US008864300B2

(12) United States Patent
Ishii et al.

(10) Patent No.: US 8,864,300 B2
(45) Date of Patent: Oct. 21, 2014

(54) LABEL PRODUCING APPARATUS AND TAPE CARTRIDGE

(75) Inventors: Hidekazu Ishii, Inazawa (JP); Takahiro Miwa, Konan (JP); Naoki Tanjima, Nisshin (JP); Tsutomu Kato, Nagoya (JP)

(73) Assignee: Brother Kogyo Kabushiki Kaisha, Nagoya-Shi, Aichi-Ken ( * ) Notice: Subject to any disclaimer, the term of this patent is extended or adjusted under 35 U.S.C. 154(b) by 196 days.

(21) Appl. No.: 13/045,959

(22) Filed: Mar. 11, 2011

(65) Prior Publication Data

US 2011/0292150 A1 Dec. 1, 2011

(30) Foreign Application Priority Data

| | | |
|---|---|---|
| May 27, 2010 | (JP) | 2010-121645 |
| May 27, 2010 | (JP) | 2010-121646 |
| Sep. 27, 2010 | (JP) | 2010-216078 |
| Sep. 27, 2010 | (JP) | 2010-216081 |
| Sep. 27, 2010 | (JP) | 2010-216082 |

(51) Int. Cl.

| | |
|---|---|
| ***B41J 2/01*** | (2006.01) |
| ***B41J 11/00*** | (2006.01) |
| ***B41J 3/407*** | (2006.01) |
| ***B41J 3/46*** | (2006.01) |

(52) U.S. Cl.

CPC ..... *B41J 3/4075* (2013.01); *B41J 11/0075* (2013.01); *B41J 3/46* (2013.01)

USPC ..... 347/104

(58) Field of Classification Search

CPC ..... B41J 2/01; B41J 2/325
USPC ..... 347/104
IPC ..... B41J 2/01
See application file for complete search history.

(56) References Cited

U.S. PATENT DOCUMENTS

| | | | |
|---|---|---|---|
| 5,492,420 | A | 2/1996 | Nunokawa et al. |
| 5,599,119 | A | 2/1997 | Nunokawa et al. |

(Continued)

FOREIGN PATENT DOCUMENTS

| | | |
|---|---|---|
| CN | 1480338 | 3/2004 |
| EP | 141411 | 5/1985 |

(Continued)

OTHER PUBLICATIONS

Office Action dated Nov. 26, 2013 from the Japanese Patent Office for Japanese Patent No. 2010-216081.

(Continued)

*Primary Examiner* — Alessandro Amari
*Assistant Examiner* — Alexander C Witkowski
(74) *Attorney, Agent, or Firm* — McCarter & English, LLP

(57) ABSTRACT

This disclosure discloses a label producing apparatus comprising: an apparatus housing; a roll holder arranged on said apparatus housing that detachably mounts thereon a tape roll winding a label producing tape; an optical detecting device that optically detects a plurality of detection mark formed at a predetermined interval along a peripheral direction of a detected body provided so as to rotate at an angular velocity in coordination with an angular velocity of said tape roll on a side of said tape roll mounted to said roll holder or on a side of said apparatus housing; a residual amount identifying portion that identifies a residual tape amount of said tape roll based on a detection result of said optical detecting device; and a residual amount related information output portion that outputs residual amount related information related to said residual tape amount identified to a display device.

10 Claims, 40 Drawing Sheets

(56) References Cited

U.S. PATENT DOCUMENTS

| | | | | |
|---|---|---|---|---|
| 5,605,404 | A | 2/1997 | Nunokawa et al. | |
| 5,634,728 | A | 6/1997 | Nunokawa et al. | |
| 5,752,777 | A | 5/1998 | Nunokawa et al. | |
| 5,765,954 | A | 6/1998 | Nunokawa et al. | |
| 5,781,708 | A * | 7/1998 | Austin et al. | 358/1.6 |
| 5,887,993 | A | 3/1999 | Nunokawa et al. | |
| 5,934,812 | A | 8/1999 | Nunokawa et al. | |
| 5,961,225 | A | 10/1999 | Nunokawa et al. | |
| 5,967,678 | A | 10/1999 | Nunokawa et al. | |
| 5,997,194 | A | 12/1999 | Nunokawa et al. | |
| 6,012,860 | A | 1/2000 | Nunokawa et al. | |
| 6,106,171 | A | 8/2000 | Nunokawa et al. | |
| 6,149,325 | A | 11/2000 | Nunokawa et al. | |
| 2001/0050320 | A1 | 12/2001 | Inana et al. | |
| 2006/0238600 | A1 * | 10/2006 | Vandermeulen et al. | 347/177 |
| 2008/0239052 | A1 * | 10/2008 | Ishii et al. | 347/104 |

FOREIGN PATENT DOCUMENTS

| | | | |
|---|---|---|---|
| JP | S62144269 | | 9/1987 |
| JP | H0428656 | A | 1/1992 |
| JP | 04246583 | | 9/1992 |
| JP | 07172649 | | 7/1995 |
| JP | H07172683 | A | 7/1995 |
| JP | 09141951 | | 6/1997 |
| JP | 2000-043338 | | 2/2000 |
| JP | 2000052629 | | 2/2000 |
| JP | 2001-253608 | | 9/2001 |
| JP | 2001-278517 | | 10/2001 |
| JP | 2002192769 | A | 7/2002 |
| JP | 2002338113 | | 11/2002 |
| JP | 2003073001 | | 3/2003 |
| JP | 2004182418 | | 7/2004 |
| JP | 3603459 | | 10/2004 |
| JP | 2005-169895 | | 6/2005 |
| JP | 2010132419 | A | 6/2010 |

OTHER PUBLICATIONS

Japanese Office Action issued in Japanese Application No. 2010-121645 on Jan. 10, 2014.

Japanese Office Action issued in Japanese Application No. 2010-216081 on Apr. 1, 2014.

Japanese Office Action issued in Japanese Application No. 2010-216078 on Jan. 24, 2014.

Japanese Office Action issued in Japanese Application No. 2010-216082 on Jan. 24, 2014.

Chinese Office Action issued in Chinese Application No. 201110084045.8 on May 4 , 2014.

* cited by examiner

| CARTRIDGE TYPE | | | LAMINATED | RECEPTOR | THERMAL |
|---|---|---|---|---|---|
| TAPE THICKNESS | t | mm | 0.120 | 0.090 | 0.160 |
| TOTAL LENGTH | Mo | mm | 8000 | 8000 | 4000 |
| ROLL INSIDE DIAMETER | d | mm | 17 | 17 | 22 |
| ROLL OUTSIDE DIAMETER | Do | mm | 39.0 | 34.7 | 36.0 |

TAPE LATERAL AREA = AREA OF OUTSIDE CIRCLE - AREA OF INSIDE CIRCLE $$t \times M = \pi (D/2)^2 - \pi (d/2)^2$$

$$= \pi (D^2 - d^2)/4$$

$$M = \pi (D^2 - d^2)/4t \ldots \text{(EQUATION A1)}$$

$S = D/2 \times \omega$ $D = 2S/\omega$ . . . (EQUATION A2)

$\omega = \theta/E$ $\theta$ : ANGLE (rad) CORRESPONDING TO ONE DETECTION MARK

E: PULSE CYCLE (s)

FIG. 16

| PULSE CYCLE E | ANGULAR VELOCITY ω | ROLL OUTSIDE DIAMETER D | TAPE RESIDUAL AMOUNT M | | |
|---|---|---|---|---|---|
| | | | LAMINATED | RECEPTOR | THERMAL |
| 0.255 | 0.513 | 38.981 | 8050 | — | — |
| 0.250 | 0.523 | 38.217 | 7664 | — | — |
| 0.245 | 0.534 | 37.452 | 7285 | — | — |
| 0.240 | 0.545 | 36.688 | 6915 | — | — |
| 0.235 | 0.557 | 35.924 | 6551 | — | 3957 |
| 0.230 | 0.569 | 35.159 | 6196 | — | 3690 |
| 0.225 | 0.581 | 34.395 | 5848 | 7798 | 3430 |
| 0.220 | 0.595 | 33.631 | 5508 | 7344 | 3174 |
| 0.215 | 0.609 | 32.866 | 5176 | 6901 | 2925 |
| 0.210 | 0.623 | 32.102 | 4851 | 6468 | 2681 |
| 0.205 | 0.638 | 31.338 | 4534 | 6045 | 2444 |
| 0.200 | 0.654 | 30.573 | 4224 | 5632 | 2211 |
| 0.195 | 0.671 | 29.809 | 3922 | 5230 | 1985 |
| 0.190 | 0.689 | 29.045 | 3628 | 4837 | 1764 |
| 0.185 | 0.707 | 28.280 | 3341 | 4455 | 1549 |
| 0.180 | 0.727 | 27.516 | 3062 | 4083 | 1340 |
| 0.175 | 0.748 | 26.752 | 2791 | 3721 | 1137 |
| 0.170 | 0.770 | 25.987 | 2527 | 3370 | 939 |
| 0.165 | 0.793 | 25.223 | 2271 | 3028 | 747 |
| 0.160 | 0.818 | 24.459 | 2023 | 2697 | 560 |
| 0.155 | 0.844 | 23.694 | 1782 | 2376 | 380 |
| 0.150 | 0.872 | 22.930 | 1549 | 2065 | 205 |
| 0.145 | 0.902 | 22.166 | 1323 | 1765 | 36 |
| 0.140 | 0.935 | 21.401 | 1106 | 1474 | — |
| 0.135 | 0.969 | 20.637 | 895 | 1194 | — |
| 0.130 | 1.006 | 19.873 | 693 | 924 | — |
| 0.125 | 1.047 | 19.108 | 498 | 664 | — |
| 0.120 | 1.090 | 18.344 | 311 | 414 | — |
| 0.115 | 1.138 | 17.580 | 131 | 175 | — |
| 0.110 | 1.189 | 16.815 | — | — | — |
| 0.105 | 1.246 | 16.051 | — | — | — |

FIG. 18

| RESIDUAL AMOUNT (m) | PULSE CYCLE | | |
|---|---|---|---|
| | LAMINATED | RECEPTOR | THERMAL |
| 8 | 0.254 | 0.227 | – |
| 7 | 0.241 | 0.216 | – |
| 6 | 0.227 | 0.204 | – |
| 5 | 0.212 | 0.192 | – |
| 4 | 0.196 | 0.179 | 0.236 |
| 3 | 0.179 | 0.165 | 0.217 |
| 2 | 0.160 | 0.149 | 0.195 |
| 1 | 0.138 | 0.131 | 0.172 |
| 0 | 0.112 | 0.112 | 0.144 |

FIG. 32

| ROLL TYPE | | | LONG | MIDDLE | SHORT |
|---|---|---|---|---|---|
| TAPE WIDTH | w | mm | 50 | 30 | 10 |
| TAPE THICKNESS | t | mm | 0.18 | 0.20 | 0.22 |
| TOTAL LENGTH | Mo | mm | 30000 | 20000 | 10000 |
| ROLL INSIDE DIAMETER | d | mm | 30 | 30 | 30 |
| ROLL OUTSIDE DIAMETER | Do | mm | 88.2 | 77.4 | 60.8 |

FIG. 34

| | | TAPE RESIDUAL AMOUNT M | | |
|---|---|---|---|---|
| PULSE CYCLE E | ROLL OUTSIDE DIAMETER D | LAMINATED | RECEPTOR | THERMAL |
| 0.255 | 38.981 | 8054 | | |
| 0.25 | 38.217 | 7667 | | |
| 0.245 | 37.452 | 7289 | | |
| 0.24 | 36.688 | 6918 | | |
| 0.235 | 35.924 | 6555 | | |
| 0.23 | 35.159 | 6199 | 8266 | |
| 0.225 | 34.395 | 5851 | 7802 | |
| 0.22 | 33.631 | 5511 | 7348 | |
| 0.215 | 32.866 | 5178 | 6904 | 3884 |
| 0.21 | 32.102 | 4853 | 6471 | 3640 |
| 0.205 | 31.338 | 4536 | 6048 | 3402 |
| 0.2 | 30.573 | 4226 | 5635 | 3170 |
| 0.195 | 29.809 | 3924 | 5232 | 2943 |
| 0.19 | 29.045 | 3630 | 4840 | 2722 |
| 0.185 | 28.280 | 3343 | 4457 | 2507 |
| 0.18 | 27.516 | 3064 | 4085 | 2298 |
| 0.175 | 26.752 | 2792 | 3723 | 2094 |
| 0.17 | 25.987 | 2529 | 3371 | 1896 |
| 0.165 | 25.223 | 2272 | 3030 | 1704 |
| 0.16 | 24.459 | 2024 | 2698 | 1518 |
| 0.155 | 23.694 | 1783 | 2377 | 1337 |
| 0.15 | 22.930 | 1550 | 2066 | 1162 |
| 0.145 | 22.166 | 1324 | 1766 | 993 |
| 0.14 | 21.401 | 1106 | 1475 | |
| 0.135 | 20.637 | 896 | 1195 | |
| 0.13 | 19.873 | 693 | 924 | |
| 0.125 | 19.108 | 498 | 664 | |
| 0.12 | 18.344 | 311 | 415 | |
| 0.115 | 17.580 | 131 | 175 | |
| 0.11 | 16.815 | | | |
| 0.105 | 16.051 | | | |

FIG. 36

| TAPE RESIDUAL AMOUNT (m) | LAMINATED PULSE CYCLE | RECEPTOR PULSE CYCLE | THERMAL PULSE CYCLE |
|---|---|---|---|
| 0 | 0.112 | 0.112 | 0.144 |
| 1 | 0.138 | 0.131 | 0.172 |
| 2 | 0.16 | 0.149 | 0.195 |
| 3 | 0.179 | 0.165 | 0.217 |
| 4 | 0.196 | 0.179 | 0.236 |
| 5 | 0.212 | 0.192 | – |
| 6 | 0.227 | 0.204 | – |
| 7 | 0.241 | 0.216 | – |
| 8 | 0.254 | 0.227 | – |

$$L = D/2 \times \omega$$

$$\omega = \theta N$$

$$D = 2L/\theta N \quad \text{(EQUATION C2)}$$

L: FEEDING DISTANCE IN PREDETERMINED TIME RANGE $\theta$ : ANGLE (rad) CORRESPONDING TO ONE DETECTION MARK

N: NUMBER OF DETECTION MARKS DETECTED IN PREDETERMINED TIME RANGE

FIG. 39

| FEEDING DISTANCE L (mm)) | ROLL OUTSIDE DIAMETER D (mm) | TAPE RESIDUAL AMOUNT M | | |
|---|---|---|---|---|
| | | LAMINATED | RECEPTOR | THERMAL |
| 2.56 | 39. 134 | 8128 | 10837 | 5139 |
| 2. 55 | 38. 981 | 8050 | 10733 | 5080 |
| 2. 54 | 38. 828 | 7972 | 10629 | 5022 |
| 2. 53 | 38. 675 | 7894 | 10526 | 4964 |
| 2. 52 | 38. 522 | 7817 | 10423 | 4906 |
| : | : | : | : | : |
| 2. 18 | 33. 325 | 5374 | 7166 | 3074 |
| 2. 17 | 33. 172 | 5308 | 7077 | 3024 |
| 2. 16 | 33. 019 | 5242 | 6989 | 2974 |
| : | : | : | : | : |
| 1. 49 | 22. 777 | 1503 | 2004 | 171 |
| 1. 48 | 22. 624 | 1458 | 1944 | 137 |
| 1. 47 | 22. 471 | 1413 | 1884 | 103 |
| : | : | : | : | : |
| 1. 16 | 17. 732 | 166 | 222 | −832 |
| 1. 15 | 17. 580 | 131 | 175 | −858 |
| 1. 14 | 17. 427 | 96 | 128 | −885 |
| 1. 13 | 17. 274 | 61 | 82 | −911 |
| 1. 12 | 17. 121 | 27 | 36 | −936 |

FIG. 40

| NUMBER OF PULSES N | TAPE RESIDUAL AMOUNT M | | |
|---|---|---|---|
| | LAMINATED | RECEPTOR | THERMAL |
| 39 | 8160 | 10880 | 5163 |
| 40 | 7664 | 10218 | 4791 |
| 41 | 7203 | 9604 | 4446 |
| 42 | 6775 | 9034 | 4125 |
| 43 | 6377 | 8503 | 3826 |
| ⋮ | ⋮ | ⋮ | ⋮ |
| 51 | 3987 | 5316 | 2033 |
| 52 | 3763 | 5017 | 1865 |
| 53 | 3551 | 4735 | 1707 |
| ⋮ | ⋮ | ⋮ | ⋮ |
| 68 | 1415 | 1887 | 105 |
| 69 | 1320 | 1760 | 33 |
| 70 | 1229 | 1639 | −35 |
| ⋮ | ⋮ | ⋮ | ⋮ |
| 85 | 225 | 300 | −788 |
| 86 | 176 | 235 | −824 |
| 87 | 129 | 172 | −860 |
| 88 | 83 | 111 | −894 |
| 89 | 39 | 52 | −927 |

FIG. 41

| TAPE RESIDUAL AMOUNT (m) | FEEDING DISTANCE L | | | NUMBER OF PULSES N | | |
|---|---|---|---|---|---|---|
| | LAMINATED | RECEPTOR | THERMAL | LAMINATED | RECEPTOR | THERMAL |
| 8 | 2. 54 | 2. 27 | – | 39 | 44 | – |
| 7 | 2. 41 | 2. 16 | – | 41 | 46 | – |
| 6 | 2. 27 | 2. 04 | – | 44 | 49 | – |
| 5 | 2. 12 | 1. 92 | – | 47 | 52 | – |
| 4 | 1. 96 | 1. 79 | 2. 35 | 51 | 56 | 42 |
| 3 | 1. 79 | 1. 65 | 2. 17 | 56 | 61 | 46 |
| 2 | 1. 60 | 1. 49 | 1. 95 | 63 | 68 | 51 |
| 1 | 1. 38 | 1. 31 | 1. 72 | 73 | 76 | 58 |
| 0 | 1. 12 | 1. 12 | 1. 44 | 89 | 89 | 69 |

LABEL PRODUCING APPARATUS AND TAPE CARTRIDGE

CROSS-REFERENCE TO RELATED APPLICATION

The present application claims priority from Japanese Patent Application No. 2010-121646, which was filed on May 27, 2010, No. 2010-216078, which was filed on Sep. 27, 2010, No. 2010-216081, which was filed on Sep. 27, 2010, and No. 2010-216082, which was filed on Sep. 27, 2010, No. 2010-121645, which was filed on May 27, 2010, the disclosure of which are incorporated herein by reference in its entirety.

BACKGROUND

1. Field

The present disclosure relates to a label producing apparatus configured to produce a printed label using a label producing tape, and a tape cartridge used in this label producing apparatus.

2. Description of the Related Art

Label producing apparatuses configured to produce printed labels using a label producing tape have been known for some time. In such a label producing apparatus, when a tape cartridge is mounted to a cartridge holder, the label producing tape is fed out from the tape roll housed in the cartridge by feeding device and desired printing is performed by printing device, thereby producing a printed label.

For such a structure that thus feeds out tape from a tape roll, there is known a technique in which the angular velocity of the tape roll is detected to detect the residual tape amount. This prior art utilizes the fact that the rotation of the tape roll accelerates as the residual tape amount in the tape roll decreases. That is, a rotary encoder provided to the tape roll is detected by an optical sensor, and the angular velocity of the tape roll is detected from the pulse output thereof. When this angular velocity reaches a preset angular velocity, an alert regarding the residual tape amount is issued.

With the label producing apparatus described above, it is possible to produce a plurality of types of printed labels, such as a so-called laminated type that is produced by bonding a cover film on that printing was performed to a label producing tape, and a so-called non-laminated type that is produced by directly performing printing on a label producing tape. In such a label producing apparatus, different types of tape cartridges are used in accordance with the type of printed label to be produced. In general, when the type of tape cartridge differs, the thickness of the label producing tape housed in the cartridge and the inside diameter of the tape roll differ.

When the angular velocity of the tape roll is detected and the residual tape amount is calculated from the angular velocity as in the above-described prior art, parameters such as tape thickness and inside tape roll diameter are required, even though this is not clearly stated in the prior art. Therefore, when the prior art described above is applied to the label producing apparatus to detect the residual tape amount of a tape roll in the aforementioned label producing apparatus, the possibility exists that the residual tape amount will not be accurately detected since parameters such as tape thickness and inside tape roll diameter change according to the type of tape cartridge as described above.

SUMMARY

It is therefore an object of the present disclosure to provide a label producing apparatus and tape cartridge that enable an operator to reliably recognize the residual tape amount.

In order to achieve the above-mentioned object, according to the first aspect, there is provided a label producing apparatus comprising: an apparatus housing constituting an apparatus outer shell; a roll holder arranged on the apparatus housing that detachably mounts thereon a tape roll winding a label producing tape; an optical detecting device that optically detects a plurality of detection mark formed at a predetermined interval along a peripheral direction of a detected body provided so as to rotate at an angular velocity in coordination with an angular velocity of the tape roll on a side of the tape roll mounted to the roll holder or on a side of the apparatus housing; a residual amount identifying portion that identifies a residual tape amount of the tape roll based on a detection result of the optical detecting device; and a residual amount related information output portion that outputs residual amount related information related to the residual tape amount identified by the residual amount identifying portion to a display device.

When a printed label is produced using the label producing apparatus, the outside diameter of the tape roll gradually decreases as the label producing tape is fed out. As a result, in a case where the tape feeding speed is constant, the angular velocity of the turning of the spool of the tape roll gradually increases in accordance with the roll outside diameter. Thus, there is a predetermined correlation between the roll outside diameter (that is, the residual tape amount) and the angular velocity of the tape roll, making it possible to utilize this correlation to identify the residual tape amount from the tape roll angular velocity.

According to the first aspect of the present disclosure, a detected body that rotates at an angular velocity in coordination with the angular velocity of the tape roll is provided on the tape roll side or apparatus housing side, and an optical detecting device optically detects detection mark of the detected body. Then, a residual amount identifying portion identifies the residual tape amount of the tape roll based on the detection result of the optical detecting device in accordance with the above-described angular velocity, and a residual amount related information output portion outputs residual amount related information in relation to the identified residual tape amount to a display device. With this arrangement, the residual amount related information can be displayed on a display part serving as display device, such as a liquid crystal screen of the label producing apparatus itself or a display part of a PC terminal connected via a network, etc., to the label producing apparatus. This makes it possible for the operator to reliably recognize the residual tape amount.

According to the second aspect, in the first aspect, the label producing apparatus further comprises a type information acquisition portion that acquires type information of the tape roll mounted to the roll holder; wherein: the residual amount identifying portion identifies a residual tape amount of the tape roll based on the type information acquired by the type information acquisition portion and a detection result of the optical detecting device.

With the label producing apparatus, it is possible to produce a plurality of different types of printed labels, such as a so-called laminated type that is produced by bonding a print-receiving tape on which printing was performed to a label producing tape, and a so-called non-laminated type that is produced by directly performing printing on a label producing tape, for example. In such a case, a plurality of different types of tape rolls is used in accordance with the types of printed labels to be produced. When the tape roll type differs, the above-described correlation between the residual tape amount and tape roll angular velocity also differs.

According to a second aspect of the present disclosure, a type information acquisition portion acquires the type information of the tape roll mounted to the roll holder. Then, the residual amount identifying portion identifies the residual tape amount of the tape roll based on both the type information acquired by the type information acquisition portion and the detection result of the optical detecting device.

With the residual tape amount thus identified by the type information of the tape roll and the detection result of the optical detecting device, the residual tape amount can be identified in accordance with the tape roll type, even in the aforementioned case where a plurality of different types of tape rolls is used in the label producing apparatus. As a result, the operator can reliably recognize the residual tape amount, even when a plurality of different types of printed labels is produced.

According to the third aspect, in the first aspect, the label producing apparatus further comprises a feeding device that feeds the label producing tape fed out from the tape roll; a feeding distance calculation portion that calculates a feeding distance caused by the feeding device; and a thickness calculation portion the calculates a tape thickness of the label producing tape based on predetermined calculation formulas using history information of a detection cycle at which the plurality of detection mark is consecutively detected based on a detection result of the optical detecting device and the feeding distance calculated by the feeding distance calculation portion; wherein: the roll holder detachably mounts a tape roll that winds the label producing tape around a winding core having a predetermined outside diameter; and the residual amount identifying portion identifies the residual tape amount of the tape roll by calculating the residual tape amount based on predetermined calculation formulas using the tape thickness calculated by the thickness calculation portion, the outside diameter of the winding core, and the history information.

When printed labels are produced, there is a predetermined correlation between the roll outside diameter (that is, the residual tape amount) and the tape roll angular velocity, as previously mentioned. Then, a plurality of different tape rolls is used in accordance with the types of printed labels to be produced.

When the tape roll type differs, the tape thickness differs, and thus the above-described correlation between the residual tape amount and tape roll angular velocity also differs. According to a third aspect of the present disclosure, a feeding distance calculation portion calculates the feeding distance of the feeding device. Then, the residual amount identifying portion identifies the residual tape amount based on predetermined calculation formulas using the history information of the detection cycles at which the plurality of detection mark are consecutively detected, based on the predetermined outside diameter of the winding core (spool), the feeding distance detected by the feeding distance calculation portion, and the detection result of the optical detecting device. With this arrangement, residual amount related information can be displayed on a display part serving as a display device, such as a liquid crystal screen of the label producing apparatus itself or a display part of a PC terminal connected via a network, etc., to the label producing apparatus.

If the outside diameter of the winding core is thus known, it is possible to identify the residual tape amount based on the feeding distance calculation portion and the detection result of optical detecting device without acquiring the parameter information (tape thickness, etc.) that differs for each tape roll type. As a result, it is possible to identify the residual tape amount in accordance with the tape roll type even in a case where the aforementioned plurality of different types of tape rolls is used in the label producing apparatus.

In addition, as described above, according to the third aspect of the present disclosure, the residual tape amount is consecutively calculated based on the feeding distance calculation portion and the detection result of the optical detecting device without acquiring parameter information (tape thickness in the above-described example). With this arrangement, it is no longer necessary to acquire tape roll type information. This makes it is possible to reliably identify the residual tape amount even in a case where a new tape roll of an unknown tape thickness is used.

Furthermore, in an actual product of the label producing tape, the tape thickness is not always constant, but rather fluctuates within a range of product error. In response, according to the third aspect of the present disclosure, the tape thickness of the label producing tape is consecutively calculated by the above-described predetermined calculation formulas, making it possible to identify the residual tape amount with accuracy in a form that accommodates the fluctuation in the above-described tape thickness which differs for each tape section as described above.

According to the fourth aspect, in the first aspect, the label producing apparatus further comprises a type information acquisition portion that acquires type information of the tape roll mounted to the roll holder; a fourth storage device that stores a parameter table that indicates a tape thickness of the label producing tape and an inside diameter of the tape roll for each type of the tape roll; a parameter information acquisition portion that acquires a tape thickness of the label producing tape and an inside diameter of the tape roll corresponding to the type information acquired by the type information acquisition portion by referring to the parameter table; a feeding device that feeds the label producing tape fed out from the tape roll; and a feeding distance calculation portion that calculates a feeding distance caused by the feeding device; wherein: the residual amount identifying portion identifies the residual tape amount of the tape roll by calculating the residual tape amount based on predetermined calculation formulas using the tape thickness of the label producing tape and the inside diameter of the tape roll acquired by the parameter information acquisition portion, a number of the detection mark detected by the optical detecting device; and the feeding distance calculated by the feeding distance calculation portion.

When printed labels are produced, there is a predetermined correlation between the roll outside diameter (that is, the residual tape amount) and the tape roll angular velocity, as previously mentioned. Then, a plurality of different tape rolls is used in accordance with the types of printed labels to be produced.

In general, when the tape roll type differs, the above-described correlation between the residual tape amount and tape roll angular velocity also differs. Further, the tape thickness of the label producing tape, the inside diameter of the tape roll, etc., also differ. According to the fourth aspect of the present disclosure, a parameter table that indicates the tape thickness of the label producing tape and the inside diameter of the tape roll for each tape roll type is stored in advance in fourth storage device. Then, parameter information acquisition portion refers to the parameter table and acquires as parameter information the tape thickness and inside tape roll diameter corresponding to the tape roll type information acquired by the type information acquisition portion. In addition, the detected body that rotates at an angular velocity in coordination with the angular velocity of the tape roll is provided, and the optical detecting device optically detects the detection mark of the detected body. When this happens, the number of detection mark detected per unit time corresponds to the angular velocity of the tape roll. In addition, the feeding distance calculation portion calculates the feeding distance of the feeding device. Then, the residual amount identifying portion identifies the residual tape amount based on predetermined calculation formulas using the tape thickness and inside tape roll diameter of the label producing tape acquired by the parameter information acquisition portion, the number of detection mark detected by the optical detecting device, and the feeding distance calculated by the feeding distance calculation portion, and residual amount related information output portion outputs the identified residual amount related information related to the residual tape amount to the display device.

The tape thickness and inside tape roll diameter that differ for each tape roll type are thus acquired as parameter information and the residual tape amount is identified based on this information, the calculation result of the feeding distance calculation portion, and the detection result of the optical detecting device, thereby making it possible to identify the residual tape amount in accordance with the tape roll type, even in a case where the aforementioned plurality of different types of tape rolls is used in the label producing apparatus. As a result, the operator can reliably recognize the residual tape amount, even when a plurality of different types of printed labels is produced.

In addition, as described above, according to the fourth aspect of the present disclosure, the residual tape amount is consecutively calculated based on the parameter information (the inside tape roll diameter and label producing tape thickness in the above-described example), the calculation result of the feeding distance calculation portion, and the detection result of the optical detecting device. With this arrangement, there is no fluctuation in accuracy in response to the data volume in the table compared to a case where the residual tape amount is identified using a residual amount table in which the correlation between the tape roll angular velocity, etc., and the residual tape amount is set in advance. As a result, the residual tape amount can be detected with high accuracy. In turn, the operator can identify in detail the residual tape amount. Further, since the residual tape amount can be detected with high accuracy, it is also possible to perform processing based on the residual tape amount, such as continually producing printed labels in accordance with the residual tape amount, or controlling the feeding force (tape feed-out force) by the feeding device in accordance with the residual tape amount to improve the stability of tape feeding.

Further, with the identification of the tape thickness and inside tape roll diameter using a parameter table prepared in advance as described above, the amount of information to be acquired can be decreased compared to a case where the tape thickness and inside tape roll diameter are acquired in addition to the tape roll type information by the type information acquisition portion, resulting also in the advantage of simplifying the structure of the sensor mechanism in a case where the type information acquisition portion is a mechanical sensor mechanism, for example.

According to the fifth aspect, in the label producing apparatus according to the first aspect, the roll holder is a cartridge holder that detachably mounts thereon a tape cartridge that includes the tape roll inside a cartridge housing and is provided to the apparatus housing; the optical detecting device optically detects the plurality of detection marks formed at a predetermined interval along a peripheral direction on the detected body provided so as to rotate at a same angular velocity as the tape roll inside the cartridge housing of the tape cartridge mounted to the cartridge holder, from outside the cartridge housing; the residual amount identifying portion calculates a residual tape amount using a predetermined correlation between a residual tape amount of the tape roll and an angular velocity of the tape roll based on a detection result of the optical detecting device; and the residual amount related information output portion outputs residual amount related information related to the residual tape amount calculated by the residual amount identifying portion to a display device.

According to the fifth aspect of the present disclosure, a detected body that rotates at the same angular velocity as the tape roll inside the cartridge housing is provided, and the optical detecting device optically detects the detection mark of the detected body from outside the cartridge housing. Then, the residual amount identifying portion calculates the residual tape amount from the tape roll angular velocity using the above-described correlation based on the detection result of the optical detecting device, and the residual amount related information output portion outputs the residual amount related information related to the calculated residual tape amount to the display device. With this arrangement, the operator can reliably recognize the residual tape amount. Further, if the residual amount related information output portion outputs alarm information as the residual amount related information when the residual tape amount decreases below a predetermined level, it is possible to prevent the occurrence of an apparatus defect that results when an operator fails to realize that the tape has ended and performs printing without any tape. Furthermore, it is also possible to continually produce printed labels in accordance with the residual tape amount calculated by the residual amount identifying portion, control the feeding force (tape feed-out force) by the feeding device in accordance with the residual tape amount, improve the stability of tape feeding, enhance the print quality, and the like.

In order to achieve the above-mentioned object, according to the sixth aspect, there is provided a tape cartridge configured to include a tape roll winding a label producing tape in a cartridge housing, comprising: a detected body on which a plurality of detection marks are formed at a predetermined interval along a peripheral direction of the tape roll, that is provided inside the cartridge housing so as to rotate at a same angular velocity as the tape roll; and at least one transmission hole that is provided on the cartridge housing.

In order to achieve the above-mentioned object, according to the seventh aspect, there is provided a tape cartridge configured to be detachably mounted on a cartridge holder of a label producing apparatus that produces printed labels and to include a tape roll winding a label producing tape in a cartridge housing, comprising: a detected body on which a plurality of detection marks are formed at a predetermined interval along a peripheral direction of the tape roll, that is provided inside the cartridge housing so as to rotate at a same angular velocity as the tape roll; and at least one transmission hole that is provided on the cartridge housing and through which is transmitted a detection light inputted and outputted by an optical detecting device that optically detects the detection mark of the detected body from outside the cartridge housing.

According to the sixth or seventh aspect of the present disclosure, a detected body that rotates at the same angular velocity as the tape roll is provided inside the cartridge housing, and at least one transmission hole that transmits detection light inputted and outputted by the optical detecting device that optically detects the detection mark of the detected body from outside the cartridge housing is provided on the cartridge housing. With this arrangement, it is possible to calculate the residual tape amount using the aforementioned correlation from the tape roll angular velocity based on the detected result of the optical detecting device. As a result, the operator is alerted to the residual tape amount, making it possible for the operator to reliably recognize the residual tape amount.

BRIEF DESCRIPTION OF THE DRAWINGS

FIG. 14 is a diagram for explaining the method of calculating the residual tape amount from the roll outside diameter.

FIG. 16 shows an example of a residual amount table stored in the table storage part.

FIG. 18 shows another example of a residual amount table stored in the table storage part.

FIG. 32 shows an example of a parameter table stored in the table storage part.

FIG. 34 shows an example of a residual amount table stored in the table storage part.

FIG. 36 shows another example of a residual amount table stored in the table storage part.

FIG. 39 shows an example of a table of an exemplary modification that uses a residual amount table stored in the table storage part.

FIG. 40 shows another example of a residual amount table stored in the table storage part.

FIG. 41 shows yet another example of a residual amount table stored in the table storage part.

DETAILED DESCRIPTION OF THE PREFERRED EMBODIMENTS

In the following, some embodiments of the present disclosure will be described with reference to the accompanying drawings.

A first embodiment of the present disclosure will now be described with reference to FIGS. 1 to 32.

Figure 1:
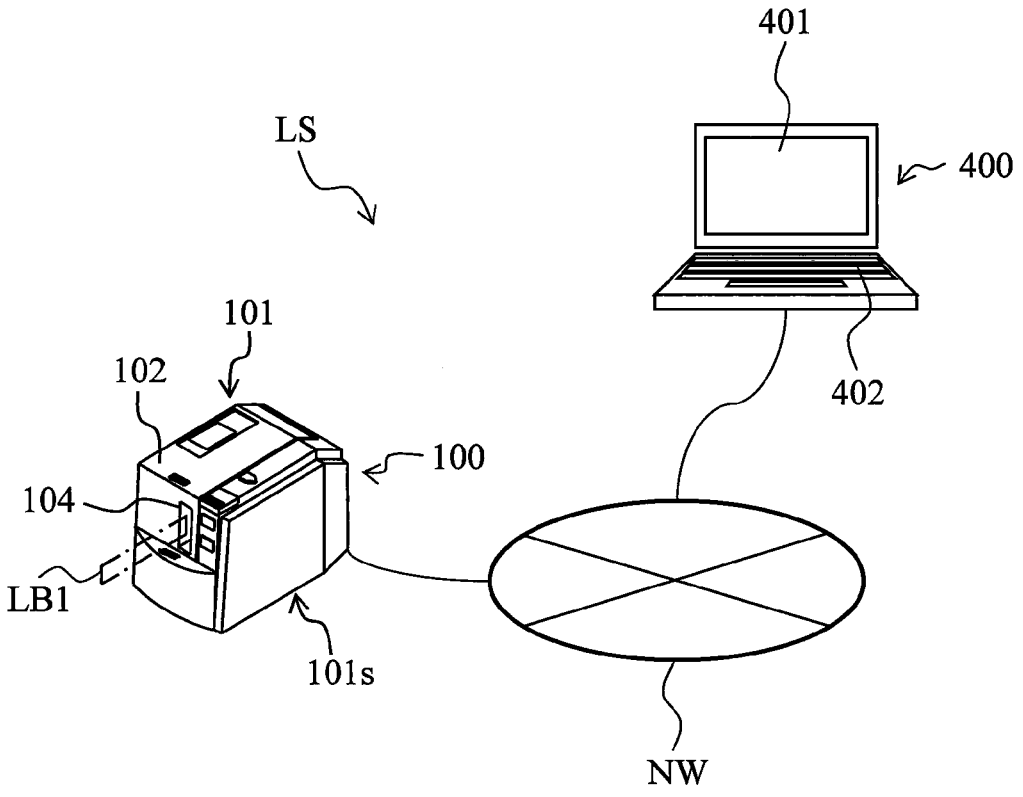
FIG. 1 is a system configuration diagram illustrating a label producing system comprising the label producing apparatus of the first embodiment of the present disclosure.

The configuration of the label producing system of this embodiment will now be described with reference to FIG. 1. In FIG. 1, a label producing system LS comprises a label producing apparatus 100 capable of producing a printed label LB1 (refer to FIG. 9 as well described later) on which desired printing was performed, and an operation terminal 400 for operating the above-described label producing apparatus 100. The label producing apparatus 100 and the operation terminal 400 are connected in an information communicable way via a wired or wireless communication line NW.

The label producing apparatus 100 has an apparatus main body 101 comprising an apparatus housing 101*s* of an overall rectangular shape as an outer shell of the label producing apparatus 100. On the upper surface of the apparatus main body 101 is provided an opening/closing lid 102 provided in a manner that enables opening and closing (or in a detachable manner). A tape discharging exit 104 is provided on the front surface of the apparatus main body 101. This tape discharging exit 104 is a discharging exit for discharging a produced label tape 23 with print, etc. (refer to FIG. 3 to FIG. 5 described later).

The operation terminal 400 is generally a commercially-sold general-purpose personal computer, which has a display part 401, such as a liquid crystal display, and an operation part 402, such as a keyboard or mouse.

The outer appearance configuration of the cartridge holder inside the apparatus main body 101 and the cartridge mounted thereto with the opening/closing lid 102 of the label producing apparatus 100 open will now be described with reference to FIG. 2. Note that, in FIG. 2, the illustration of the opening/closing lid 102 opened upward has been omitted to avoid illustration complexities.

Figure 2:
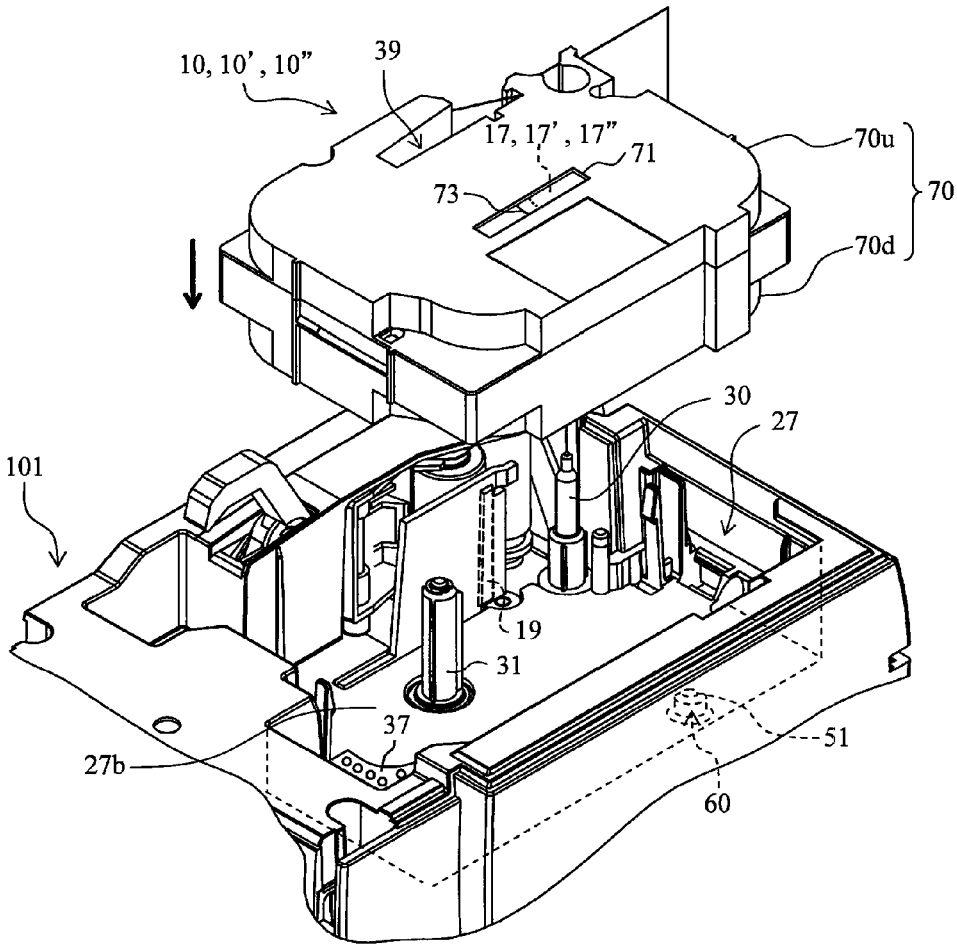
FIG. 2 is a perspective view illustrating the outer appearance configuration of a cartridge holder inside the label producing apparatus main body and a cartridge mounted thereto, with the opening/closing lid of the apparatus open.

In FIG. 2, a cartridge holder 27, a print head 19, a feeding roller driving shaft 30, a ribbon take-up roller driving shaft 31, a cartridge sensor 37, and a first optical sensor 51 are provided in the interior of the apparatus main body 101 of the label producing apparatus 100.

The cartridge holder 27 enables selective attachment and detachment of cartridges 10, 10', and 10" of a plurality of types having different types of tape (in other words, roll types; hereinafter the same) housed therein. The cartridge 10 is a cartridge (refer to FIG. 3 described later) having a base tape roll 17 around which is wound a base tape 16 for producing the printed label LB1. The cartridge 10' is a cartridge (refer to FIG. 4 described later) having a thermal tape roll 17' around which is wound a thermal tape 16' for producing the printed label LB1. The cartridge 10" is a cartridge (refer to FIG. 5 described later) having a receptor tape roll 17" around which is wound a receptor tape 16" for producing the printed label LB1. Furthermore, with each of the cartridges 10, 10', and 10" having the above-described different tape types (in other words, roll types), the cartridge holder 27 enables selective attachment and detachment of a plurality of types of cartridges (in other words, a plurality of types of rolls) having different tape widths housed therein. Note that cartridges of tape types other than the above-described types may also be used.

Hereinafter, the above-described cartridges 10, 10', and 10" will be generally referred to as "cartridge 10, etc."; the base tape 16, the thermal tape 16', and the receptor tape 16" will be generally referred to as "label producing tapes 16, 16', and 16"; and the base tape roll 17, the thermal tape roll 17', and the receptor tape roll 17" will be generally referred to as "tape rolls 17, 17', and 17"."

The print head 19 performs desired printing on a cover film 11, etc., fed out from the above-described feeding roller driving shaft 30, etc. The feeding roller driving shaft 30 and the ribbon take-up roller driving shaft 31 are driving shafts that respectively provide feeding driving power to a used ink ribbon 13 and the label tape 23 with print (for both, refer to FIG. 3 described later), and are rotationally driven in coordination.

The cartridge sensor 37 indirectly detects the type information of the cartridge 10, etc., by mechanically detecting a detected part 24 (refer to FIG. 3 to FIG. 5 described later) formed on the mounted cartridge 10, etc., when the cartridge 10, etc., is mounted. As described above, in this embodiment, the cartridge types (in other words, the roll types) include a laminated type comprising the base tape 16 and the cover film 11 that is bonded thereto, such as the cartridge 10 shown in FIG. 3 described later, a thermal type comprising the thermal tape 16', such as the cartridge 10' shown in FIG. 4 described later, and a receptor type comprising the receptor tape 16", such as the cartridge 10" shown in FIG. 5 described later.

The first optical sensor 51 is an optical sensor that optically detects from outside a cartridge housing 70 a plurality of detection mark 75 (refer to FIG. 3 described later) formed at a predetermined interval around the periphery of a detected body 74 (refer to FIG. 3 described later) provided so as to rotate at the same angular velocity as the above-described base tape roll 17 inside the cartridge housing 70 of the cartridge 10, etc., mounted to the cartridge holder 27. A control circuit 40 described later (refer to FIG. 8 described later) is capable of detecting the angular velocity of the base tape roll 17 based on an encoder pulse output from the above-described first optical sensor 51. Note that, while described in detail later, this first optical sensor 51 is supported in a retractable/extendable manner with respect to a bottom 27*b* of the cartridge holder 27 by a sensor support mechanism 60.

On the other hand, the cartridge 10, etc., comprises the above-describe cartridge housing 70 formed in an overall rectangular shape, and a head insertion opening 39 that passes through both the front and rear surfaces for insertion of the above-described print head 19 is formed on this cartridge housing 70. A residual amount observation window 71 of a long-hole shape for the operator to visually check the residual tape amount of the base tape 16 is provided on an upper part 70*u* of the cartridge housing 70. Further, a transmission hole 72 (not shown in FIG. 2; refer to FIG. 3 described later) that transmits detection light from the above-described first optical sensor 51 is provided on a lower part 70*d* of the cartridge housing 70.

The structure of the area surrounding the cartridge holder 27 with the above-described cartridge 10 of the laminated type mounted thereto will now be described with reference to FIG. 3.

Figure 3:
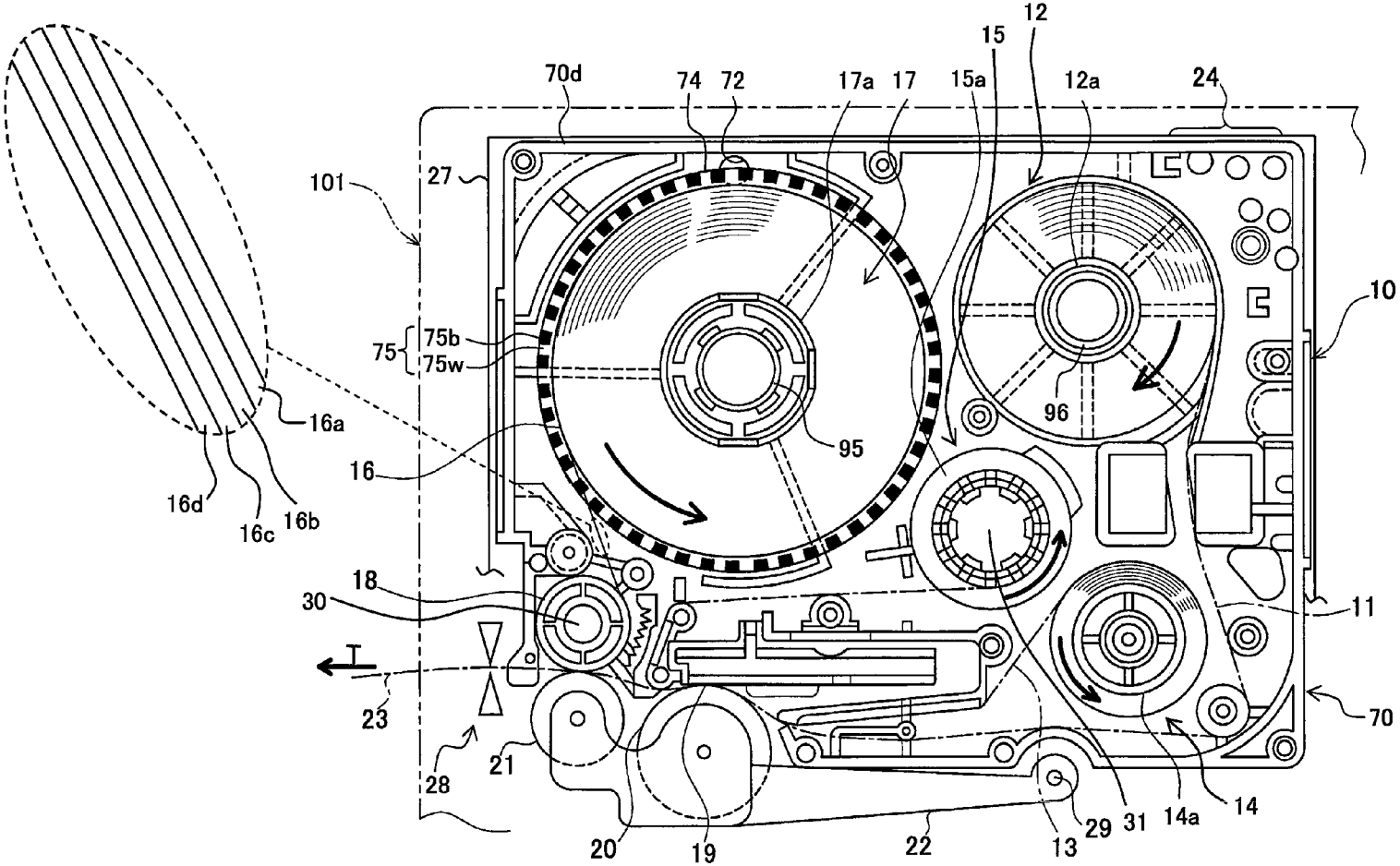
FIG. 3 is a diagram illustrating the area surrounding the cartridge holder with a laminated type of cartridge mounted thereto, along with the cartridge.

In FIG. 3, the cartridge 10 is detachably housed in the above-described cartridge holder 27, which is a recess within the apparatus main body 101. The cartridge 10 comprises the base tape roll 17 around which the base tape 16 is wound, a cover film roll 12 around which the cover film 11 is wound, a ribbon supply side roll 14 configured to feed out an ink ribbon 13 for printing, a ribbon take-up roller 15 configured to rewind the ink ribbon 13 after the printing, and a feeding roller 18.

The base tape roll 17 is provided with the above-described base tape 16 that is wound around the periphery of a base tape spool 17*a* rotatably inserted into a boss 95 established on the bottom of the cartridge 10.

The base tape 16 comprises a layered structure of a plurality of layers (four layers in this example; refer to the partially enlarged view in FIG. 3). That is, the base tape 16 is designed with layers comprised of an adhesive layer 16*a* made of a suitable adhesive for bonding the above-described cover film 11, a tape base layer 16*b* made of PET (polyethylene terephthalate) or the like, an adhesive layer 16*c* made of a suitable adhesive, and a separation sheet 16*d*, which are layered in that order from the side wrapped on the inside (the right side in FIG. 3) to the opposite side (the left side in FIG. 3).

The separation sheet 16*d* is peeled off when the printed label LB1 eventually formed is to be affixed to an object such as a predetermined article, thereby making it possible to adhere the printed label LB1 to the article or the like by the adhesive layer 16*c*.

The cover film roll 12 is provided with the cover film 11 that has substantially the same width as the above-describe base tape 16 in this example and is wound around the periphery of a cover film spool 12*a* rotatably inserted into a boss 96 established on the bottom of the cartridge 10.

The ribbon supply side roll 14 is provided with the ink ribbon 13 that is wound around a ribbon supply side spool 14*a* comprising a shaft that is orthogonal to the longitudinal direction of the ink ribbon 13. The ribbon take-up roller 15 comprises a ribbon take-up spool 15*a* comprising a shaft orthogonal to the longitudinal direction of the ink ribbon 13, and is configured to wind up the used ink ribbon 13 around the ribbon take-up spool 15*a* when driven by the above-described ribbon take-up roller driving shaft 31 on the side of the cartridge holder 27.

The feeding roller 18 is configured to affix the above-described base tape 16 and the above-described cover film 11 to each other by applying pressure, and feeds the label tape 23 with print thus formed in the direction of an arrow T in FIG. 3, when driven by the above-described feeding roller driving shaft 30 on the side of the cartridge holder 27. That is, the feeding roller 18 functions as a pressure roller as well.

The above-described ribbon take-up roller 15 and the feeding roller 18 are rotationally driven in coordination by the driving power of a feeding motor 33 (refer to FIG. 8 described later), which is a pulse motor, for example, provided on the outside of each of the cartridges 10. This driving power is transmitted to the above-described ribbon take-up roller driving shaft 31 and the feeding roller driving shaft 30 via a gear mechanism (not shown).

The detected part 24 is formed on the cartridge 10 in the corner (the upper right corner in FIG. 3) that is opposite the above-described feeding roller 18. A plurality of switch holes is formed in predetermined patterns on this detected part 24, and each of these patterns includes cartridge type information as described above, such as the type of the cartridge 10, the tape thickness of the base tape 16, and an inside diameter of the above-described base tape roll 17. The aforementioned cartridge sensor 37 (refer to FIG. 2) detects the pattern of the switch holes which differs according to the type of the cartridge 10 as described above, making it possible to detect the type of the cartridge 10 (in other words, the roll type).

On the other hand, the cartridge holder 27 comprises the above-described print head 19, the above-described ribbon take-up roller driving shaft 31, the above-described feeding roller driving shaft 30, and a roller holder 22. The print head 19 comprises a plurality of heat emitting elements, and performs printing in a predetermined print area of the cover film 11 fed out from the above-described cover film roll 12.

The feeding roller driving shaft 30 feeds the cover film 11 fed out from the cover film roll 12 of the cartridge 10 mounted to the cartridge holder 27, and the base tape 16 fed out from the base tape roll 17 when driven by the above-described feeding roller 18.

The roller holder 22 is rotatably supported by a support shaft 29 and can switch between a printing position and a release position via a switching mechanism. On this roller holder 22 are rotatably provided a platen roller 20 and a tape pressure roller 21. When the roller holder 22 switches to the above-described printing position, the platen roller 20 and the tape pressure roller 21 press against the above-described print head 19 and the feeding roller 18.

Furthermore, on the cartridge holder 27 is provided a cutter 28 that is adjacent to a discharging exit (not shown) of the cartridge 10. This cutter 28 operates when a cutter driving button 38 (refer to FIG. 8 described later) is pressed, cutting the label tape 23 with print at a predetermined length to produce the printed label LB1.

In addition, circular shaped film members 73 and 74 configured to prevent defects caused by the protrusion of adhesive from the base tape 16 are respectively provided on both end sides in the axial direction (the vertical direction of the paper in FIG. 3) of the above-described base tape spool 17*a* so as to contact both ends in the width direction (the vertical direction of the paper in FIG. 3) of the base tape roll 17. The plurality of detection mark 75 comprising a light-reflective area 75*w* and a light-absorbing area 75*b* is formed at a predetermined interval in the peripheral direction of the base tape roll 17, on the film member 74 (refer to FIG. 3) on the downward side, on the outer peripheral end in the radial direction thereof, when the cartridge 10 is mounted to the cartridge holder 27. While 48 detection marks 75 are formed in this embodiment as shown in the figure, another quantity is acceptable. This film member 74 is engaged to the outer peripheral surface of the base tape spool 17*a*, for example, so that it rotates at an angular velocity (the same angular velocity in this example) in coordination with the base tape roll 17 (basically, the base tape spool 17*a*). In this specification, the film member 74 is suitably referred to as the "detected body 74."

The detected body 74 is made of a transparent or semi-transparent film material. The light-reflective area 75*w* of the above-described detection mark 75 is formed by printing a white or silver color on the film, and reflects incident light. The above-described light-absorbing area 75*b* is transparently or semi-transparently formed by printing a black color or nothing on the film, and absorbs or transmits incident light.

The film member 73 (refer to FIG. 2) that is positioned on the upper side when the cartridge 10 is mounted to the cartridge holder 27 is made of the same transparent or semi-transparent film as the film member 74. With this arrangement, as shown in FIG. 2, the operator can look at the film member 73 through the residual amount observation window 71 and visually check the rough residual tape amount.

The above-described detection mark 75 are formed on the outer peripheral end in the radial direction of the detected body 74, more specifically, in an area further on the outer peripheral side than the roll contour when an outside diameter of the base tape roll 17 in its largest state (the state shown in FIG. 3). With this arrangement, the outside diameter of the base tape roll 17 subsequently only decreases as the base tape 16 is fed out, making it possible to achieve good detection of the detection mark 75 by the first optical sensor 51 without overlap between the detection mark 75 and the roll contour.

The transmission hole 72 for transmitting the detection light from the first optical sensor 51 that optically detects the detection mark 75 of the detected body 74 from outside the cartridge housing 70 is provided on the lower part 70*d* of the cartridge housing 70, as described above. In this embodiment, the transmission hole 72 is formed into a circular shape.

With the above-described configuration, once the cartridge 10 is mounted to the above-described cartridge holder 27, the ribbon take-up roller driving shaft 31 and the feeding roller driving shaft 30 are simultaneously rotationally driven by the driving power of the feeding motor 33 (refer to FIG. 8 described later). The feeding roller 18, the platen roller 20, and the tape pressure roller 21 rotate in accordance with the drive of the feeding roller driving shaft 30, thereby feeding out the base tape 16 from the base tape roll 17 and supplying the base tape 16 to the feeding roller 18 as described above. On the other hand, the cover film 11 is fed out from the cover film roll 12 and power is supplied to the plurality of heat emitting elements of the print head 19 by a print-head driving circuit 32 (refer to FIG. 8 described later). At this time, the ink ribbon 13 is pressed against the above-described print head 19, coming in contact with the rear surface of the cover film 11. As a result, desired printing is performed in the predetermined print area on the rear surface of the cover film 11. Then, the above-described base tape 16 and the above-described cover film 11 on which printing was performed are affixed to each other by the feeding roller 18 and the tape pressure roller 21 so as to form a single tape, thereby forming the label tape 23 with print, which is then fed to outside the cartridge 10 via the above-described discharging exit. Then, the label tape 23 with print is cut by the cutter 28 to form the printed label LB1 on which desired printing was performed.

The structure of the area surrounding the cartridge holder 27 with the above-described cartridge 10' of the thermal type mounted thereto will now be described with reference to FIG. 4. Note that the components of FIG. 4 that are the same as those in the above-described FIG. 3 are denoted using the same reference numerals and descriptions thereof will be omitted; only those components that differ from FIG. 3 will be described.

Figure 4:
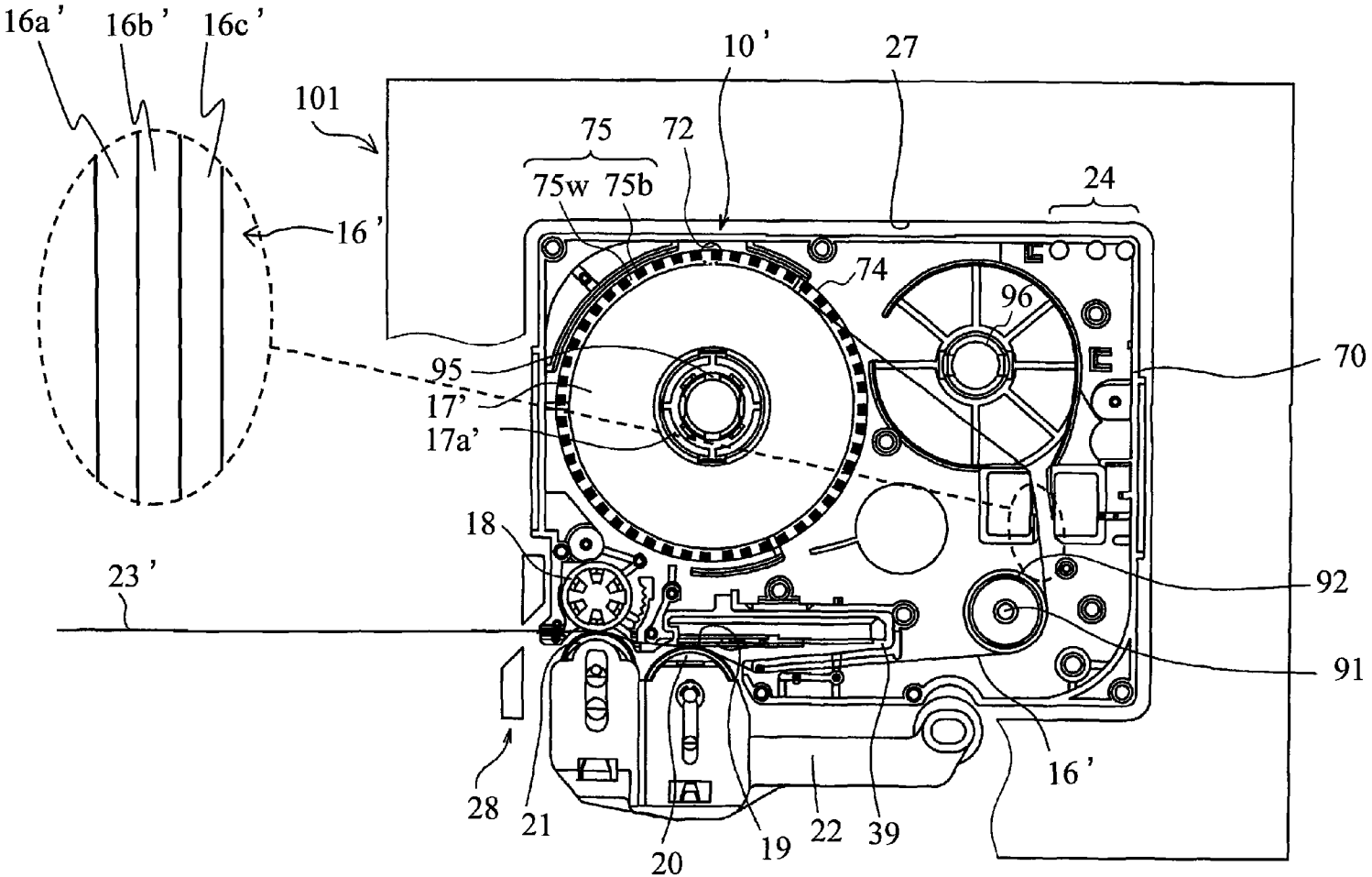
FIG. 4 is a diagram illustrating the area surrounding the cartridge holder with a thermal type of cartridge mounted thereto, along with the cartridge.

In FIG. 4, the cartridge 10' comprises the thermal tape roll 17' around which the thermal tape 16' is wound. This cartridge 10' differs from the above-described laminated type cartridge 10 in that it does not have the cover film roll 12 around which is wound the cover film 11, the ribbon take-up roll 14, or the ribbon take-up roller 15. The thermal tape roll 17' is provided with the above-described thermal tape 16' that is wound around the periphery of a thermal tape spool 17*a*' rotatably inserted into the boss 95 established on the bottom of the cartridge 10'.

The thermal tape 16' has a three-layered structure in this example (refer to the partially enlarged view of FIG. 4), comprising a cover film 16*a*' formed of PET (polyethylene terephthalate) or the like having a thermal recording layer on the surface, an adhesive layer 16*b*' formed of a suitable adhesive material, and a separation sheet 16*c*'. The three layers of the thermal tape 16' are layered in that order from the side rolled to the inside (the left side in FIG. 4) to the side corresponding to the opposite side (the right side in FIG. 4).

When the cartridge 10' is loaded to the cartridge holder 27 and the roller holder 25 is moved to the contact position from a distant location, the thermal tape 16' is brought between the print head 19 and the platen roller 20, and then between the feeding roller 18 and the pressure roller 21. Then, the feeding roller 18, the pressure roller 21, and the platen roller 20 are synchronously rotated so as to feed out the thermal tape 16' from the thermal tape roll 17'.

The fed thermal tape 16' is supplied to the print head 19 on the downstream side of the feeding direction from the above-described head insertion opening 39 while guided to a substantially cylindrical shaped reel 92 rotatably inserted in a reel boss 91 established on the cartridge bottom. Power is supplied to the plurality of heating elements from the above-described print-head driving circuit 32 (refer to FIG. 8 described later), causing the print head 19 to print the print characters R on the front side of the cover film 16*a*' of the thermal tape 16' so as to form a label tape 23' with print, which is subsequently discharged to outside the cartridge 10'. Subsequently, the label tape 23' with print is cut by the cutter 28 to form the printed label LB1 on which desired printing was performed.

While, in the above, printing is performed by using thermal tape as the label producing tape, particularly by using only the heat generated by the print head 19 and not an ink ribbon, etc., printing may be performed using ordinary ink ribbon.

The structure of the area surrounding the cartridge holder 27 with the receptor type cartridge 10" mounted thereto will now be described with reference to FIG. 5. Note that the components of FIG. 5 that are the same as those in the above-described FIG. 3 and FIG. 4 are denoted using the same reference numerals and descriptions thereof will be omitted; only those components that differ from FIG. 3 and FIG. 4 will be described.

Figure 5:
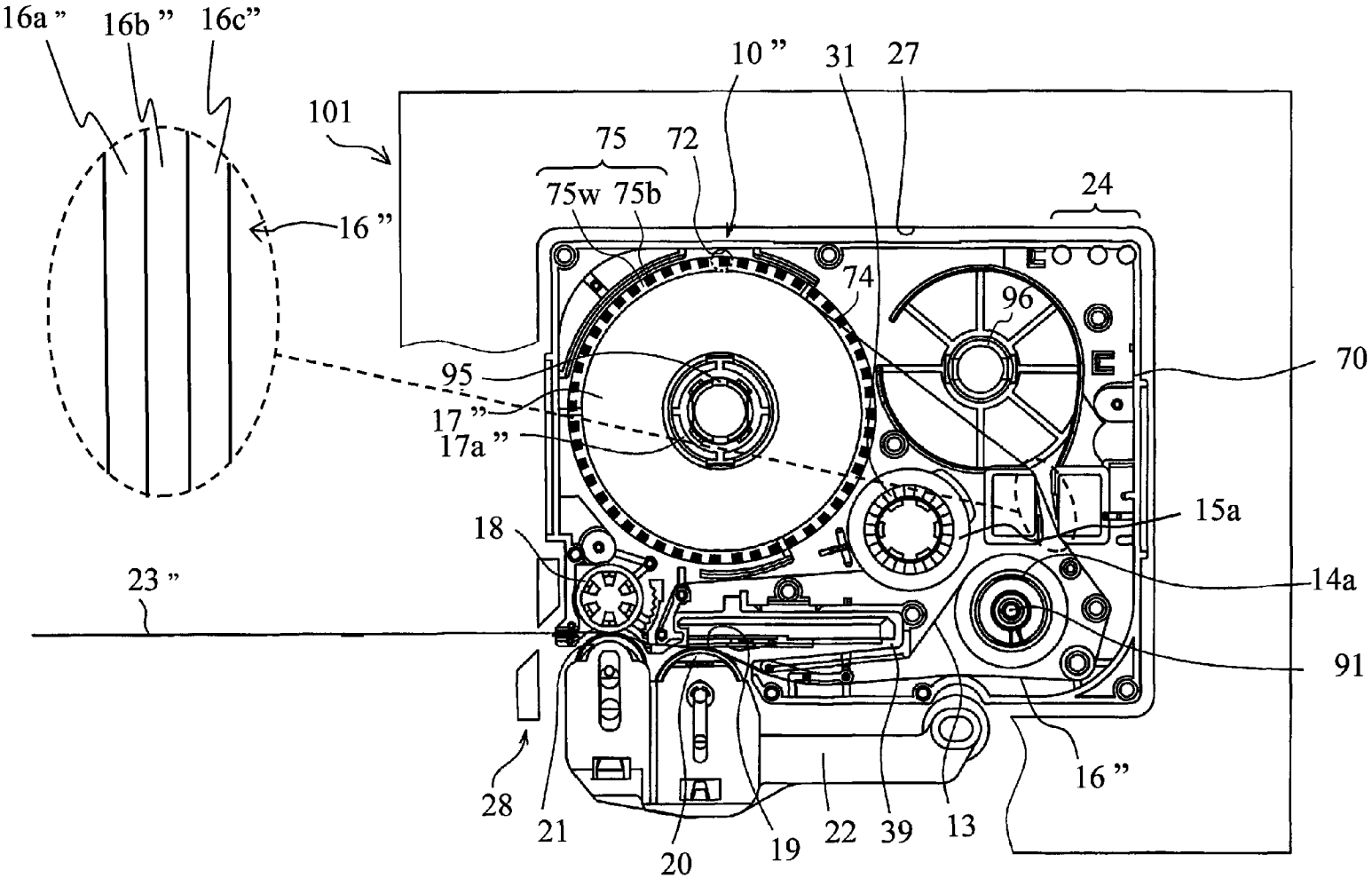
FIG. 5 is a diagram illustrating the area surrounding the cartridge holder with a receptor type of cartridge mounted thereto, along with the cartridge.

In FIG. 5, the cartridge 10" comprises the receptor tape roll 17" around which the receptor tape 16" is wound. This cartridge 10" differs from the above-described thermal type cartridge 10' in that it has the ribbon supply side roll 14 and the ribbon take-up roller 15, but similarly does not have the cover film roll 12 around which is wound the cover film 11. The receptor tape roll 17" is provided with the above-described receptor tape 16" that is wound around the periphery of a receptor tape spool 17*a*" rotatably inserted into the boss 95 established on the bottom of the cartridge 10". Note that the outside diameters (hereinafter suitably simply referred to as the "spool outside diameter") of the base tape spool 17*a* of the above described cartridge 10, the thermal tape spool 17*a*' of the above-described cartridge 10', and the receptor tape spool 17*a*" of the above-described cartridge 10" are each the same size d.

The receptor tape 16" has a three-layered structure in this example (refer to the partially enlarged view of FIG. 5), comprising a colored base film 16*a*" formed of PET (polyethylene terephthalate) or the like, an adhesive layer 16*b*" formed of a suitable adhesive material, and a separation sheet 16*c*". The three layers of the receptor tape 16" are layered in that order from the side rolled to the inside (the left side in FIG. 5) to the side corresponding to the opposite side (the right side in FIG. 5).

When the cartridge 10" is mounted to the cartridge holder 27 and the roller holder 22 is moved to the contact position from a distant location, the receptor tape 16" and the ink ribbon 13 are brought between the print head 19 and the platen roller 20, and then between the feeding roller 18 and the pressure roller 21. Then, the feeding roller 18, the pressure roller 21, and the platen roller 20 are synchronously rotated so as to feed out the receptor tape 16" from the receptor tape roll 17".

Meanwhile, power is supplied to the plurality of heating elements from the above-described print-head driving circuit 32 (refer to FIG. 8 described later), causing the print head 19 to print the print characters R on the front of the base film 16*a*" of the receptor tape 16" so as to form a label tape 23" with print, which is subsequently discharged to outside the cartridge 10". Subsequently, the label tape 23" with print is cut by the cutter 28 to form the printed label LB1 on which desired printing was performed.

Figure 6A:
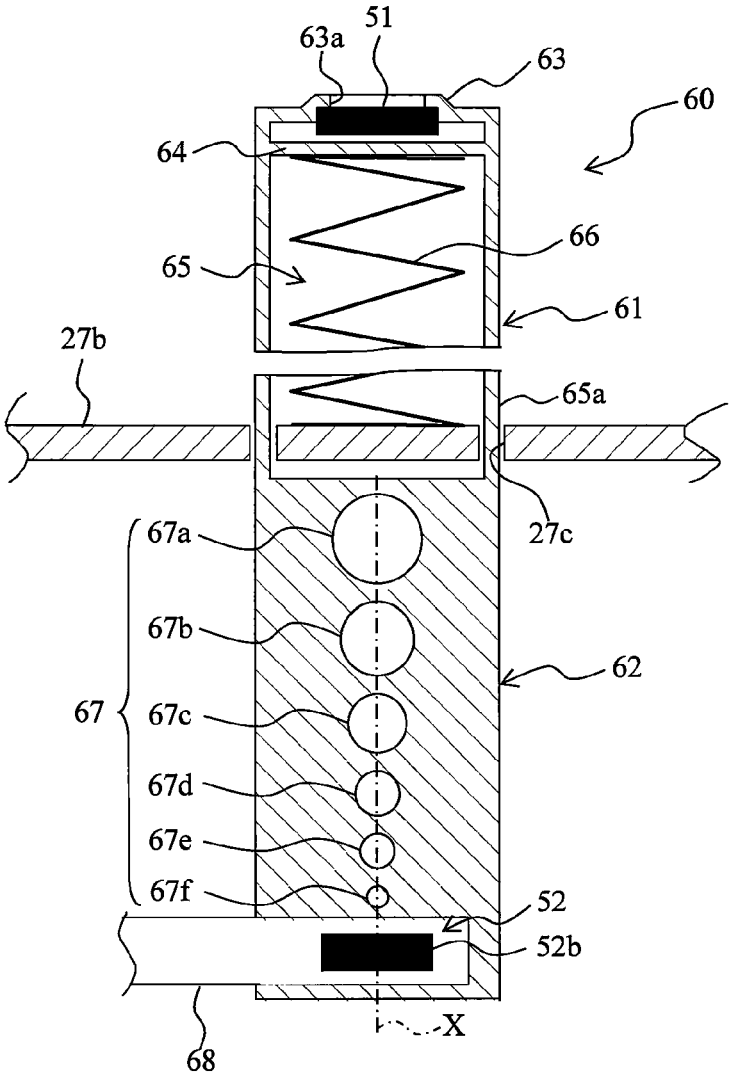
FIG. 6 is a sectional view conceptually showing the overall structure of the sensor support mechanism.
Figure 6B:
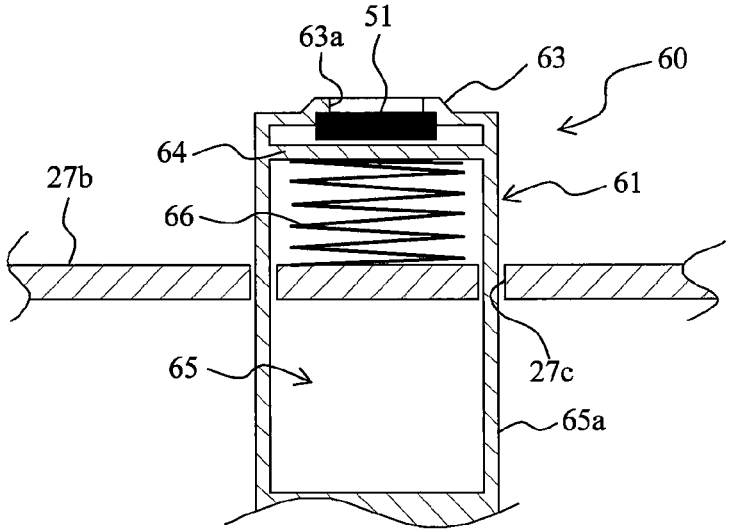

The overall structure of the aforementioned sensor support mechanism 60 will now be described with reference to FIG. 6. Note that FIG. 6A shows the cartridge 10, etc., not mounted to the cartridge holder 27, and FIG. 6B shows the cartridge 10, etc., mounted to the cartridge holder 27.

The sensor support mechanism 60 is provided to a position opposite the transmission hole 72 of the above-described cartridge housing 70 on the bottom 27*b* of the cartridge holder 27. This sensor support mechanism 60 comprises a sensor support part 61 of a hollow cylindrical shape exposably provided upward from the bottom 27*b* of the cartridge holder 27, and a sheet-shaped detected part 62 provided downward from the bottom 27*b* of the cartridge holder 27. The sensor support part 61 and the detected part 62 are integrally formed.

The sensor support part 61 comprises a raised part 63 on the upper end thereof, and the above-described first optical sensor 51 is provided on the inside of this raised part 63. The outer peripheral surface of the raised part 63 is tapered and capable of engaging with the transmission hole 72 of the above-described cartridge housing 70 (refer to FIG. 7). A sensor opening 63*a* is formed on the upper part of the raised part 63, and transmits the detection light from the first optical sensor 51, which is a reflective sensor.

The above-described first optical sensor 51 and a spring housing 65 partitioned by a partition 64 are provided inside the sensor support part 61. A peripheral wall 65*a* of this spring housing 65 is inserted into a circular-shaped slit 27*c* formed on the bottom 27*b* of the cartridge holder 27, and thus the sensor support mechanism 60 supports the first optical sensor 51 in a retractable and extendable manner with respect to the bottom 27*b* of the cartridge holder 27, within the range in which the bottom 27*b* is capable of moving inside the spring housing 65. Further, the spring housing 65 houses a spring 66 having an upper end that contacts the above-described partition 64 and a lower end that contacts the bottom 27*b* of the cartridge holder 27.

A plurality of detection holes 67 is formed along an axis X of the sensor support mechanism 60 on the detected part 62. Each of the detection holes 67 has a different opening surface area, each corresponding to the tape width of the cartridge 10, etc., mounted to the cartridge holder 27. For example, in the example shown in FIG. 6A, detection holes 67*a*, 67*b*, 67*c*, 67*d*, 67*e*, and 67*f* respectively correspond to the tape widths 36 mm, 24 mm, 18 mm, 12 mm, 9 mm, and 6 mm.

A second optical sensor 52 is provided by the support member 68 at a position corresponding to the above-described axis X, downward from the sensor support mechanism 60. This second optical sensor 52 is a transmission-type optical sensor comprising a light-emitting part 52*a* and a light-receiving part 52*b* on one side and the other side of the above-described detected part 62, respectively [with only the light-receiving part 52*b* shown in FIG. 6A]. The detection light outputted by the light-emitting part 52*a* is transmitted in the vertical direction (the vertical direction of the paper in FIG. 6) with respect to each of the above-described detection holes 67 and inputted into the light-receiving part 52*b*. With this arrangement, a control circuit 40 described later (refer to FIG. 8 described later) can detect which of the detection holes 67 is facing the second optical sensor 52 based on the received amount of light of the light-receiving part 52*b* outputted from the above-described second optical sensor 52. As a result, it is possible to detect the retracted or extended position of the first optical sensor 51 in a state of contact with the cartridge housing 70 of the cartridge 10, etc., mounted to the cartridge holder 27.

With the above-described configuration, when the cartridge 10, etc., is not mounted to the cartridge holder 27, the sensor support part 61 is not pressed downward by the cartridge housing 70, and thus the sensor support part 61 protrudes further upward than the bottom 27*b* of the cartridge holder 27 due to the biasing force of the spring 66 as shown in FIG. 6A, thereby supporting the first optical sensor 51 in a relatively upper position. This position is set to a position at which the upper end of the sensor support part 61 comes in contact with the cartridge housing 70 and is pressed downward, even in a case where a cartridge having the smallest tape width of the cartridge 10, etc., mountable to the cartridge holder 27, that is, the cartridge housing 70 having the smallest thickness, is mounted.

In a state where the cartridge 10, etc., is mounted to the cartridge holder 27, the cartridge 10 does not rise, even when the biasing force of the aforementioned spring 66 acts from below, due to a cartridge presser bar spring (not shown) provided inside the above-described opening/closing lid 102. As a result, in the above-described mounted state, the sensor support part 61 is pressed downward by the cartridge housing 70, and the sensor support part 61 and the detected part 62 (not shown in FIG. 6B) move downward against the biasing force of the spring 66, as illustrated in FIG. 6B. At this time, the cartridge housing 70 of the cartridge 10, etc., is formed so that the thickness differs in accordance with the tape width housed therein, causing the amount of downward movement of the sensor support part 61 and the detected part 62 to be in accordance with the tape width. Therefore, the above-described control circuit 40 (refer to FIG. 8 described later) detects which detection hole of the aforementioned detection holes 67*a* to 67*f* is facing the second optical sensor 52, making it possible to detect the tape width of the cartridge 10, etc. Subsequently, when the cartridge 10, etc., is removed from the cartridge holder 27, the sensor support part 61 and the detected part 62 move upward due to the biasing force of the spring 66 and return to the state shown in FIG. 6A. At this time, the detection light of the second optical sensor 52 is assessed according to the section of the detected part 62 in which no detection holes exist. As a result, even in a case where the received amount of light of the light-receiving part 52*b* is 0 (or smaller than a predetermined amount), it is possible to detect such a state as a state in which the cartridge 10, etc., is not mounted in the cartridge holder 27.

Figure 7A:
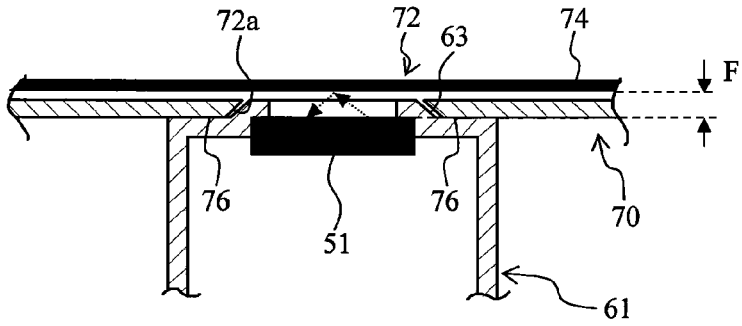
FIG. 7 is a cross-sectional view showing the structure near the transmission hole of the cartridge housing.
Figure 7B:
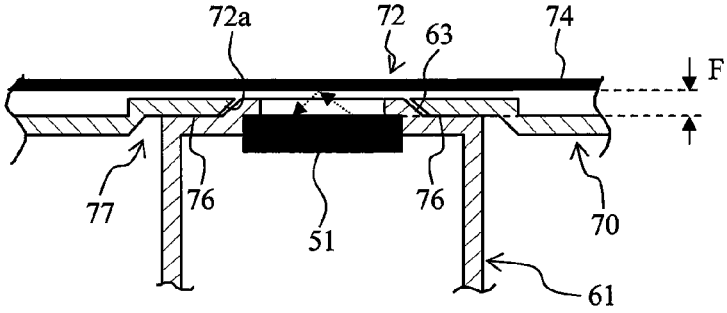
Figure 7C:
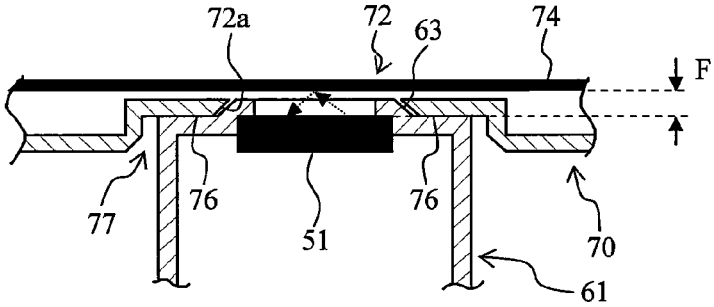

The structure near the transmission hole 72 of the cartridge housing 70 will now be described with reference to FIG. 7. FIG. 7A shows a case where the cartridge housing 70 has different thicknesses in accordance with each tape width, and FIG. 7B and FIG. 7C show a case where the cartridge housing 70 has the same thickness for a plurality of tape widths.

As shown in FIG. 7A, the above-described first optical sensor 51 is a reflective-type sensor that comprises a light-emitting part (not shown) and a light-receiving part (not shown) disposed on the downward side of the cartridge housing 70, and detects the detection light outputted from the light-emitting part and reflected by the above-described detected body 74 using the light-receiving part. Further, the cartridge housing 70 comprises a contacting part 76 that contacts the first optical sensor 51 capable of retracting and extending with respect to the bottom 27*b* of the aforementioned cartridge holder 27 in the area surrounding the above-described transmission hole 72. Specifically, the contacting part 76 contacts the upper end of the sensor support part 61 of the aforementioned sensor support mechanism 60. Further, the transmission hole 72 comprises on the inner peripheral surface a tapered part 72*a* capable of engaging with the outer peripheral surface of the above-described raised part 63 provided on the upper end of the sensor support part 61. With this arrangement, when the cartridge 10, etc., is mounted to the cartridge holder 27, the raised part 63 provided on the upper end of the sensor support mechanism 60 engages with the transmission hole 72 of the cartridge housing 70, making it possible to position the first optical sensor 51 so that the detection light from the first optical sensor 51 reliably passes through the transmission hole 72.

Further, in a case where a reflective-type sensor such as the first optical sensor 51 is used, the distance between the sensor 51 and the detected body 74 needs to be a fixed distance corresponding to a focal length F of the sensor 51. In this embodiment, as shown in FIG. 7A, the cartridge 10, etc., is configured so that the distance between the bottom surface of the cartridge housing 70 and the detected body 74 is the above-described focal length F and, with the contacting part 76 contacting the upper end of the sensor support part 61 of the sensor support mechanism 60, the distance between the first optical sensor 51 and the detected body 74 can be maintained at the above-described focal length F.

Note that while, in general, the cartridge housing 70 of the cartridge 10, etc., is formed so that the thickness thereof differs according to the width of the tape housed therein, in certain cases the cartridge housing 70 is formed so that it has the same thickness for a plurality of tape widths within a relatively small range of tape widths (the tape widths of about 6 mm, 9 mm, and 12 mm, for example) for the convenience of manufacturing. In such a case, since the distance between the bottom surface of the cartridge housing 70 and the detected body 74 changes according to the tape width, in such a structure as shown in FIG. 7A described above, the possibility exists that the distance between the first optical sensor 51 and the detected body 74 will not match the focal length F of the above-described sensor 51, making accurate detection of the detection mark 75 no longer possible.

In such a case, as shown in FIG. 7B and FIG. 7C, the contacting part 76 of the cartridge housing 70 formed so as to have the same thickness for different tape widths may be designed as a stepped part 77 recessed a predetermined distance with respect to the top surface of the cartridge housing 70 in accordance with the tape width. For example, in the example shown in FIG. 7, the aforementioned FIG. 7A corresponds to 12 mm, 18 mm, and 24 mm tape widths, FIG. 7B corresponds to a 9 mm tape width, and FIG. 7C corresponds to a 6 mm tape width. With this arrangement, in the relatively large range of the tape widths 24 mm, 18 mm, 12 mm, etc., support is achieved by the structure indicated in FIG. 7A in which the cartridge housing 70 is formed to have different thicknesses in accordance with the tape width; and in the relatively small range of the tape widths of 6 mm, 9 mm, etc., the stepped part 77 having a depth corresponding to the tape width such as shown in FIG. 7B and FIG. 7C is provided and the contacting part 76 positioned on the bottom of the stepped part 77 is made to contact the upper end of the sensor support part 61, making it possible to maintain the distance between the first optical sensor 51 and the detected body 74 at the focal length F of the sensor 51 and accurately detect the detection mark 75.

Note that while the stepped part 77 in the aforementioned example shown in FIG. 7 is formed into a recessed shape at each predetermined distance with respect to the top surface of the cartridge housing 70, the stepped part 77 may be formed into a convex shape that protrudes outward each predetermined distance with respect to the top surface of the cartridge housing 70 so that the distance between the first optical sensor 51 and the detected body 74 is constant.

The functional configuration of the label producing apparatus 100 will now be described with reference to FIG. 8.

Figure 8:
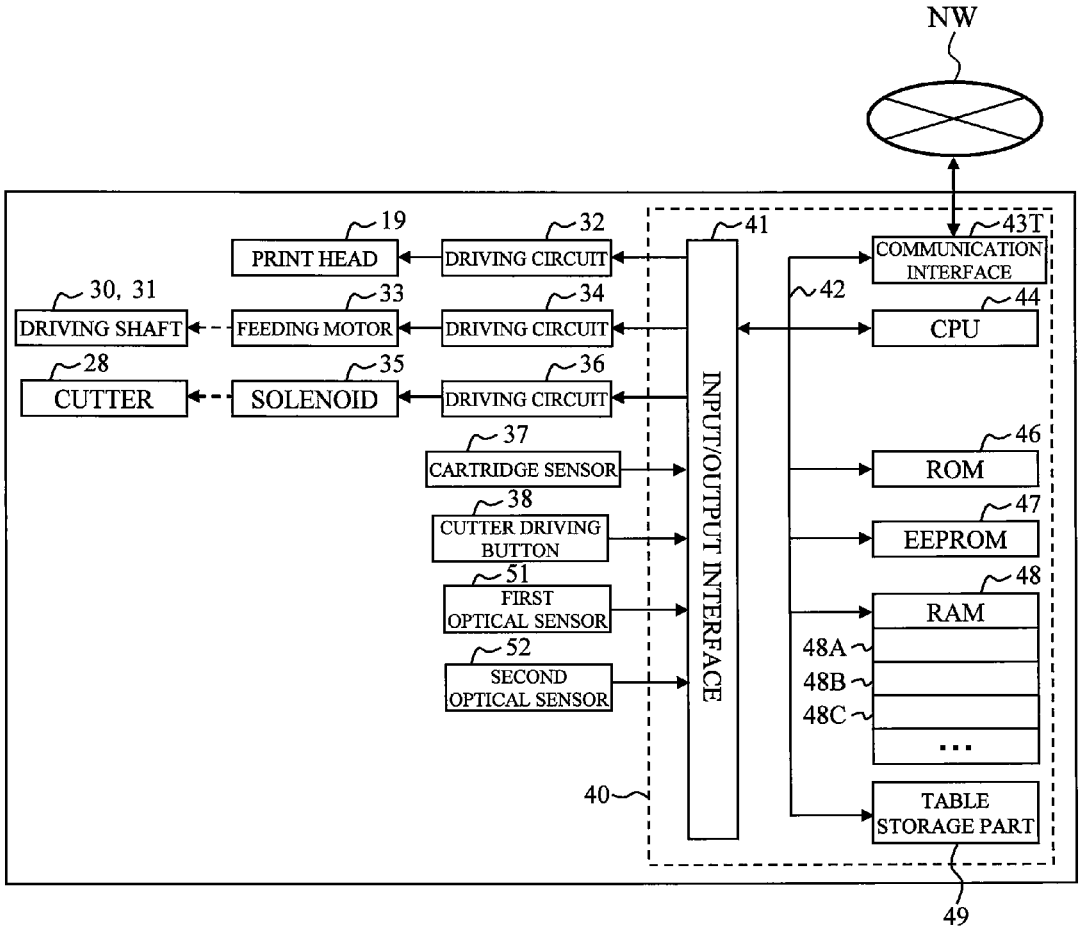
FIG. 8 is a functional block diagram illustrating the functional configuration of the label producing apparatus.

In FIG. 8, a control circuit 40 is disposed on a control board (not shown) of the label producing apparatus 100. The control circuit 40 is provided with a CPU 44, which is connected to an input/output interface 41, a ROM 46, a flash memory (EEPROM) 47, a RAM 48, a table storage part 49, and a communication interface (communication I/F) 43T, via a data bus 42.

The ROM 46 stores various programs required for control, such as a print-head driving control program configured to read the data of a print buffer 48B described later and drive the above-described print head 19 and the feeding motor 33 described later, a cutter driving control program configured to drive the feeding motor 33 so that the label tape 23 with print is fed to a cutting position after printing is completed and to drive a solenoid 35 described later to cut the label tape 23 with print, and a residual amount calculating program configured to calculate the residual tape amount described later. The CPU 44 performs various operations based on such programs stored in the ROM 46.

The RAM 48 temporarily stores the results of various operations performed by the CPU 44. This RAM 48 is provided with devices such as a text memory 48A, the print buffer 48B, and a work memory 48C that stores various operation data and the like. The text memory 48A stores print data such as document data.

The table storage part 49 comprises in part a storage area of the ROM 46 and the EEPROM 47, for example. This table storage part 49 contains a parameter table (refer to FIG. 13 described later) stored in advance that indicates the tape thickness of the label producing tapes 16, 16', and 16" and the inside diameter of the tape rolls 17, 17', and 17", which serve as parameter information for calculating the residual tape amount, for each type of the cartridge 10, etc. (in other words, for each type of roll). The details of this parameter table will be described later.

The communication I/F 43T performs network communication with the operation terminal 400 via the above-described communication line NW. The input/output interface 41 is connected to the print-head driving circuit 32 for driving the above-described print head 19, a feeding motor driving circuit 34, a solenoid driving circuit 36, the above-described cartridge sensor 37, the cutter driving button 38, the first optical sensor 51, and the second optical sensor 52.

The feeding motor driving circuit 34 drives the feeding motor 33, thereby driving the aforementioned feeding roller driving shaft 30 and ribbon take-up roller driving shaft 31, feeding the base tape 16, the cover film 11, and the label tape 23 with print.

When caused to drive the feeding motor 33, the CPU 44 outputs a motor pulse signal for driving the motor 33 to the feeding motor driving circuit 34 via the input/output interface 41, for example. The feeding motor driving circuit 34 amplifies and outputs the motor pulse signal, thereby driving the feeding motor 33. The feeding roller driving shaft 30 to which the power of the feeding motor 33 is transmitted rotates the feeding roller 18. When the cartridge 10 is mounted, for example, the feeding roller 18 feeds the base tape 16 and the cover film 11 while pressing the two together as described above, and the outside diameter thereof is regarded as constant. As a result, the feeding distance, which is the length by which the base tape 16 is fed out from the base tape roll 17, changes in accordance with the angle at which the feeding motor 33 (feeding roller 18) is rotated. This angle is a size corresponding to the number of motor pulse signals outputted by the CPU 44. Thus, the CPU 44 calculates the feeding distance from the number of outputted motor pulse signals.

The solenoid driving circuit 36 drives the solenoid 35 for driving the above-described cutter 28 to perform the cutting operation. The cutter driving button 38 enables the operator to manually operate the above-described cutter 28 and cut the printed label LB1 at a desired length.

The detection result of the detected part 24 formed in the aforementioned cartridge 10, etc., is inputted from the cartridge sensor 37, and the CPU 44 is capable of detecting the type information of the cartridge 10, etc., based on the detected result. The pulse that is the detection result of the detection mark 75 formed on the aforementioned detected body 74 is inputted from the first optical sensor 51, and the CPU 44 detects the angular velocity of the base tape roll 17 based on the pulse cycle. The received amount of light of the aforementioned light-receiving part 52*b* is inputted from the second optical sensor 52, and the CPU 44 is capable of detecting the tape width of the cartridge 10, etc., based on this received amount of light. Furthermore, the number of pulses that drive the feeding motor 33, which is a pulse motor, is proportional to the tape feeding distance, and thus the CPU 44 is capable of calculating the feeding distance of the base tape 16, the cover film 11, and the label tape 23 with print based on the number of pulses.

In the control system in which the control circuit 40 shown in FIG. 8 serves as the core, print data is consecutively stored in the text memory 48A when inputted from the operation terminal 400 to the label producing apparatus 100 via the communication line NW. Then, the stored print data is read once again and subjected to predetermined conversion by a converting function of the control circuit 40, thereby generating dot pattern data. This data is then stored in the print buffer 48B. The print head 19 is driven via the print-head driving circuit 32 and the above-described heating elements are selectively driven to emit heat in accordance with the print dots of one line, thereby printing the dot pattern data stored in the print buffer 48B. At the same time, the feeding motor 33 controls the feeding of the above-described cover film 11, etc., via the feeding motor driving circuit 34, eventually producing the printed label LB1.

The outer appearance and structure of the printed label LB1 thus produced by the label producing apparatus 100 will now be described with reference to FIG. 9A, FIG. 9B, and FIG. 10.

Figure 9A:
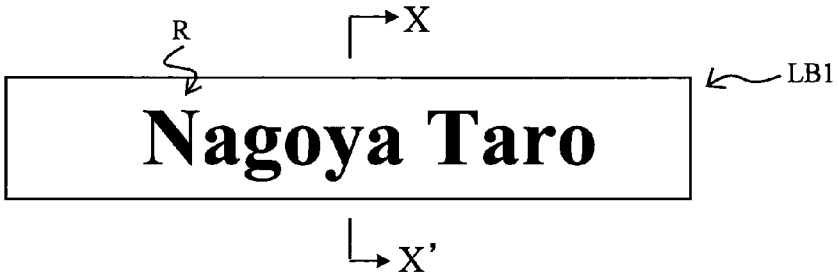
FIG. 9 is a top plan view and a bottom plan view illustrating the outer appearance of a printed label produced by the label producing apparatus.
Figure 9B:
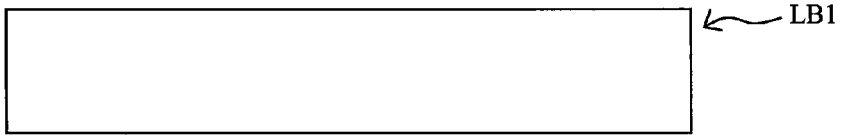
Figure 10:
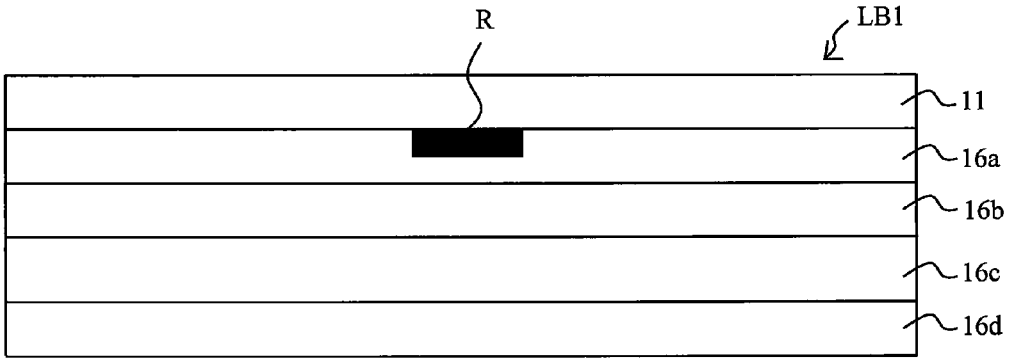
FIG. 10 is a diagram illustrating a cross-sectional view taken along line X-X' in FIG. 9A, rotated 90°.

In FIG. 9A, FIG. 9B, and FIG. 10, the printed label LB1 has a five layer structure with the cover film 11 added to the base tape 16 shown in the aforementioned FIG. 3. That is, the printed label LB1 is designed with layers comprised of the cover film 11, the adhesive layer 16*a*, the tape base layer 16*b*, the adhesive layer 16*c*, and the separation sheet 16*d*, which are layered in that order from the front surface (upper side in FIG. 10) to the opposite side (lower side in FIG. 10).

On the rear surface of the cover film 11, the print characters R (the characters "Nagoya Taro" in this example) of the content corresponding to the print data inputted via the operation part 402 of the operation terminal 400 by the operator are printed by mirror-image printing.

Next, the control contents executed by the control circuit 40 of the label producing apparatus 100 will be described with reference to FIG. 11.

Figure 11:
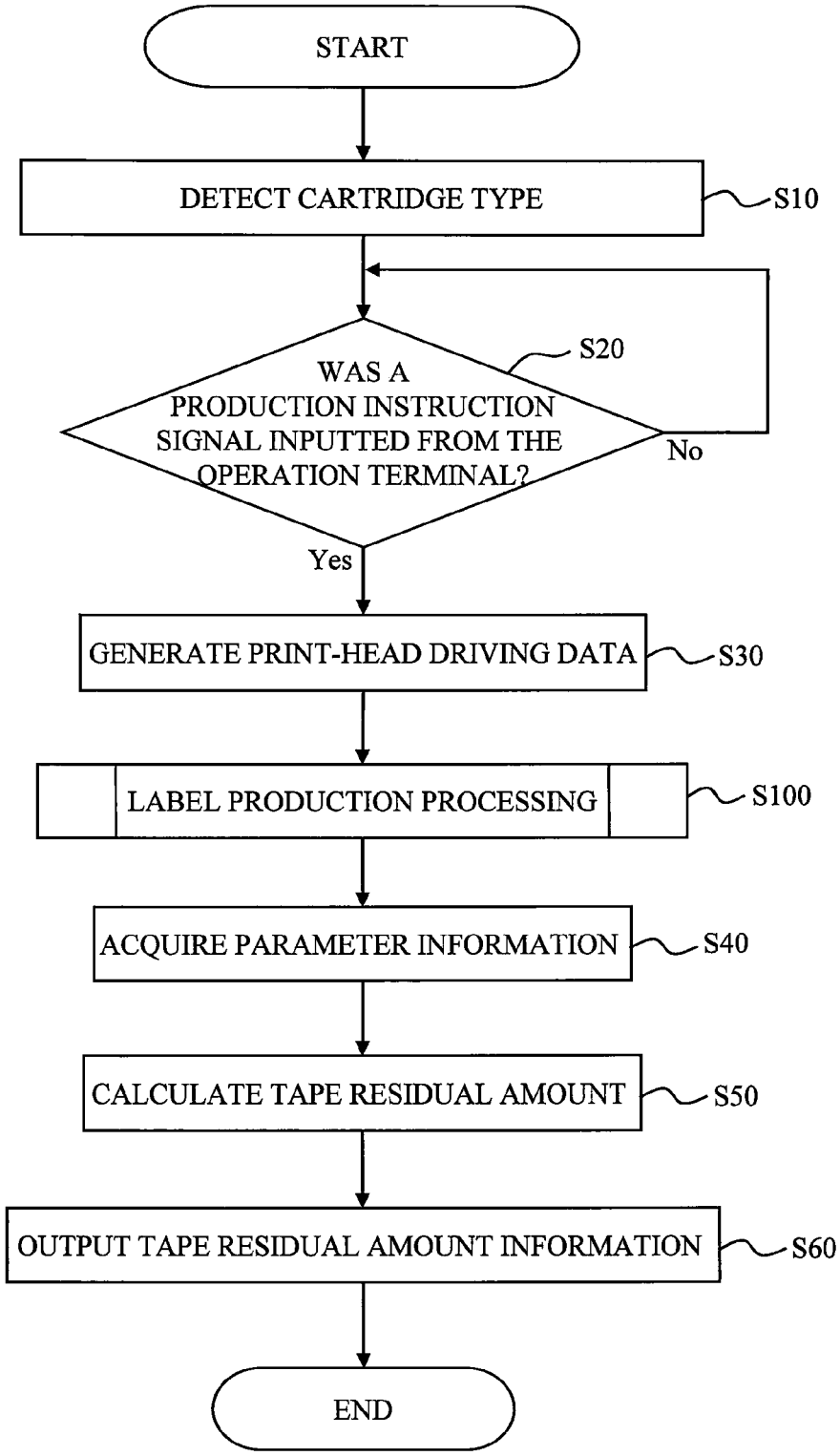
FIG. 11 is a flowchart illustrating the control contents executed by the control circuit of the label producing apparatus.

In FIG. 11, the flow is started ("START" position) when the operator turns ON the power of the label producing apparatus 100, for example.

First, in step S10, the control circuit 40 outputs a control signal to the cartridge sensor 37, detects the type of cartridge 10, etc. (in other words, the type of roll) mounted to the above-described cartridge holder 27, and stores the detection result in the RAM 48, for example. When a cartridge is not mounted, the control circuit 40 detects that information. Note that the control circuit 40 may continually input the detection result of the cartridge sensor 37 and then store the result in the RAM 48 based on this timing. The types of the cartridge 10, etc., in this embodiment include, as described above, the laminated type, the thermal type, and the receptor type.

Then, in step S20, the control circuit 40 assesses whether or not a production instruction signal outputted from the operation terminal 400 has been inputted via the communication line NW. Until the production instruction signal is inputted from the operation terminal 400, the condition is not satisfied and the control circuit 40 enters a wait loop. Then, once the production instruction signal is inputted from the operation terminal 400, the decision is made that the condition is satisfied and the print data included in the production instruction signal is stored in the text memory 48A and the flow proceeds to step S30.

In step S30, the control circuit 40 reads the print data stored in the text memory 48A in the above-described step S20 and executes a predetermined conversion process, for example, to generate dot pattern data (=print-head driving data) corresponding to the contents to be printed on the cover film 11, etc. Then, the dot pattern data is stored in the print buffer 48B.

Subsequently, in step S100, the control circuit 40 executes the label production processing (for the detailed procedure, refer to FIG. 12 described later) for producing the printed label LB1 on which desired printing has been performed.

Figures 13, 14A, 14B:
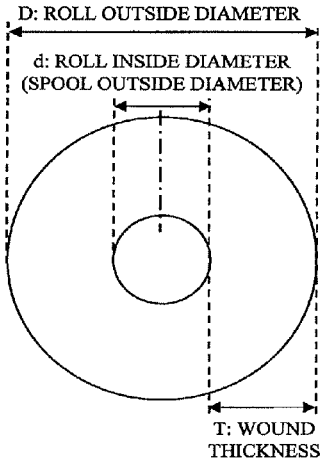
FIG. 13 shows an example of a parameter table stored in the table storage part.

Then, in step S40, the control circuit 40 accesses the table storage part 49 and refers to the parameter table (refer to FIG. 13 described later) that indicates parameter information for calculating the residual tape amount for each type of the cartridge 10, etc. Then, in the parameter table, the control circuit 40 acquires the parameter information corresponding to the type of cartridge detected in the above-described step S10. This parameter information includes a tape thickness t of the label producing tapes 16, 16', and 16", and a roll inside diameter d of the tape rolls 17, 17', and 17". FIG. 13 shows an example of a parameter table stored in the above-described table storage part 49.

As shown in FIG. 13, the tape thickness t (mm), a total length M (mm), the roll inside diameter d (mm), and a roll outside diameter D (mm) of a roll are registered in advance for each cartridge type in the parameter table. Note that the total length M and the roll outside diameter D are the values (initial values) Mo and Do when a cartridge is not used. Of these, the tape thickness t and the roll inside diameter d are acquired by the control circuit 40 in the above-described step S40 as parameter information for calculating the residual tape amount.

That is, according to the example of FIG. 13, in step S40, when the cartridge detected in the above-described step S10 is a laminated type, the parameter information of the contents t=0.120 (mm), Mo=8000 (mm), d=17 (mm), and Do=39.0 (mm) is acquired. When the cartridge detected in the above-described step S10 is a receptor type, the parameter information of the contents t=0.090 (mm), Mo=8000 (mm), d=17 (mm), and Do=34.7 (mm) is acquired. When the cartridge detected in the above-described step S10 is a thermal type, the parameter information of the contents t=0.160 (mm), Mo=4000 (mm), d=22 (mm), and Do=36.0 (mm) is acquired.

Returning to FIG. 11, subsequently, in step S50, the control circuit 40 calculates the residual tape amount. Here, the residual tape amount refers to the remaining length of the base tape 16 on the base tape roll 17, the remaining length of the thermal tape 16' on the thermal tape roll 17', and the remaining length of the receptor tape 16" on the receptor tape roll 17" when the cartridge mounted on the cartridge holder 27 is the cartridge 10 of a laminated type, the cartridge 10' of a thermal type, and the cartridge 10" of the receptor type, respectively. Note that, in the cartridge 10 of the laminated type, the tape length of the base tape 16 on the base tape roll 17 rather than the cover film 11 on the cover film roll 12 is used for the residual tape amount since the total length of the base tape 16 is shorter in order to ensure that the base tape 16 reaches a residual tape amount of zero before the cover film 11.

While, in each of the cartridges 10, 10', and 10", the tape rolls 17, 17', and 17" feed out the label producing tapes 16, 16', and 16" while rotating the spools 17*a*, 17*a*', and 17*a*" around a shaft, the outside diameters of the tape rolls 17, 17', and 17" gradually decrease as the label producing tapes 16, 16', and 16" are fed out. Thus, in a case where the tape feeding velocity is constant, the angular velocity around the spool of the tape rolls 17, 17', and 17" gradually increases as the roll outside diameter Decreases. Further, even in a case where the tape feeding speed is constant, the angular velocity around the spool of the tape rolls 17, 17', and 17" while feeding is performed for a predetermined length gradually increases as the roll outside diameter Decreases. Thus, a predetermined correlation exists between the roll outside diameter and tape roll angular velocity and, as described later, the roll outside diameter and residual tape amount have a one-to-one correspondence. Thus, in this embodiment, this correlation is utilized to calculate the residual tape amount from the angular velocity (refer to step S155 of FIG. 12 described later) of the tape rolls 17, 17', and 17" based on the detection result of the first optical sensor 51.

Next, the detailed calculation method of the residual tape amount will be described with reference to FIG. 14 and FIG. 15.

In general, the lateral area of the roll of wound tape is identified as the lateral area of the entire tape fed out from the roll. The lateral tape area is the product of the tape thickness t and the tape total length M. On the other hand, the roll lateral area can be found by subtracting the area of the inner circle found from the roll inside diameter d from the area of the outer circle found from the roll outside diameter D, as shown in FIG. 14A. Note that, as described above, the outside diameters of the above-described spools 17*a*, 17*a*', and 17*a*" are all equivalent and denoted as d.

Therefore, as shown in FIG. 14B, an equation is established in which the lateral tape area equals the area of the outer circle minus the area of the inner circle. That is, the left side of the equation is the lateral tape area, which is t (tape thickness)×M (tape length), and the right side of the equation is the area of the outer circle minus the area of the inner circle, which is $\pi(D/2)^2-\pi(d/2)^2$. Rearranged, the equation $M=\pi(D^2-d^2)/4t$ is derived. Hereinafter, this equation will be referred to as "Equation A1."

Of the variables of the above-described "Equation A1," the tape thickness t and the roll inside diameter d are acquired from the parameter table as previously described. Therefore, if the roll outside diameter D is acquired, the tape total length M serving as the residual tape amount (hereinafter suitably referred to as "residual tape amount M") can be calculated.

Figures 15A, 15B:
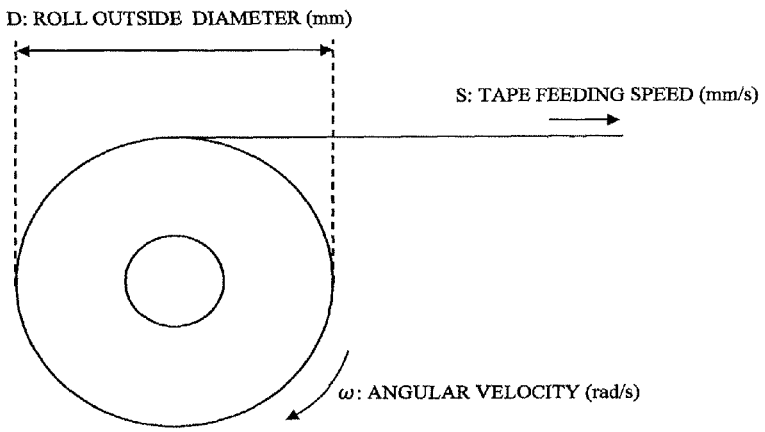
FIG. 15 is a diagram for explaining the method of calculating the roll outside diameter from the roll angular velocity based on the detection result of the first optical sensor.

Given a roll angular velocity ω (rad/s) and a feeding speed S (mm/s) of the tape fed out from the roll, as shown in FIG. 15A, the feeding speed S can be expressed as D (roll outside diameter)/2×angular velocity ω, as shown in FIG. 15B. From this equation, $D=2S/\omega$ is derived. Hereinafter, this equation will be referred to as "Equation A2." The feeding speed S is determined based on the specifications of the label producing apparatus 100 and the cartridge 10, etc. (that is, the rotational speed of the feeding motor 33 and the diameter of the feeding roller 18), and is stored in advance in the RAM 48, for example. Further, the angular velocity ω (rad/s) is a value found by dividing the angle θ [rad] corresponding to one of the plurality of detection mark 75 provided to the detected body 74 by a pulse cycle E (s) outputted from the first optical sensor 51. That is, $\omega=\theta/E$. Hereinafter, this equation will be referred to as "Equation A3." In this embodiment, since the 48 detection mark 75 are formed on the detected body 74 as previously described, the angle θ is $2\pi/48=\pi/24$ [rad]. This angle θ is also stored in advance in the RAM 48, etc.

Thus, the control circuit 40 detects the roll angular velocity ω from the above-described "Equation A3" based on the pulse cycle E outputted from the first optical sensor 51 and the above-described angle θ read from the above-described RAM 48. Then, the roll outside diameter D is calculated based on the above-described "Equation A2" from this angular velocity ω and the above-described feeding speed S read from the RAM 48. Then, the residual tape amount M can be calculated based on the above-described "Equation A1" from this calculated roll outside diameter D and the tape thickness t and roll inside diameter d acquired from the parameter table.

Returning to FIG. 11, subsequently, in step S60, the control circuit 40 outputs the residual tape amount information corresponding to the above-described calculated residual tape amount M to the operation terminal 400 via the communication line NW. As a result, the residual tape amount M is then displayed on the display part 401 of the operation terminal 400. This process then terminates here.

Note that the residual tape amount display of the above-described operation terminal 400 may be a numeric display, or a display using graphics, such as a bar graph, etc., or a display using other symbols, etc. Further, in a case of a numeric display, the amount may be a detailed display in units of millimeters or centimeters, or a general display in units of meters.

The detailed procedure of step S100 of the above-described FIG. 11 will now be described with reference to FIG. 12. The description that follows uses as an example the case in FIG. 12 where the printed label LB1 is produced using the cartridge 10 of a laminated type.

First, in step S110, the control circuit 40 outputs a control signal to the feeding motor driving circuit 34, and the feeding motor 33 drives the feeding roller driving shaft 30 and the ribbon take-up roller driving shaft 31. As a result, the feed-out of the base tape 16 from the base tape roll 17 and the feed-out of the cover film 11 from the cover film roll 12 are started, and the feeding of the base tape 16, the cover film 11, and the label tape 23 with print (hereinafter collectively simply referred to as "base tape 16, etc.") is started.

Subsequently, in step S120, the control circuit 40 determines whether or not the base tape 16, etc., has been fed a predetermined distance. This predetermined distance is a feeding distance required for the top edge of the print area of the cover film 11 to arrive at a position substantially opposite the print head 19, for example. This feeding distance may be determined by simply detecting a marking provided on the base tape 16, for example, using a known tape sensor (not shown). Or, for example, the feeding distance may be determined by detecting a marking provided on the base tape 16 using a known tape sensor (not shown). Until the base tape 16, etc., is fed the predetermined distance, the decision is made that the condition is not satisfied and the routine enters a wait loop. Then, once the base tape 16, etc., is fed the predetermined distance, the decision is made that the condition is satisfied and the flow proceeds to step S130.

In step S130, the control circuit 40 outputs a control signal to the print-head driving circuit 32, causing the print head 19 to start printing in accordance with the print-head driving data in the print area of the cover film 11.

Then, in step S140, the control circuit 40 determines whether or not all of the printing in the above-described print area of the cover film 11 is completed. Until all of the printing is completed, the condition is not satisfied and the routine enters a wait loop. Then, once all of the printing is completed, the decision is made that the condition is satisfied and the flow proceeds to step S150.

Subsequently, in step S150, the control circuit 40 determines whether or not the base tape 16, etc., has been further fed a predetermined distance. This predetermined distance refers to a feeding distance that causes the entire print area to pass the cutter 28 by a predetermined length, for example. At this time, this feeding distance may be simply determined in the same manner as in the above-described step S120, for example. Until the base tape 16, etc., is fed the predetermined distance, the decision is made that the condition is not satisfied and the routine enters a wait loop. Then, once the base tape 16, etc., is fed the predetermined distance, the decision is made that the condition is satisfied and the flow proceeds to step S155.

In step S155, in a case where the tape feeding speed after printing has begun is constant, the control circuit 40 inputs the timing of the pulse stream, which is the detection result of the detection mark 75 formed on the detected body 74 by the first optical sensor 51, in parallel with the tape feeding operation, and detects the angular velocity of the base tape roll 17 based on the pulse cycle.

In step S160, the control circuit 40 outputs a control signal to the feeding motor driving circuit 34, and stops the driving of the feeding roller driving shaft 30 and the ribbon take-up roller driving shaft 31 by the feeding motor 33, thereby stopping the feed-out of the base tape 16 and the cover film 11 from the base tape roll 17 and the cover film roll 12 as well as the feeding of the base tape 16, etc.

Subsequently, in step S170, the control circuit 40 determines whether or not the above-described cutter driving button 38 was manually operated by the operator. Until the cutter driving button 38 is manually operated, the condition is not satisfied and the routine enters a wait loop. Then, once the cutter driving button 38 is manually operated, the decision is made that the condition is satisfied and the flow proceeds to step S180.

Then, in step S180, the control circuit 40 outputs a control signal to the solenoid driving circuit 36 to drive the solenoid 35, causing the label tape 23 with print to be cut by the cutter 28. At this moment, as described above, the entire label tape 23 with print, including the above-described print area, sufficiently passes the cutter 28, and the cutting of the cutter 28 forms a printed label LB1 on which printing in accordance with the print-head driving data was performed.

Subsequently, in step S190, the control circuit 40 outputs a control signal to a discharging motor (not shown) configured to drive a discharging roller (not shown) separately provided, and the printed label LB1 formed into a label shape in the above-described step S180 is discharged to outside the apparatus. Note that in a case where the printed label LB1 can be manually discharged to the outside without a discharging motor, this step S190 may be omitted. This routine then terminates here.

As described above, in the label production process, the angular velocity of the base tape roll 17 is detected immediately before the feeding of the base tape 16, etc., on which printing has been completed is stopped, making it possible to detect with good accuracy the residual tape amount of the base tape roll 17 after label production.

In the above-described first embodiment, the cartridge sensor 37 acquires the type information of the cartridge 10, etc., mounted to the cartridge holder 27. Further, the detected body 74 that rotates at the same angular velocity as the tape rolls 17, 17', and 17" inside the cartridge housing 70 is provided, and the first optical sensor 51 optically detects the detection mark 75 of the detected body 74 from outside the cartridge housing 70. Then, the control circuit 40 calculates the residual tape amount M of the tape rolls 17, 17', and 17" based on the type information acquired by the cartridge sensor 37 and the detection result of the first optical sensor 51 in the above-described step S50, and outputs the residual tape amount information corresponding to the calculated residual tape amount to the operation terminal 400 in step S60. As a result, the residual tape amount M can be displayed on the display part 401 of the operation terminal 400.

With the residual tape amount M thus calculated based on the type information of the cartridge 10, etc., and the detection result of the first optical sensor 51, it is possible to calculate the residual tape amount M corresponding to the type of cartridge, even in a case where the aforementioned cartridges 10, 10', and 10" of a plurality of types are used in the label producing apparatus 100. As a result, the operator can reliably recognize the residual tape amount M, even in a case where a plurality of different types of printed labels LB1 is produced.

Further, in this embodiment in particular, the control circuit 40 acquires the parameter information related to the tape rolls 17, 17', and 17" based on the type information of the cartridge 10, etc., acquired by the cartridge sensor 37 in the above-described step S40. Then, in step S50, the control circuit 40 calculates the residual tape amount M based on "Equation A1," "Equation A2," and "Equation A3" using the parameter information acquired in step S40 and the angular velocity ω of the tape rolls 17, 17', and 17" based on the detection result of the first optical sensor 51. With the residual tape amount M thus consecutively calculated based on the parameter information and the detection result of the first optical sensor 51, the residual tape amount M can be detected with high accuracy compared to a case where the residual tape amount M is identified using a residual amount table prepared in advance, for example, without the accuracy being affected by the volume of data in a table. As a result, the operator can minutely identify the residual tape amount M. Further, since the residual tape amount M can be detected with high accuracy, it is also possible to perform processing based on the residual tape amount, such as continually producing printed labels LB1 in accordance with the residual tape amount M, or controlling the feeding force (tape feed-out force) by the feeding roller 18 in accordance with the residual tape amount M to improve the stability of tape feeding. Controlling the feeding force includes, for example, slowing down or accelerating the feeding when the tape roll diameter is large due to the large inertia.

Further, in this embodiment in particular, in general when the type of cartridge differs, the parameter information such as the tape thickness of the label producing tapes 16, 16', and 16" and the inside diameter of the tape rolls 17, 17', and 17", etc., also differ, and thus a parameter table that indicates the tape thickness t of the label producing tapes 16, 16', and 16" and the roll inside diameter d of the tape rolls 17, 17', and 17" for each of the types of the cartridge 10, etc., is stored in advance in the table storage part 49. Then, the control circuit 40 refers to the parameter table in the above-described step S40, and acquires as parameter information the roll inside diameter d of the tape rolls 17, 17', and 17" and the tape thickness t corresponding to the type information of the cartridge 10, etc., acquired by the cartridge sensor 37. Then, in step S50, the control circuit 40 calculates the residual tape amount M using the parameter information and the angular velocity ω of the tape rolls 17, 17', and 17". With the residual tape amount M thus calculated upon acquiring the tape thickness t and the roll inside diameter d of the tape rolls 17, 17', and 17", which differ for each of the types of the cartridge 10, etc., it is possible to reliably identify the residual tape amount M in accordance with the type of the cartridge 10, etc. Further, with the tape thickness t and the roll inside diameter d of the tape rolls 17, 17', and 17" thus identified using a parameter table prepared in advance, it is possible to decrease the amount of information to be acquired and simplify the structure of the cartridge sensor 37, which is a mechanical sensor mechanism, compared to a case where the tape thickness t and the roll inside diameter d of the tape rolls 17, 17', and 17" are acquired in addition to the cartridge type information by the cartridge sensor 37.

Further, in this embodiment in particular, in the label producing apparatus 100, the first optical sensor 51 is configured so that it can retract and extend with respect to bottom 27*b* of the cartridge holder 27 by the sensor support mechanism 60, and the cartridge housing 70 has the contacting part 76 that contacts the first optical sensor 51 and is disposed around the periphery of the transmission hole 72. With this arrangement, even in a case where the cartridges 10, etc., having different tape widths (that is, different thicknesses of the cartridge housing 70) are mounted to the cartridge holder 27, the first optical sensor 51 retracts or extends with respect to the bottom 27*b* of the cartridge holder 27, making it possible for the first optical sensor 51 (specifically, the upper end of the sensor support part 61 of the sensor support mechanism 60) to always contact the contacting part 76 provided to the cartridge housing 70. As a result, the cartridge 10, etc., is configured so that the distance between the top surface of the cartridge housing 70 and the detected body 74 is constant, thereby making it possible to maintain a distance between the first optical sensor 51 and the detected body 74 that equals the focal length F of the sensor 51. Therefore, even in a case where cartridges of different tape widths are used, the residual tape amount can be detected with high accuracy.

Further, in this embodiment in particular, the tapered part 72*a* provided to the inner peripheral surface of the transmission hole 72 of the cartridge 10, etc., engages with the first optical sensor 51 (specifically, the raised part 63 provided to the upper end of the sensor support part 61). With this arrangement, it is possible to position the first optical sensor 51 so that the detection light inputted and outputted to and from the first optical sensor 51 reliably passes through the transmission hole 72. Thus, the residual tape amount can be reliably detected. Further, the transmission hole 72 is provided with a tapered shape rather than a hole structure capable of engaging with the first optical sensor 51 to guide the first optical sensor 51 (raised part 63) to the transmission hole 72, resulting in the advantage of simplified engagement as well.

Further, in this embodiment in particular, in a case where the cartridge housing 70 is formed so that it has the same thickness for a plurality of tape widths within a relatively small tape width range for the convenience of manufacture, the contacting part 76 is configured as the stepped part 77 that is recessed with respect to the top surface of the cartridge housing 70 by a predetermined distance in accordance with the tape width. With this arrangement, even in a case where the cartridge housing 70 is formed so that it has the same thickness for different tape widths, the contacting part 76 is recessed by a predetermined distance in accordance with the tape width, making it possible to fix the distance between the first optical sensor 51 and the detected body 74 in a state of contact with the contacting part 76 of the cartridge housing 70 so that it matches the focal length F of the sensor 51, and thus accurately detect the detection mark 75.

Further, in this embodiment in particular, the detected body 74 is made by forming the plurality of detection mark 75 at a predetermined interval around the periphery of the lower film member 74 of the circular film members 73 and 74, which prevent defects caused by the protrusion of adhesive from the label producing tapes 16, 16', and 16" and are provided to both ends in the width direction of the tape rolls 17, 17', and 17". With this arrangement, it is possible to configure the detected body 74 using existing members rather than providing new members, thereby resulting in both space savings and cost savings.

Further, in this embodiment in particular, the detected body 74 is made of a transparent or semi-transparent film member that forms the plurality of detection mark 75 on both ends of the outer periphery in the radial direction. With the detection mark 75 thus provided on the outer peripheral ends in the radial direction, the detection mark 75 and the contours of the tape rolls 17, 17', and 17" do not overlap, making it possible to achieve good detection of the detection mark 75 by the first optical sensor 51.

Further, in this embodiment in particular, the second optical sensor 52 detects the retracted/extended position of the first optical sensor 51 with the first optical sensor 51 that is retractably and extendably supported with respect to the bottom 27*b* of the cartridge holder 27 by the sensor support mechanism 60 in contact with the cartridge housing 70 of the cartridge 10, etc., mounted to the cartridge holder 27. The retracted/extended position is determined in accordance with the thickness (that is, tape width) of the cartridge housing 70, making it possible to detect the tape width of the cartridge 10, etc., based on the detection result.

Note that various modifications may be made according to the first embodiment without departing from the spirit and scope of the disclosure, in addition to the above-described embodiment. Description will be made below regarding such modifications.

(1-1) Using a Residual Amount Table

While in the above-described first embodiment the control circuit 40 calculates the residual tape amount M based on the angular velocity ω, which is based on the detection result of the first optical sensor 51, as well as the tape thickness t and the roll inside diameter d acquired from the parameter table using the above-described "Equation A1," "Equation A2," and "Equation A3," the residual tape amount M may be calculated in advance and a residual amount table that indicates the correlation between the angular velocity ω and the residual tape amount M for each cartridge type may be stored in the table storage part 49.

An example of a residual amount table stored in the table storage part 49 will now be described with reference to FIG. 16. In the example shown in FIG. 16, the corresponding angular velocity ω (rad/s), roll outside diameter D (mm), and residual tape amount M (mm) of each cartridge type are calculated and registered in the residual amount table for each 0.005 (s) change in the pulse cycle E outputted from the first optical sensor 51. Here, the residual tape amount M is calculated from the above-described "Equation A1," "Equation A2," and "Equation A3" using the values of each of the parameters shown in the aforementioned FIG. 13, given a feeding speed S of 10 (mm/s) and an angle θ of π/24 [rad]. Note that the increment of the above-described pulse cycle E may be a smaller or greater value.

Figure 17:
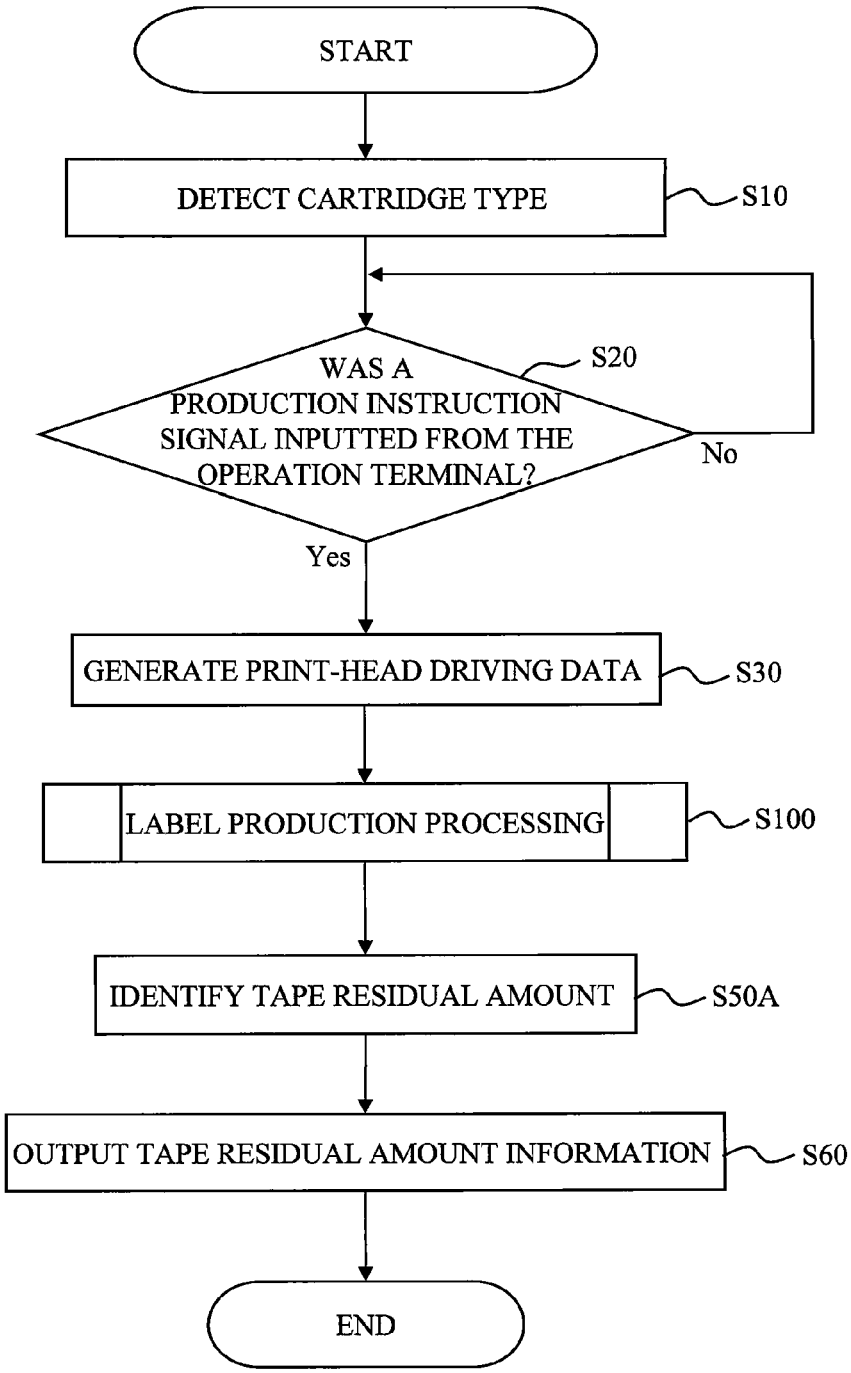
FIG. 17 is a flowchart illustrating the control content executed by the control circuit when there is a residual amount table.

The control contents executed by the control circuit 40 of this exemplary modification will now be described with reference to FIG. 17. In FIG. 17, step S10 to step S100 are the same as those of FIG. 11 previously described, and descriptions thereof will be omitted. In the next step S50A, which is in place of step S50, the control circuit 40 refers to the section of the residual amount table stored in the table storage part 49 that corresponds to the type of cartridge (in other words, the type of roll) detected in the aforementioned step S10, and identifies the residual tape amount M corresponding to the pulse cycle E or angular velocity ω of the tape rolls 17, 17', and 17" (refer to step S155 of FIG. 12) based on the detection result of the first optical sensor 51. The subsequent step S60 is identical to that of FIG. 11.

Specifically, in a case where the cartridge 10 of a laminated type is mounted, for example, and the pulse cycle E is 0.220 (s), the residual tape amount M is 5508 (mm), as shown in FIG. 16. Therefore, the residual tape amount M is displayed as 5508 (mm) the moment the pulse cycle E becomes 0.220 (s), and subsequently continues to be displayed as 5508 (mm) until the pulse cycle E changes to the next 0.215 (s). Then, when the pulse cycle E changes to the next 0.215 (s), the residual tape amount display changes to 5176 (mm). In this manner, the residual tape amount is displayed in accordance with each 0.005 (s) change in the pulse cycle E.

According to this exemplary modification, the residual tape amount M is identified using a residual amount table prepared in advance and thus, compared to a case where the residual tape amount M is consecutively calculated based on the detection result of the first optical sensor 51 as in the above-described embodiment, does not require calculations, thereby simplifying the control contents related to residual tape amount detection. As a result, the CPU, etc., can be designed with low specifications, thereby achieving lower costs. Further, this exemplary modification also offers the advantage of shortening the time required to identify the residual tape amount to the extent that calculations are no longer required.

Note that while the residual amount table was meticulously set in the above, a table that is more broadly set may be used, as shown in FIG. 18, for example. In the example shown in FIG. 18, the pulse cycle is calculated and registered for each 1 (m) change in the residual tape amount. In such a case, when the pulse cycle E is detected as 0.200 (s), for example, the residual tape amount may be displayed as "4-5 m" for the laminated type, "5-6 m" for the receptor type, and "2-3 m" for the thermal type.

(1-2) Not Using a Cartridge

An exemplary modification in which printed labels are produced using a plurality of different types of tape rolls and not any cartridges will now be described with reference to FIG. 19 to FIG. 32.

Figure 19:
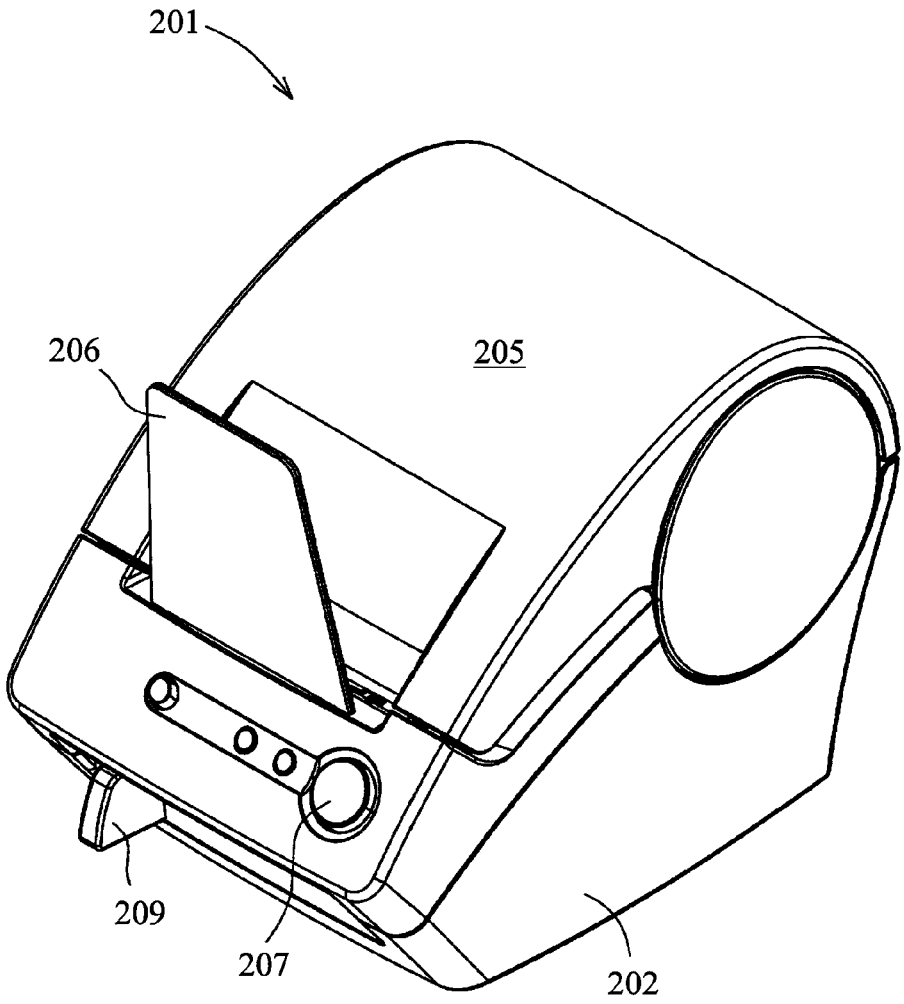
FIG. 19 is a perspective view showing the general configuration of a label producing apparatus according to a modification in which a cartridge is not used.

As shown in FIG. 19, a label producing apparatus 201 of this exemplary modification comprises a main body housing 202, an upper cover 205 made of transparent resin, a tray 206 that is made of transparent resin and established opposite the substantial center of the front side of the upper cover 205, a power source button 207 disposed on the front side of this tray 206, a cutter lever 209, and the like.

Figure 20:
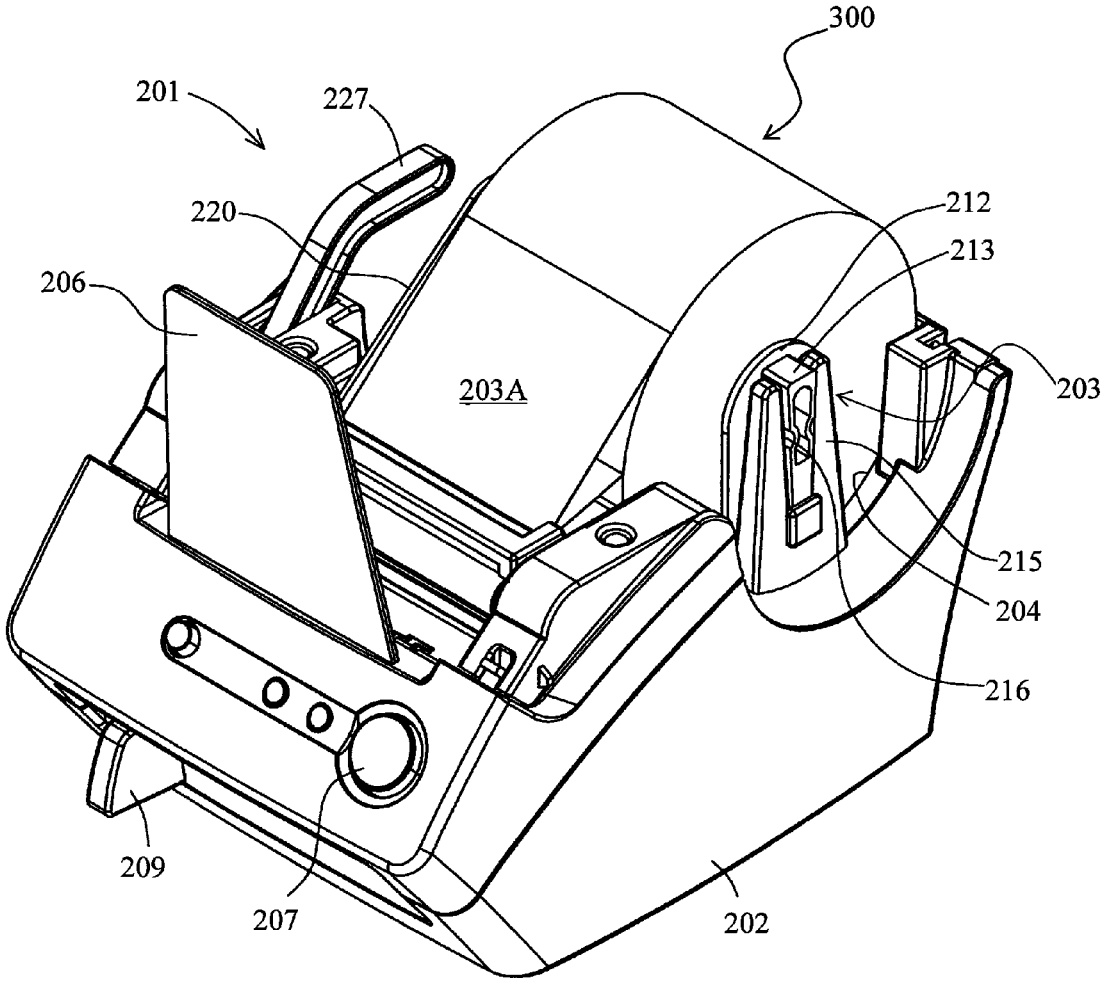
FIG. 20 is a perspective view showing a state of the label producing apparatus shown in FIG. 19, with the upper cover removed.

As shown in FIG. 20, a roll mounting mechanism 203 is disposed on a roll housing part 204 which functions as a roll holder. This roll mounting mechanism 203 comprises a position retaining member 212 and a guide member 220, and a tape 203A of a predetermined width is rotatably wound into a roll shape to form a tape roll 300. That is, the above-described guide member 220 serving as one side wall and the above-described position retaining member 212 serving as the other side wall are provided on both sides of the tape 203A in the axial direction, substantially orthogonal to that axis. Further, the aforementioned upper cover 205 is installed on the rear upper end so that it opens and closes freely and covers the upper side of the roll housing part 204.

In addition, a support member 215 is provided on one side edge of the roll housing part 204, in the substantially vertical direction with respect to the feeding direction, and a first positioning groove part 216 of a substantially oblong rectangular shape that opens upward as viewed from the front is formed on this support member 215. Then, an installation member 213 that has a substantially oblong rectangular cross-sectional shape in the vertical direction and is formed so as to protrude outward with respect to the above-described position retaining member 212 and form a narrower width downward as viewed from the front is made to contact the inside of the above-described first positioning groove part 216 having a narrower width in the downward direction and thus insert into the above-described support member 215. Note that the protruding height of this installation member 213 is formed so that the dimension substantially equals the width dimension of the first positioning groove part 216.

A lever 227 is provided on the front end in the feeding direction of the other side edge of the roll housing part 204.

Figure 21:
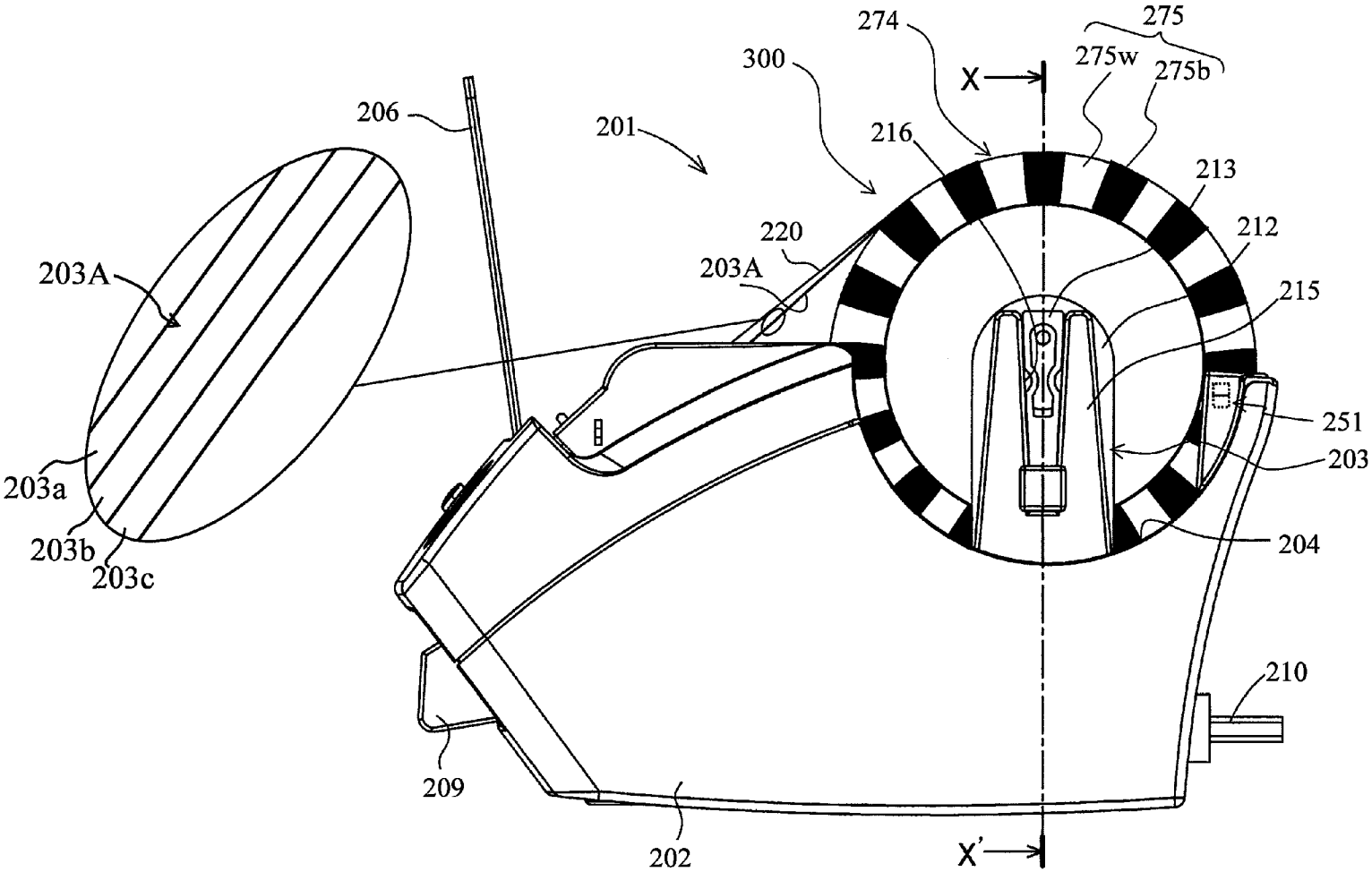
FIG. 21 is a side view of the structure shown in FIG. 20.

As shown in FIG. 21, the tape 203A has a three-layered structure in this example (refer to the partially enlarged view), and is composed of layers comprising a separation sheet 203*a*, an adhesive layer 203*b*, and a long thermal paper 203*c* capable of producing color, which are layered in that order from the side wrapped on the outside (the upper left side in FIG. 21) to the opposite side (the lower right side in FIG. 21).

The above-described separation sheet 203*a* is adhered to the underside (the upper left side in FIG. 21) of the thermal tape 203*c* or to the thermal paper 203*c* by the above-described adhesive layer 203*b*. The separation sheet 203*a* is peeled off when a printed label LB2 is affixed as a finished product to a predetermined article or the like, thereby affixing the printed label LB2 to the article or the like by the adhesive layer 203*b*.

Note that a power source cord 210 is connected to one side end of the back surface of the main body housing 202.

Further, a film member 273 (not shown) and a film member 274 circular in shape are respectively provided to both ends in the axial direction (the vertical direction of the paper in FIG. 21) of the above-described tape roll 300 so as to contact both ends in the width direction (the vertical direction of the paper in FIG. 21) of the tape roll 300. A plurality of detection mark 275 comprising a light-reflective area 275*w* and a light-absorbing area 275*b* is formed at a predetermined interval in the peripheral direction of the tape roll 300 on the film member 274 (refer to FIG. 21), which is the film member on the right side toward the front of the apparatus when the tape roll 300 is mounted. While 16 detection marks 275 are formed in this modification as shown in the figure, other quantities are acceptable. This film member 274 is provided on the side surface of the tape roll 300, for example, so that it rotates at an angular velocity (the same angular velocity in this example) in coordination with the tape roll 300 mounted to the roll housing part 204. In this specification, the film member 274 is suitably referred to as the "detected body 274." Note that the film member is not shown in any of the figures other than FIG. 21 and FIG. 27 to avoid complexities of illustration.

The detected body 274 is made of a transparent or semi-transparent film material, similar to the detected body 74 of the above-described first embodiment. The light-reflective area 275*w* of the above-described detection mark 275 is formed by printing a white or silver color on the film, and reflects incident light. The above-described light-absorbing area 275*b* is transparently or semi-transparently formed by printing a black color or not performing printing on the film, and absorbs or transmits incident light.

Then, an optical sensor 251 is provided on the rear end in the feeding direction of one side of the roll housing part 204, in the substantially vertical direction with respect to the feeding direction. This optical sensor 251 is an optical sensor that optically detects the above-described detection mark 275 from outside the roll, similar to the first optical sensor 51 of the above-described first embodiment. That is, similar to the above-described optical sensor 51, the optical sensor 251 is a reflective-type sensor that comprises a light-emitting part (not shown) and a light-receiving part (not shown), and detects the detection light outputted from the light-emitting part and reflected by the above-described detected body 274 using the light-receiving part. Then, a control circuit 410 described later (refer to FIG. 26 described later) is capable of detecting the angular velocity of the tape roll 300 based on an encoder pulse output from the above-described optical sensor 251.

The above-described detection mark 275, similar to the detection mark 75 of the above-described first embodiment, are formed on the outer peripheral end in the radial direction of the detected body 274, i.e., in an area further on the outer periphery than the contour of the tape roll 300 with the outside diameter of the roll in its largest state. (Note that, in FIG. 21, the detection mark 275 are shown exaggerated in size, existing further on the inner periphery than the roll contour as well, to clearly show the structure.) With this arrangement, the outside diameter of the tape roll 300 subsequently only decreases as the tape 203A is fed out, making it possible to achieve good detection of the detection mark 275 by the optical sensor 251 without overlap between the detection mark 275 and the roll contour.

Figure 22:
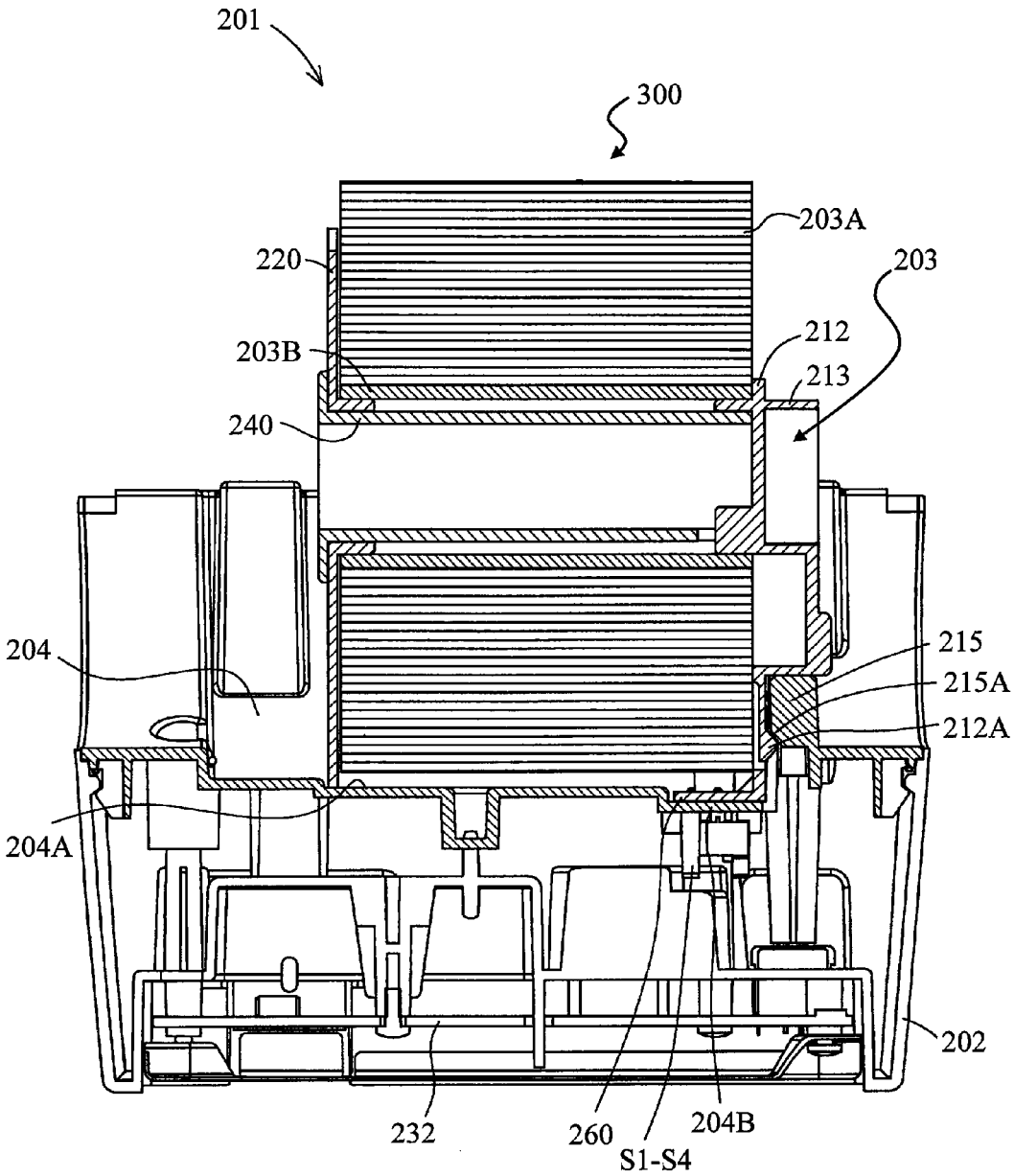
FIG. 22 is a cross-sectional view taken along a line X-X' in FIG. 21.

As shown in FIG. 22, the above-described tape 203A comprises the above-described tape roll 300 wound into a roll shape around a winding core 203B having an roll outside diameter D, similar to the above-described first embodiment.

A substantially cylindrical shaft member 240 is provided between the position retaining member 212 and the guide member 220 so that it is disposed in the axial direction on the inner peripheral side of the above-described winding core 203B, and the roll mounting mechanism 203 is mainly made of the position retaining member 212, the guide member 220, and the shaft member 240. Note that the provided shaft member 240 has a length dimension of a plurality of types (four types for example) corresponding to each length dimension of the aforementioned winding core 203B, and changing the length dimension of this shaft member 240 respectively forms a plurality of types of the roll mounting mechanism 203 capable of mounting the tape roll 300 (where the outside diameters d of the winding cores 203B are all the same) comprising the tape 203A of different width dimensions. It should be noted that the maximum winding length of the tape 203A wound around the roll mounting mechanism 203 is a length of approximately 30 m, for example.

An engaging recessed part 215A is formed on the inside base end of the support member 215, and an elastic locking piece 212A that is provided in an extended position on the lower end of the position retaining member 212 engages with this engaging recessed part 215A.

A positioning recessed part 204A of an oblong rectangular shape in a planar view is formed at a predetermined depth (1.5 to 3 mm, for example), substantially vertical with respect to the feeding direction from the inner base end of the support member 215, on the bottom surface of the roll housing part 204. A control board 232 on which a control circuit part that controls the driving of each mechanical part based on commands from an external personal computer, etc., is provided on the lower side of the roll housing part 204.

The feeding direction width dimension of the positioning recessed part 204A is formed so that it is substantially equal to the width dimension of each lower edge of the position retaining member 212 and the guide member 220 that make up the roll mounting mechanism 203. Further, the section opposite a detected part 260 (refer to FIG. 27 described later as well) described later that extends substantially perpendicular in the inward direction from the lower edge of the position retaining member 212 on the inner base end of the support member 215 of the positioning recessed part 204A forms a detected recessed part 204B.

This detected recessed part 204B has an oblong rectangular shape in the feeding direction in the planar view, and is formed so that it is deeper than the positioning recessed part 204A by a predetermined depth (approximately 1.5 to 3 mm, for example). Further, four roll detection sensors S1, S2, S3, and S4 that comprise a push-type micro-switch, etc., and determine the type of the tape roll 300 are formed in a substantial L shape, for example, on the detected recessed part 204B. These roll detection sensors S1 to S4 are each made of a known mechanical switch, such as a plunger and micro-switch, and the upper end of each of the plungers is provided so that it protrudes from the bottom of the detected recessed part 204B to near the bottom of the positioning recessed part 204A. Then, the existence or non-existence of each sensor hole (described later) of the detected part 260 with respect to each of the roll detection sensors S1 to S4 is detected, and the type of the tape roll 300 mounted to the roll mounting mechanism 203 is detected based on the on/off signals thereof.

Figure 23A:
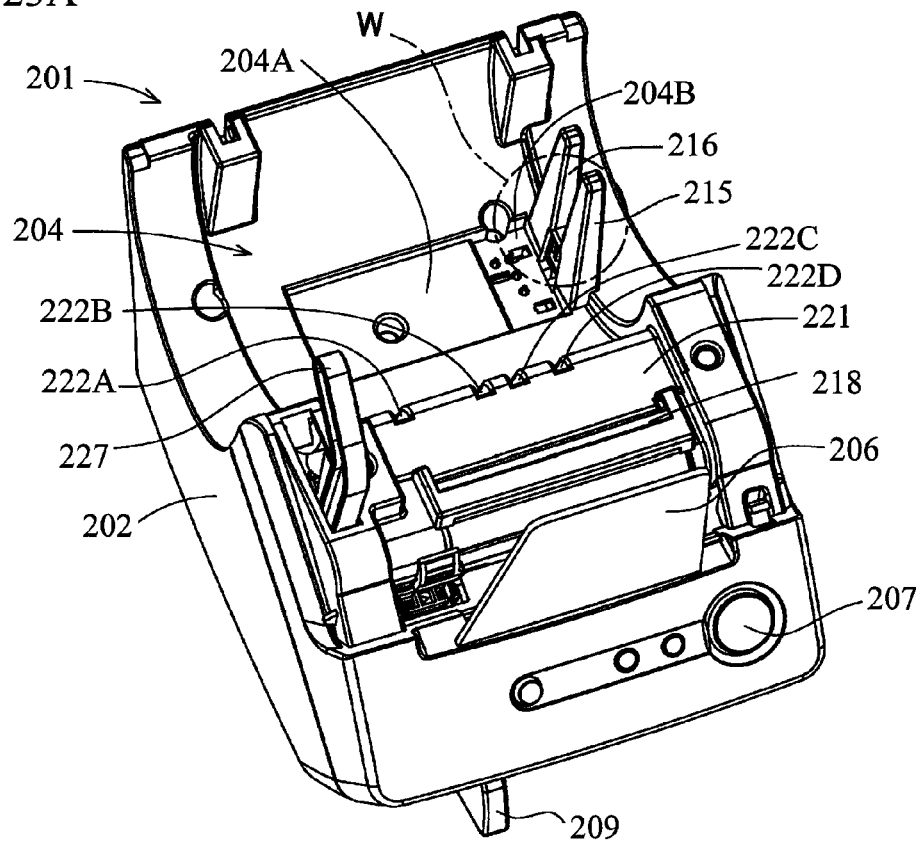
FIG. 23 is a perspective view illustrating a state of the label producing apparatus shown in FIG. 19 with its upper cover and tape roll removed, and an enlarged perspective view of Section W in FIG. 21A.
Figure 23B:
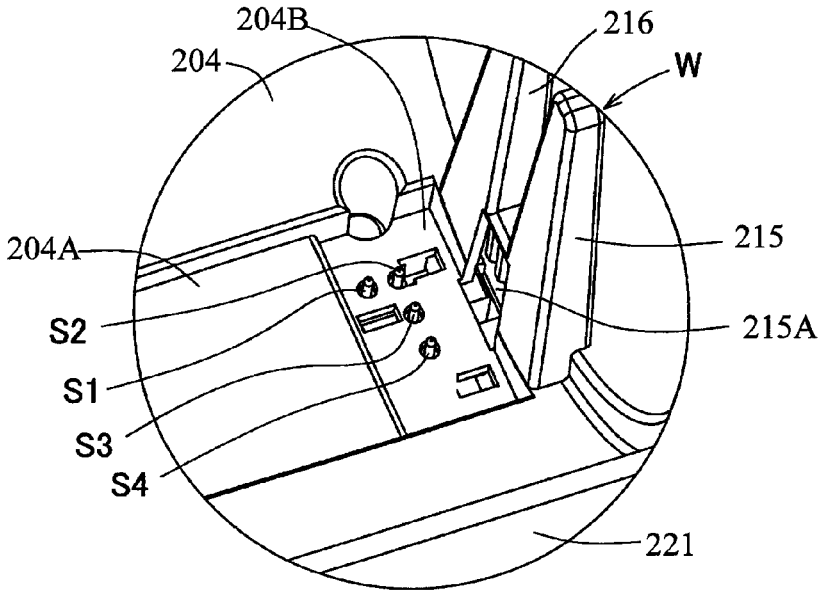

A mounting part 221 on which the front end of the above-described guide member 220 of the roll mounting mechanism 203 is provided as shown in FIG. 23A and FIG. 23B. This mounting part 221 extends substantially horizontally from the rear edge of an insertion hole 218 through which the above-described tape 203A is inserted to the front upper edge of the roll housing part 204. Note that the front end of the aforementioned guide member 220 is extended to the above-described insertion hole 218.

Four second positioning groove parts 222A to 222D having substantially L-shaped cross-sections are formed on the edge corner on the rear side in the feeding direction of the mounting part 221, in accordance with the plurality of width dimensions of the tape 203A. That is, in this exemplary modification, the plurality of types of tape rolls 300 having different tape widths can be mounted to the roll housing part 204 using the roll mounting mechanism 203. Each of the second positioning groove parts 222A to 222D is formed so that a part of the section that contacts the mounting part 221 of the guide member 220 of the roll mounting mechanism 203 can be inserted from above. Note that the above-described positioning recessed part 204A is provided from the inner base end of the support member 215 to the position opposite the above-described second positioning groove part 222A.

The tape roll 300 of this exemplary modification comprising the winding core 203B, the tape 203A, and the roll mounting mechanism 203 is detachably installed to the roll housing part 204 by inserting the installation member 213 of the position retaining member 212 into the first positioning groove part 216 of the support member 215, engaging the elastic stopping piece 212A provided in an extended manner to the bottom end of the position retaining member 212 with the engaging recessed part 215A formed on the inner base end of the support member 215, and inserting the front end lower surface of the guide member 220 into each of the second positioning groove parts 222A to 222D so that the lower end of the guide member 220 is inserted within and contacts the positioning recessed part 204A.

Figure 24:
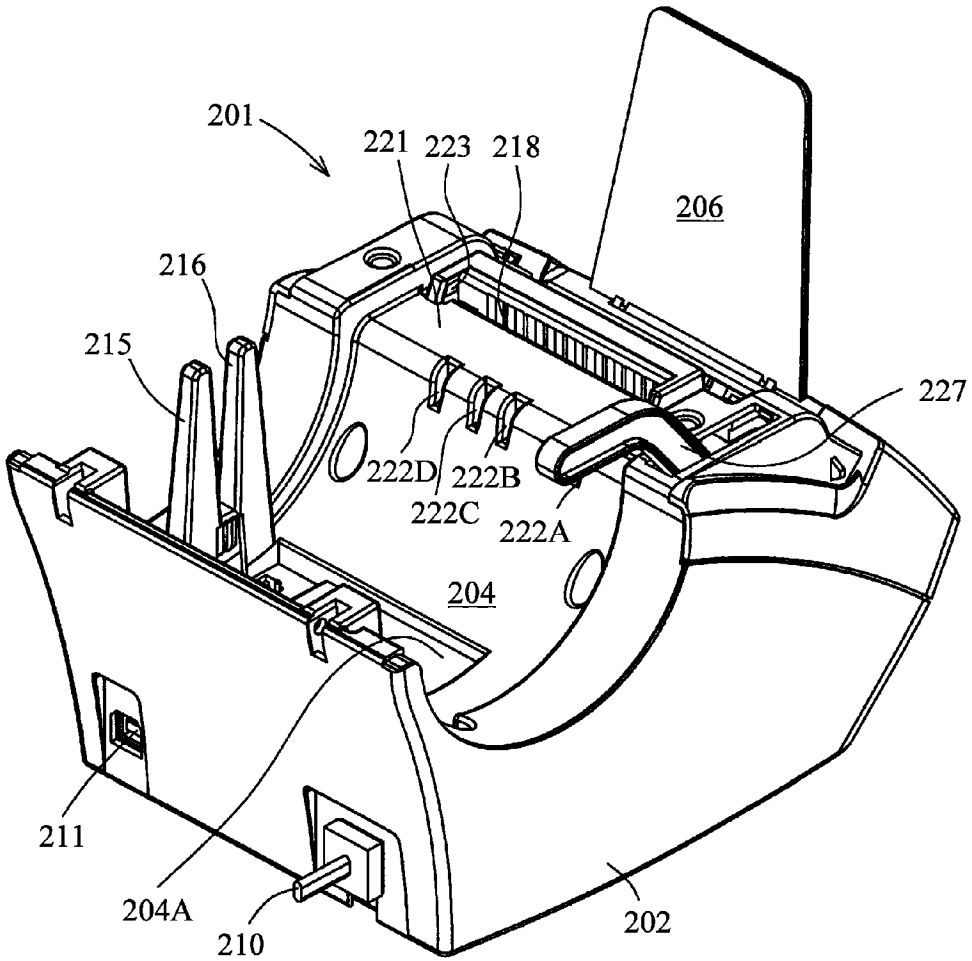
FIG. 24 is a rearward perspective view showing a state of the label producing apparatus shown in FIG. 19, with the upper cover removed.

A guiding rib part 223 is established on the lateral edge on the side of the support member 215 of the above-described insertion hole 218, as shown in FIG. 24. The lateral edge (the left edge in FIG. 24) on the side of the support member 215 of the insertion hole 218 is formed at a position opposite the inner end surface of the above-described position retaining member 212 inserted into the support member 215.

Note that a connector part 211 comprising a universal serial bus (USB), etc., that connects to a personal computer, etc., (not shown) is provided on the other lateral end of the back surface of the main body housing 202.

Figure 25:
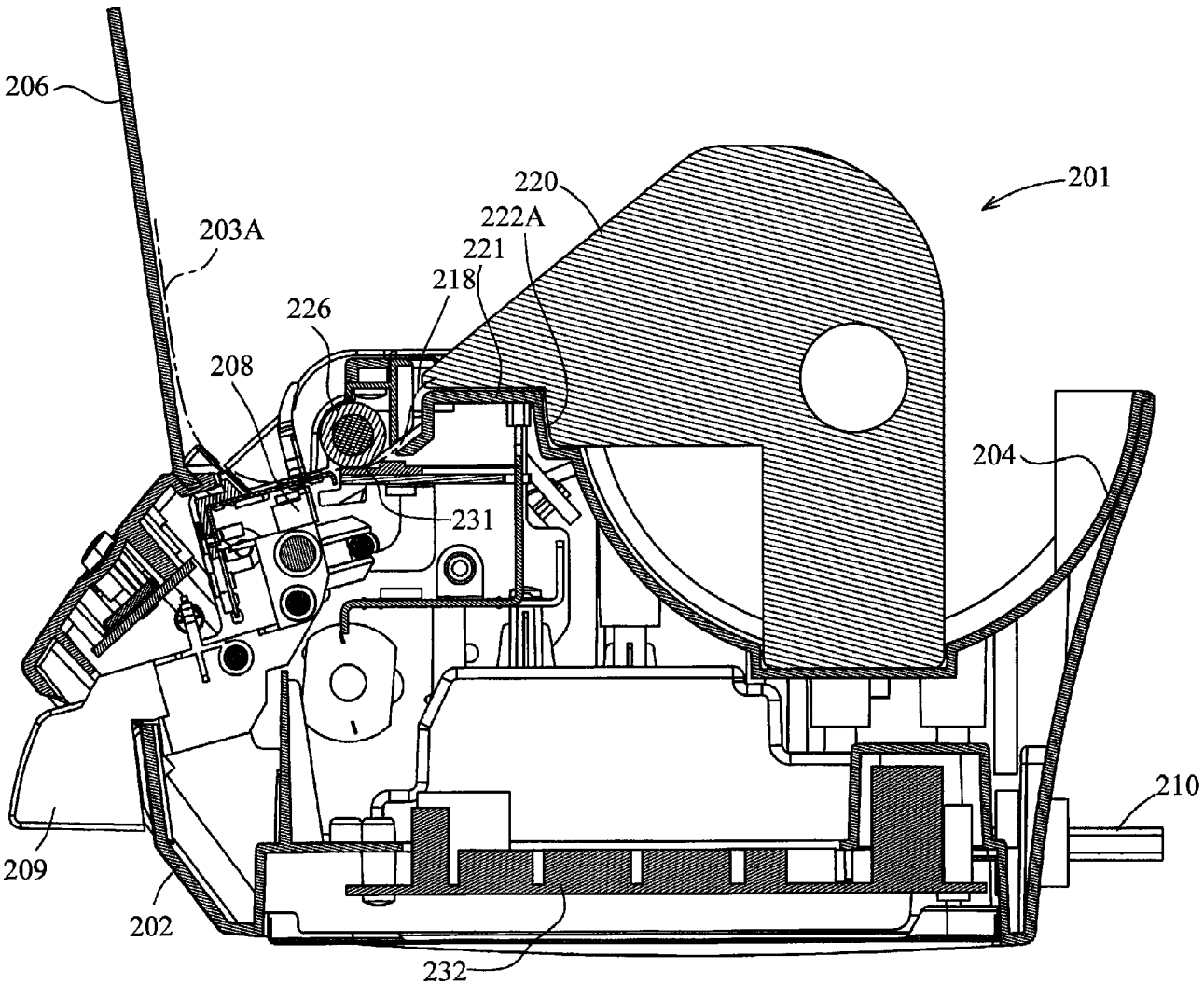
FIG. 25 is a side sectional view showing the label producing apparatus shown in FIG. 19, with the roll mounting mechanism mounted and the upper cover removed.

As shown in FIG. 25, a cutter unit 208 that is moved horizontally by the above-described cutter lever 209 provided in a horizontally movable manner is provided to the front lateral surface, a thermal head 231 that performs printing is provided on the upstream lower part of the cutter unit 208 in the feeding direction of the tape 203A (on the right side in FIG. 25), and a platen roller 226 is provided at a position opposite this thermal head 231.

The thermal head 231 is moved downward and away from the platen roller 226 by moving the aforementioned lever 227 for executing vertical movement operations thereof upward, and moved upward and into a printable state by moving the lever 227 downward, which causes the tape 203A to press against the platen roller 226.

That is, at the time printing is executed, first the lever 227 is moved upward, causing one lateral edge of the tape 203A to contact the inner surface of the guide member 220 and the other lateral edge of the tape 203A to contact the above-described guiding rib part 223 established on the lateral edge of the insertion hole 218, resulting in insertion into the insertion hole 218. The lever 227 is then rotated downward, enabling printing. In this state, the lever 227 is rotated downward, causing the tape 203A inserted from the insertion hole 218 to be energized and pressed toward the platen roller 226 by the line-type thermal head 231. Then, as the platen roller 226 is rotationally driven by a controllable pulse motor (or stepping motor, etc.; refer to FIG. 26 described later) using a motor pulse signal, the thermal head 231 is driven and controlled, making it possible to consecutively print desired print data on the print surface while feeding the tape 203A. Then, the tape 203A with print that was discharged onto the tray 206 is cut by the cutter unit 208 by moving the cut lever 209 to the right, thereby producing the printed label LB2 (refer to FIG. 29 described later).

Next, the control system of the above-described label producing apparatus 201 will be described with reference to FIG. 26.

Figure 26:
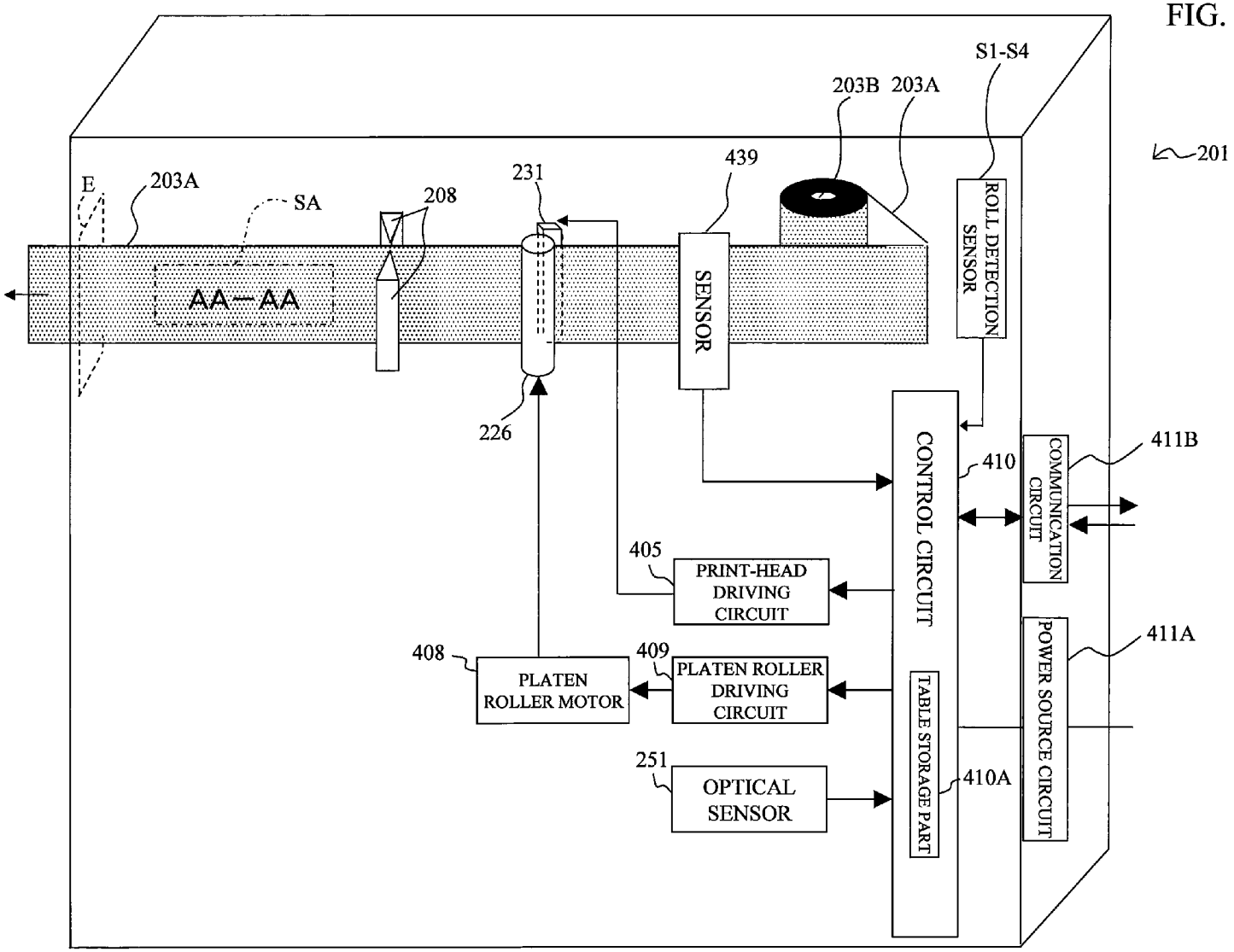
FIG. 26 is a perspective view showing the control system of the label producing apparatus.

In FIG. 26, the above-described tape 203A wound around the winding core 203B, in this example, is subjected to desired printing in a print area SA by the thermal head 231, and the tape 203A with print is cut by the cutter unit 208 at a desired timing by operating the cutter lever 209 as previously described, thereby producing the printed label LB2.

Additionally, the label producing apparatus 201 is provided with a sensor 439 that detects the presence of the tape 203A on the feeding path toward a discharging exit E, the above-described platen roller 226 that feeds and sends the tape 203A and the cut printed label LB2 to the discharging exit E, a print-head driving circuit 405 that controls the power to the above-described thermal head 231, a platen roller driving circuit 409 that controls a platen roller motor 408 that drives the above-described platen roller 226, and the control circuit 410 for controlling the operation of the overall label producing apparatus 201 via the above-described print-head driving circuit 405, the platen roller driving circuit 409, etc.

The control circuit 410 is a so-called microcomputer. While a detailed description thereof will be omitted, the control circuit 410 comprises a CPU which is a central processing unit, ROM, RAM, and the like, and performs signal processing according to a program previously stored in the ROM using the temporary storage function provided by the RAM. In addition, the control circuit 410 comprises a table storage part 410A that stores a parameter table (refer to FIG. 32 described later), similar to the table storage part 49 of the above-described first embodiment. Furthermore, the control circuit 410 is supplied with power from a power circuit 411A and connected to a communication line, for example, via a communication circuit 411B, making it possible to communicate information with route servers (not shown), other terminals, general-purpose computers, information servers, and the like connected to this circuit line. In addition, the number of pulses for driving the above-described platen roller motor 408, which is a pulse motor, is proportional to the tape feeding distance, and thus the control circuit 410 is capable of calculating the feeding distance of the tape 203A based on the number of pulses.

Figure 27A:
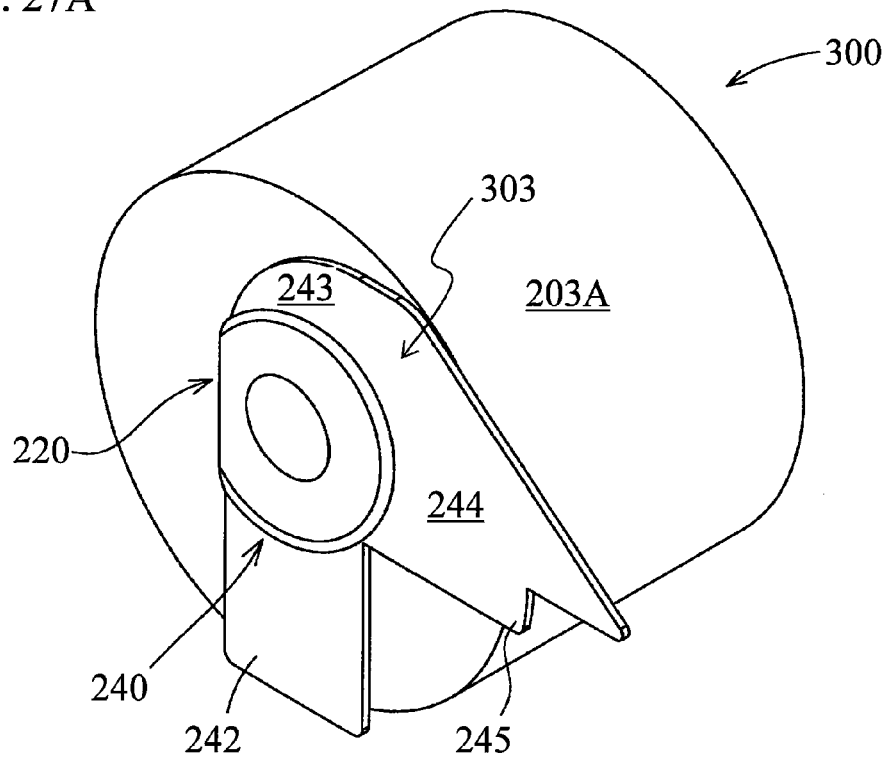
FIG. 27 shows perspective views of the detailed structure of the tape roll from the upper front and from the lower rear, respectively.
Figure 27B:
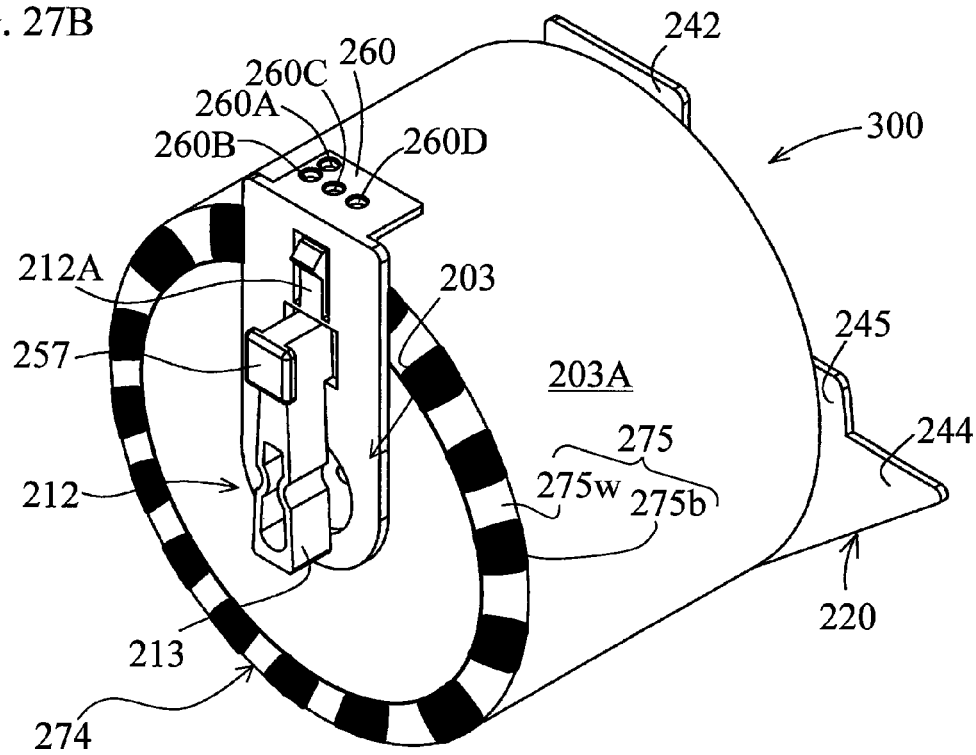

As shown in FIG. 27A and FIG. 27B, a first extending part 242 that is inserted in the positioning recessed part 204A formed on the bottom part of the roll housing part 204 and made to contact the bottom of the positioning recessed part 204A, a second extending part 243 that is extended outward so as to cover the outer end surface on substantially one-fourth of the periphery in the frontward direction of the tape 203A, and a third extending part 244 that is extended into a shape in which the upper edge is positioned downward in the front from the outer periphery of the second extending part 243 to near the above-described insertion hole 218 (refer to FIG. 24) of the tape 203A are formed on the guide member 220 of the roll mounting mechanism 203.

The lower end surface of the front end of the third extending part 244 is formed substantially horizontal and contacts the aforementioned mounting part 221 of the label producing apparatus 201 so that one lateral edge of the mounted tape 203A is guided to the above-described insertion hole 218 by the inner surface of the third extending part 244 and the second extending part 243. Further, a fourth extending part 245 that is extended a predetermined length is formed from the position opposite the rear edge in the feeding direction of the mounting part 221 on the lower end surface of the third extending part 244 to the first extending part 242. The front end section in the feeding direction of this fourth extending part 245 is formed so as to insert into one of the second positioning groove parts 222A to 222D facing the tape width of the mounted tape 203A when the lower end surface of the above-described third extending part 244 contacts the mounting part 221 (refer to FIG. 25 previously described).

Further, a flat guiding part 257 (having a length of approximately 1.5 to 3 mm in this example) that is substantially square in shape as viewed from the front and protrudes further than the lower end of the installation member 213 by a predetermined length (approximately 1.5 to 3 mm in this example) in each of the horizontally outward directions is formed on the lower end of the installation member 213 of the position retaining member 212 of the roll mounting mechanism 203. With this arrangement, when the roll mounting mechanism 203 is mounted, the guiding part 257 formed on the lower end of the installation member 213 contacts the outer end surface of the support member 215 as the installation member 213 is inserted into the first positioning groove part 216, making it possible to easily position and mount the roll mounting mechanism 203.

The lower edge of the extending part 256 of the position retaining member 212 is extended so as to protrude further than the lower edge of the guide member 220 in the downward direction by a predetermined length (approximately 1 to 2.5 mm in this example), and the above-described detected part 260 of a substantially rectangular shape extending a predetermined length in the substantially perpendicular inward direction is formed on the lower edge thereof.

Sensor holes 260A to 260D are disposed in a substantially L-shape in predetermined positions opposite the aforementioned roll detection sensors S1 to S4, and the detected part 260 works in coordination with these sensors S1 to S4 to identify the type of the tape roll 300.

An example of the mounting behavior of the roll mounting mechanism 203 configured as described above and mounted to the label producing apparatus 201 side will now be described with reference to FIG. 28A and FIG. 28B.

Figure 28B:
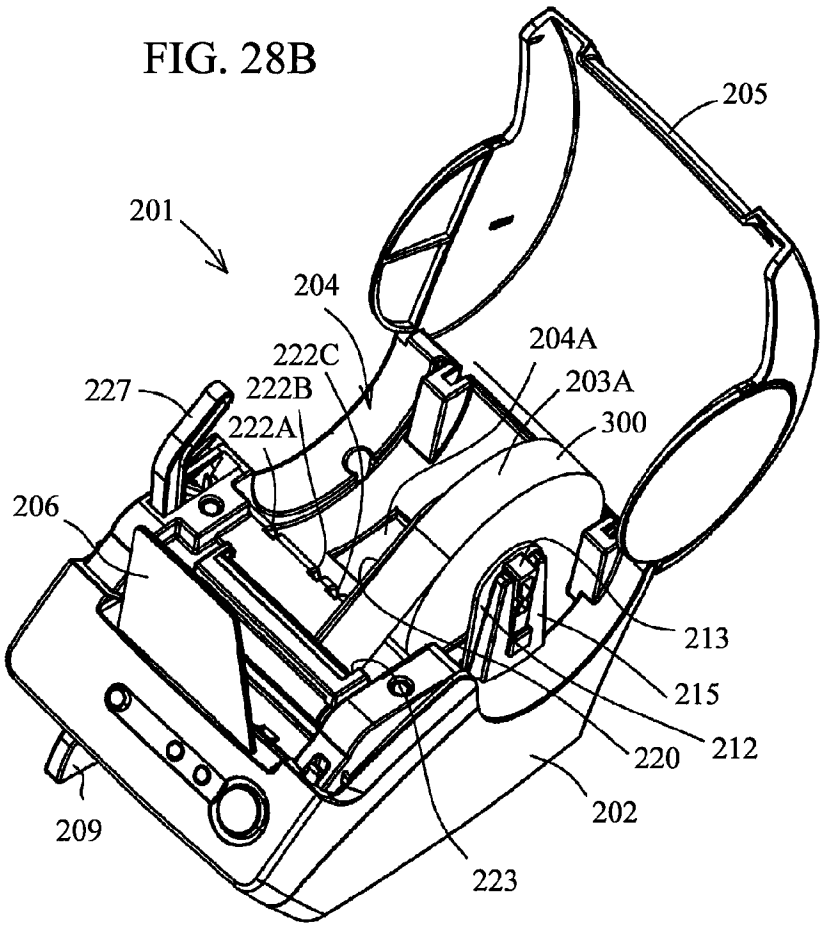
FIG. 28 is an explanatory view for explaining an example of the mounting behavior of the roll mounting mechanism on the label producing apparatus side.
Figure 28A:
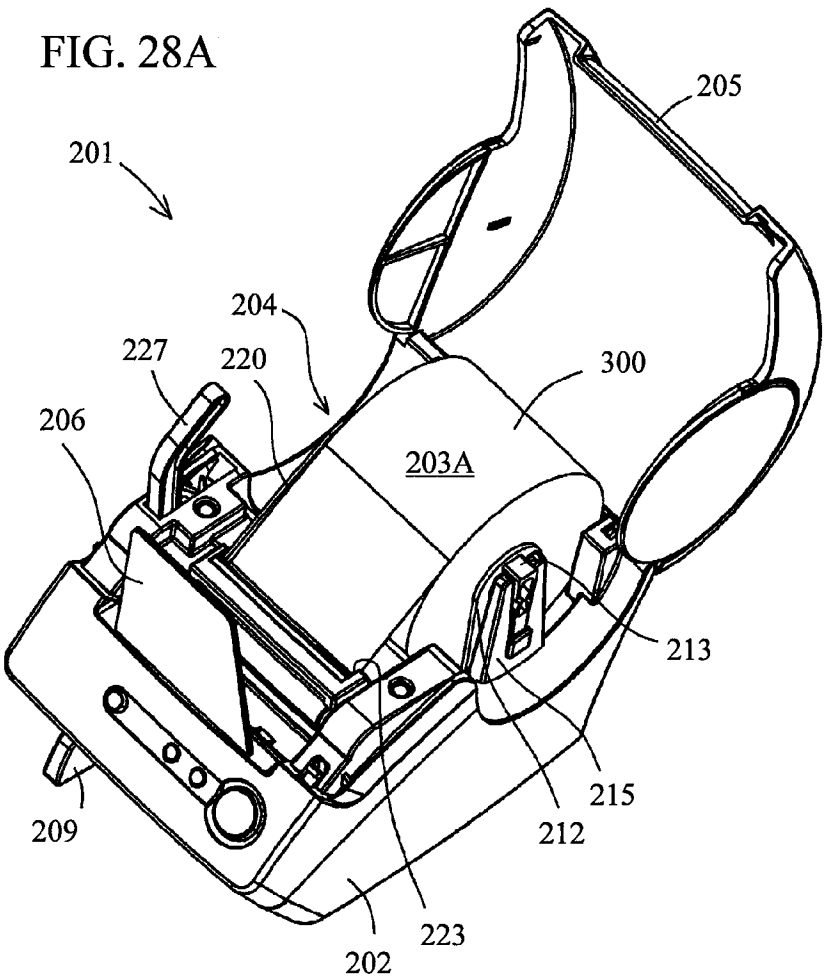

FIG. 28A shows an example of a case where the tape roll 300 having the tape 203A of a maximum width wound around the winding core 203B is mounted. In FIG. 28A, the installation member 213 of the position retaining member 212 of the roll mounting mechanism 203 is first inserted into the positioning groove part 216 of the support member 215. Then, the lower end surface of the third extending part 244 of the guide member 220 of the roll mounting mechanism 203 is made to contact the mounting part 221, and the fourth extending part 245 of the guide member 220 is inserted into the second positioning groove part 222A formed on the rear corner in the feeding direction of the mounting part 221. Further, the lower edge of the first extending part 242 of the guide member 220 is inserted into and made to contact the inside of the positioning recessed part 204A formed on the bottom of the roll housing part 204.

At the same time, the detected part 260 formed on the lower end of the extending part 256 of the position retaining member 212 of the roll mounting mechanism 203 is inserted into the detected recessed part 204B formed on the inside of the base end of the support member 215, and the elastic stopping piece 212A is engaged with the engaging recessed part 215A formed on the base end of the support member 215.

Next, with the lever 227 rotated upward, one lateral edge of the tape 203A is made to contact the inner surface of the guide member 220 as the tape 203A is drawn out, and the other lateral edge of the tape 203A is made to contact the guiding rib part 223 established on the lateral edge of the insertion hole 218 as it is inserted into the insertion hole 218. Subsequently, the lever 227 is rotated downward, causing the front end of the tape 203A to be pressed against the platen roller 226 by the thermal head 231, enabling printing.

FIG. 28B shows an example of a case where the tape roll 300 having the tape 203A of a minimum width wound around the winding core 203B is mounted. In FIG. 28B, the installation member 213 of the position retaining member 212 of the roll mounting mechanism 203 is first inserted into the positioning groove part 216 of the support member 215. Then, the lower end surface of the third extending part 244 of the guide member 220 of the roll mounting mechanism 203 is made to contact the mounting part 221, and the fourth extending part 245 of the guide member 220 is inserted into the second positioning groove part 222D formed on the rear corner in the feeding direction of the mounting part 221. Further, the lower edge of the first extending part 242 of the guide member 220 is inserted into and made to contact the inside of the positioning recessed part 204A formed on the bottom of the roll housing part 204.

At the same time, the detected part 260 formed on the lower end of the extending part 256 of the position retaining member 212 of the roll mounting mechanism 203 is inserted into the detected recessed part 204B formed on the inside of the base end of the support member 215, and the elastic stopping piece 212A is engaged with the engaging recessed part 215A formed on the base end of the support member 215.

With the above operation, the roll mounting mechanism 203 is detachably installed to the roll housing part 204, and the presence or non-presence of each of the sensor holes 260A to 260E of the opposing detected part 260 is detectable via each of the roll detection sensors S1 to S5.

The subsequent upward rotation of the lever 227 and other operations are the same as described above, and descriptions thereof will be omitted.

Figure 29A:
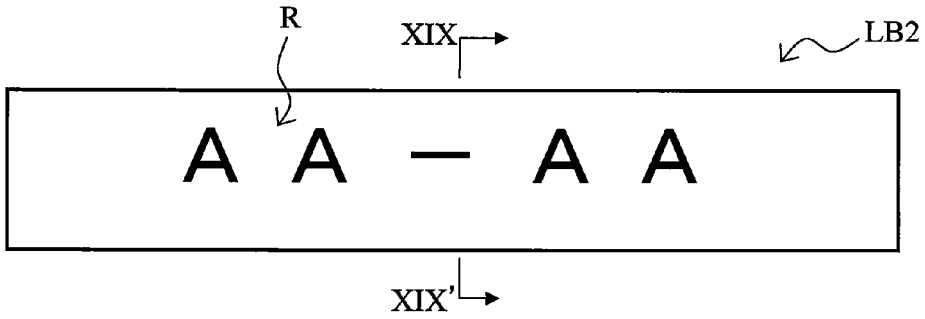
FIG. 29 is a top plan view and a bottom plan view illustrating the outer appearance of an exemplary printed label.
Figure 29B:
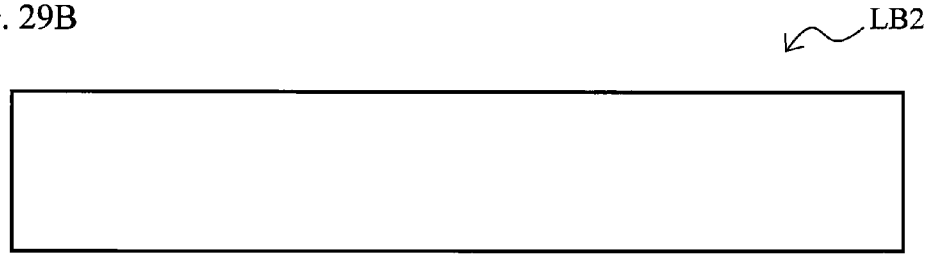
Figure 30:
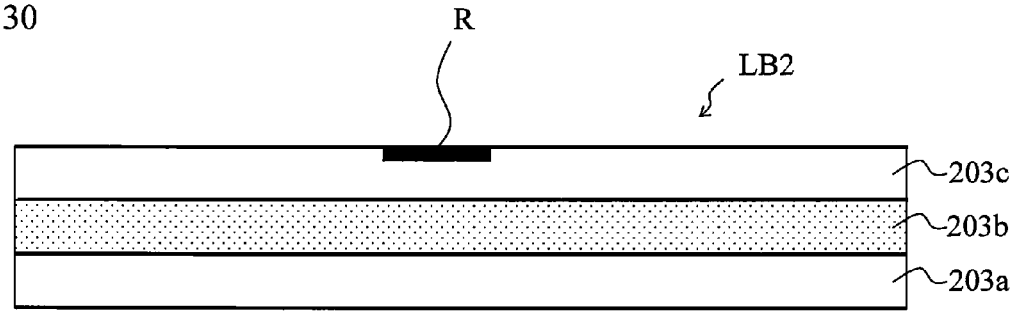
FIG. 30 is a cross-sectional view taken along a line XIX-XIX' in FIG. 29.

The printed label LB2 formed upon cutting the tape 203A as described above has the aforementioned three-layered structure composed of layers comprising the thermal paper 203*c*, the adhesive layer 203*b*, and the separation sheet 203*a*, which are layered in that order from the front surface side (the upper side in FIG. 30) to the opposite side (the lower side in FIG. 30), as shown in FIG. 29A, FIG. 29B, and FIG. 30. Then, the print characters R (the characters "AA-AA" in this example) are printed on the top surface of the thermal tape 203*c* as previously described.

In this exemplary modification, as described above, the roll mounting mechanism 203 on which the tape rolls 300 of different types are mounted is selectively mounted on the roll housing part 204, making it possible to produce the printed label LB2 while selectively using different types of tape rolls. Then, at this time, the type of the mounted tape roll 300 is detected and the residual tape amount M is calculated in accordance with the type in the same manner as the above-described first embodiment. In the following, the details of this flow will be described in order.

Figure 31:
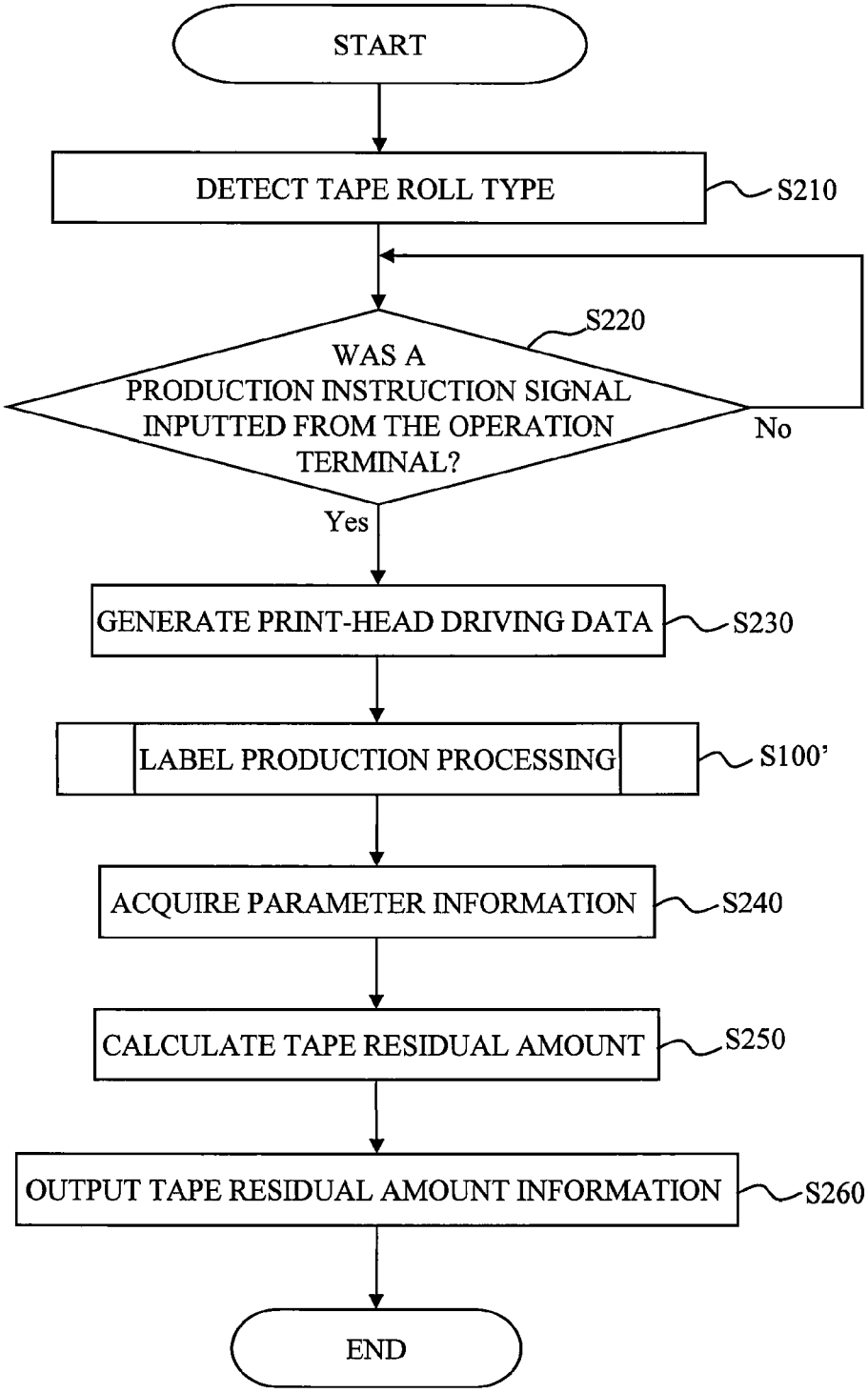
FIG. 31 is a flowchart illustrating the control procedure executed by the control circuit of the label producing apparatus.

The control contents executed by the above-described control circuit 410 of the label producing apparatus 201 will now be described with reference to FIG. 31. FIG. 31 is a flowchart corresponding to FIG. 11 of the above-described first embodiment.

In FIG. 31, the flow is started ("START" position) when the operator turns ON the power of the label producing apparatus 201, for example.

First, in step S210, the control circuit 410 outputs a control signal to the roll detection sensors S1 to S4, detects the type of the tape roll 300 mounted to the roll mounting mechanism 203, and stores the detection result in the RAM of the above-described control circuit 410. When the roll mounting mechanism 203 is not mounted at this time, the control circuit 40 detects that information. Note that the control circuit 410 may continually input and store the detection result of the roll detection sensors S1 to S4 in the above-described RAM, etc., based on this timing.

Then, in step S220, the control circuit 410 assesses whether or not a production instruction signal from another terminal or general-purpose computer (or suitable operation device of the label producing apparatus 201), for example, has been inputted via the communication circuit 411B. Until the production instruction signal is inputted, the condition is not satisfied and the routine enters a wait loop. Then, once the production instruction signal is inputted, the decision is made that the condition is satisfied and the print data included in the production instruction signal is stored in the suitable memory of the above-described RAM, etc., inside the control circuit 410, and the flow proceeds to step S230.

In step S230, the control circuit 410 reads the print data stored in memory in the above-described step S220 and executes a predetermined conversion process, for example, to generate the dot pattern data (=print-head driving data) corresponding to the contents to be printed on the tape 203A, etc. This data is then stored in the print buffer (not shown) inside the control circuit 410.

Subsequently, in step S100' (described in detail later) which is equivalent to step S100 of the above-described first embodiment, the control circuit 410 executes label production processing for producing the printed label LB2 (refer to FIG. 29, etc.) on which desired printing was performed.

Then, in step S240, the control circuit 410 accesses the above-described table storage part 410A and refers to the parameter table (refer to FIG. 32 described later) that indicates parameter information for calculating the residual tape amount for each type of the tape roll 300. Then, in the parameter table, the control circuit 40 acquires the parameter information corresponding to the type of the tape roll 300 detected in the above-described step S210. This parameter information contains the tape thickness t of the tape 203A and the roll inside diameter d of the tape roll 300. FIG. 32 shows an example of a parameter table stored in the above-described table storage part 410A.

As shown in FIG. 32, the tape width w (mm), tape thickness t (mm), total length M (mm), inside tape roll diameter d (mm), and outside tape roll diameter D (mm) for each type of the tape roll 300 are registered in advance in the parameter table. Note that the total length M and the roll outside diameter D are the values (initial values) Mo and Do when the tape roll 300 is not used. Of these, the tape thickness t and the roll inside diameter d are acquired by the control circuit 410 in the above-described step S240 as parameter information for calculating the residual tape amount.

That is, in the example of FIG. 32, in step S240, in a case where the tape 203A wound around the tape roll 300 is, for example, a long type, the parameter information of the contents w=50 (mm), t=0.18 (mm), Mo=30000 (mm), d=30 (mm), and Do=88.2 (mm) is acquired. In a case where the tape 203A wound around the tape roll 300 is a middle type, for example, the parameter information of the contents w=30 (mm), t=0.20 (mm), Mo=20000 (mm), d=30 (mm), and Do=77.4 (mm) is acquired. In a case where the tape 203A wound around the tape roll 300 is a short type, for example, the parameter information of the contents w=10 (mm), t=0.22 (mm), Mo=10000 (mm), d=30 (mm), and Do=60.8 (mm) is acquired.

Returning to FIG. 31, subsequently, in step S250, the control circuit 410 calculates the residual tape amount. The calculation method of this residual tape amount is the same as the method of the above-described first embodiment described with reference to FIG. 14 and FIG. 15, and is performed using the aforementioned "Equation A1," "Equation A2," and "Equation A3." That is:

$$M=\pi(D^2-d^2)/4t \quad \text{(Equation A1)}$$

$$D=2S/\omega \quad \text{(Equation A2)}$$

$$\omega=\theta/E \quad \text{(Equation A3)}$$

Similar to the above-described first embodiment, the tape thickness t and the roll inside diameter d are acquired from the aforementioned parameter table. In addition, the feeding speed S is determined based on the specifications of the label producing apparatus 201 and is stored in advance in the above-described RAM. Further, the angular velocity ω (rad/s) is found by dividing the angle θ [rad] corresponding to one of the plurality of detection mark 275 provided to the detected body 274 by the pulse cycle E (s) outputted from the optical sensor 251. In this exemplary modification, 16 detection mark 275 are formed on the detected body 274 as previously described, and thus the angle θ is 2π/16=π/8 [rad]. This angle θ is also stored in advance in the RAM.

Thus, the control circuit 410 detects the angular velocity ω of the roll 300 from the above-described "Equation A3" based on the pulse cycle E outputted from the optical sensor 251 and the above-described angle θ read from the above-described RAM. Then, the roll outside diameter D of the roll 300 is calculated based on the above-described "Equation A2" from this angular velocity ω and the above-described feeding speed S read from RAM. The residual tape amount M can then be calculated based on the above-described "Equation A1" from this calculated roll outside diameter D and the tape thickness t and roll inside diameter d acquired from the above-described parameter table.

Returning to FIG. 31, subsequently, in step S260, the control circuit 410 outputs the residual tape amount information corresponding to the above-described calculated residual tape amount M to another terminal, general-purpose computer, etc., via the communication circuit 411B. As a result, the residual tape amount M is displayed on the display part of the other terminal or general-purpose computer (or may be displayed on suitable display device provided to the label producing apparatus 201). This process then terminates here.

Note that, similar to the above-described first embodiment, the residual tape amount display may be a numeric display, or a display using graphics, such as a bar graph, etc., or other symbol display, etc. Further, in a case of a numeric display, the amount may be a detailed display in units of millimeters or centimeters, or a general display in units of meters.

The detailed procedure of step S100' of the above-described FIG. 32 is the same as that of step S100 of the above-described first embodiment, and the contents thereof will now be described with reference to the above-described FIG. 12.

Figure 12:
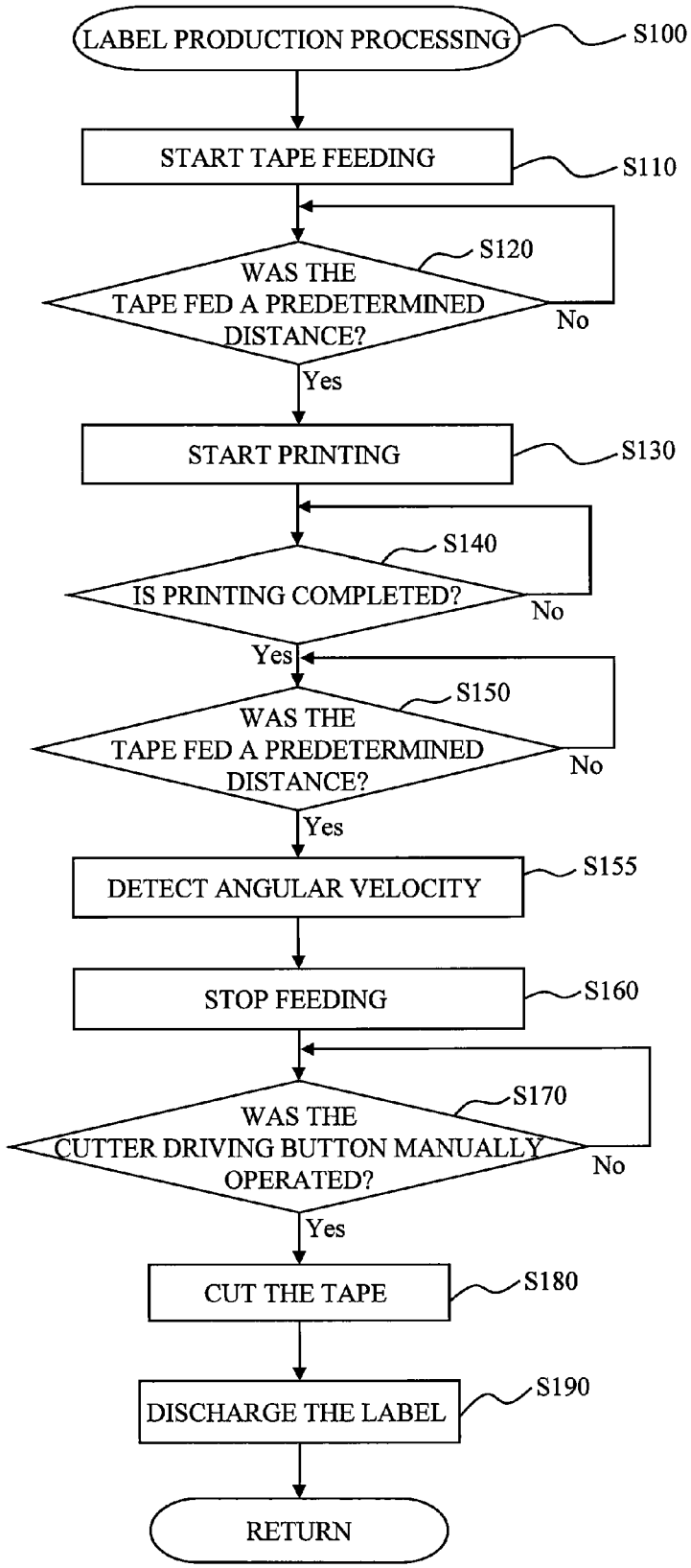
FIG. 12 is a flowchart which shows the detailed procedure of step S100.

In the above-described FIG. 12, in step S110, the control circuit 410 outputs a control signal to the platen roller circuit 409 (refer to FIG. 26) and drives the platen roller 226 by the platen roller motor 408 (refer to FIG. 26). As a result, the feed-out and feeding of the tape 203A from the tape roll 300 are started.

Subsequently, in step S120, the control circuit 410 determines whether or not the tape 203A has been fed a predetermined distance. This predetermined distance, similar to the above-described first embodiment, is the feeding distance required for the front end of the above-described print area SA of the tape 203A to reach the position substantially opposite the thermal head 231, for example. This feeding distance may be determined by simply detecting a marking provided on the tape 203A, similar to the above, using a known tape sensor (not shown). Until the tape 203A. is fed the predetermined distance, the decision is made that the condition is not satisfied and the routine enters a wait loop. Then, once the tape 203A is fed the predetermined distance, the decision is made that the condition is satisfied and the flow proceeds to step S130.

In step S130, the control circuit 410 outputs a control signal to the print-head driving circuit 405, causing the thermal head 231 to start printing in accordance with the print-head driving data in the print area SA of the tape 203A.

Then, in step S140, the control circuit 410 determines whether or not all of the printing in the above-described print area SA of the tape 203A is completed. Until all of the printing is completed, the condition is not satisfied and the control circuit 410 enters a wait loop. Then, once all of the printing is completed, the decision is made that the condition is satisfied and the flow proceeds to step S150.

Subsequently, in step S150, the control circuit 410 determines whether or not the tape 203A has been further fed a predetermined distance. Until the tape 203A is fed the predetermined distance, the condition is not satisfied and the routine enters a wait loop. Then, once the tape 203A is fed the predetermined distance, the decision is made that the condition is satisfied and the flow proceeds to step S155.

In step S155, in a case where the tape feeding speed after printing has begun is constant, the control circuit 410 inputs the timing of the pulse stream, which is the detection result of the detection mark 275 formed on the detected body 274 by the optical sensor 251, in parallel with the tape feeding operation, and detects the angular velocity of the tape roll 300 based on the pulse cycle.

In step S160, the control circuit 410 outputs a control signal to the platen roller driving circuit 409, stops the driving of the platen roller 226 by the platen roller motor 408, and stops the feed-out and feeding of the tape 203A from the tape roll 300. With this arrangement, the tape 203A is cut when the operator manually operates the above-described cutter lever 209, formed into the printed label LB2 on which printing was performed in accordance with the print-head driving data, and discharged outside the apparatus. In this exemplary modification, step S170, step S180, and step S190 of FIG. 12 are omitted and subsequently the routine ends.

In the above-described exemplary modification, the roll detection sensors S1 to S4 acquire the type information of the tape roll 300 mounted to the roll housing part 204 via the roll housing mechanism 203. The optical sensor 251 optically detects the detection mark 275 of the detected body 274 that rotates at the same angular velocity as the roll 300. Then, the control circuit 410 calculates the residual tape amount M of the tape roll 300 based on the type information acquired by the roll detection sensors S1 to S4 and the detection result of the optical sensor 251 in the above-described step S250, and outputs the residual tape amount information corresponding to the calculated residual tape amount in step S260. With this arrangement, it is possible to display the residual tape amount M to the operator.

With the residual tape amount M thus calculated based on the type information of the tape roll 300 and the detection result of the optical sensor 251, it is possible to calculate the residual tape amount M corresponding to the type of roll, even in a case where the aforementioned plurality of different types of tape rolls 300 is used in the label producing apparatus 201, similar to the above-described first embodiment. As a result, the operator can reliably recognize the residual tape amount M, even in a case where a plurality of different types of printed labels LB2 is produced.

Further, in this exemplary modification in particular, the control circuit 410 acquires parameter information related to the tape roll 300 based on the type information of the tape roll 300 acquired by the roll detection sensors S1 to S4 in the above-described step S240. Then, in step S250, the control circuit 240 calculates the residual tape amount M based on "Equation A1," "Equation A2," and "Equation A3" using the parameter information acquired in step S240 and the angular velocity ω of the tape roll 300 based on the detection result of the optical sensor 251. With the residual tape amount M thus consecutively calculated based on the parameter information and the detection result of the optical sensor 251, the residual tape amount M can be detected with high accuracy compared to a case where the residual tape amount M is identified using a residual amount table prepared in advance, for example, without the accuracy being affected by the volume of data in a table. As a result, the operator can minutely identify the residual tape amount M.

Further, in this exemplary modification in particular, the table storage part 410A stores in advance a parameter table that indicates the tape thickness t of the tape 203A and the roll inside diameter d of the tape roll 300 for each type of the tape roll 300. Then, the control circuit 410 refers to the parameter table in the above-described step S240, and acquires as parameter information the roll inside diameter d of the tape roll 300 and the tape thickness t corresponding to the type information of the tape roll 300 acquired by the roll sensors S1 to S4. Then, in step S250, the control circuit 410 calculates the residual tape amount M using the parameter information and the angular velocity ω of the tape roll 300. With the residual tape amount M thus calculated upon acquiring as parameter information the tape thickness t and the roll inside diameter d of the tape roll 300, which differ for each of the types of the tape roll 300, it is possible to reliably identify the residual tape amount M in accordance with the type of the tape roll 300. Further, with the tape thickness t and the roll inside diameter d of the tape roll 300 thus identified using a parameter table prepared in advance, it is possible to decrease the amount of information to be acquired and simplify the structure of the roll detection sensors S1 to S4, which are mechanical sensor mechanisms, compared to a case where the tape thickness t and the roll inside diameter d of the tape roll 300 are acquired in addition to the tape roll type information by the roll detection sensors S1 to S4.

Next, a second embodiment of the present disclosure will be described with reference to FIGS. 33 to 36. Note that components identical to those in the above-described first embodiment are denoted using the same reference numerals, and descriptions thereof will be omitted or simplified as appropriate.

In the above-described first embodiment, the control circuit 40 detects the residual tape amount M using the above-described "Equation A1," "Equation A2," and "Equation A3" based on the tape thickness t and the roll inside diameter d acquired from the parameter table and the angular velocity ω based on the detection result of the first optical sensor 51. In this second embodiment, the tape thickness t is calculated based on the change in the pulse cycle E outputted from the first optical sensor 51 right around the time the tape is fed a predetermined feeding distance L, and the residual tape amount M is calculated based on the tape thickness t thus calculated.

The control contents executed by the control circuit 40 of the label producing apparatus 100 of this embodiment will now be described with reference to FIG. 33.

Figure 33:
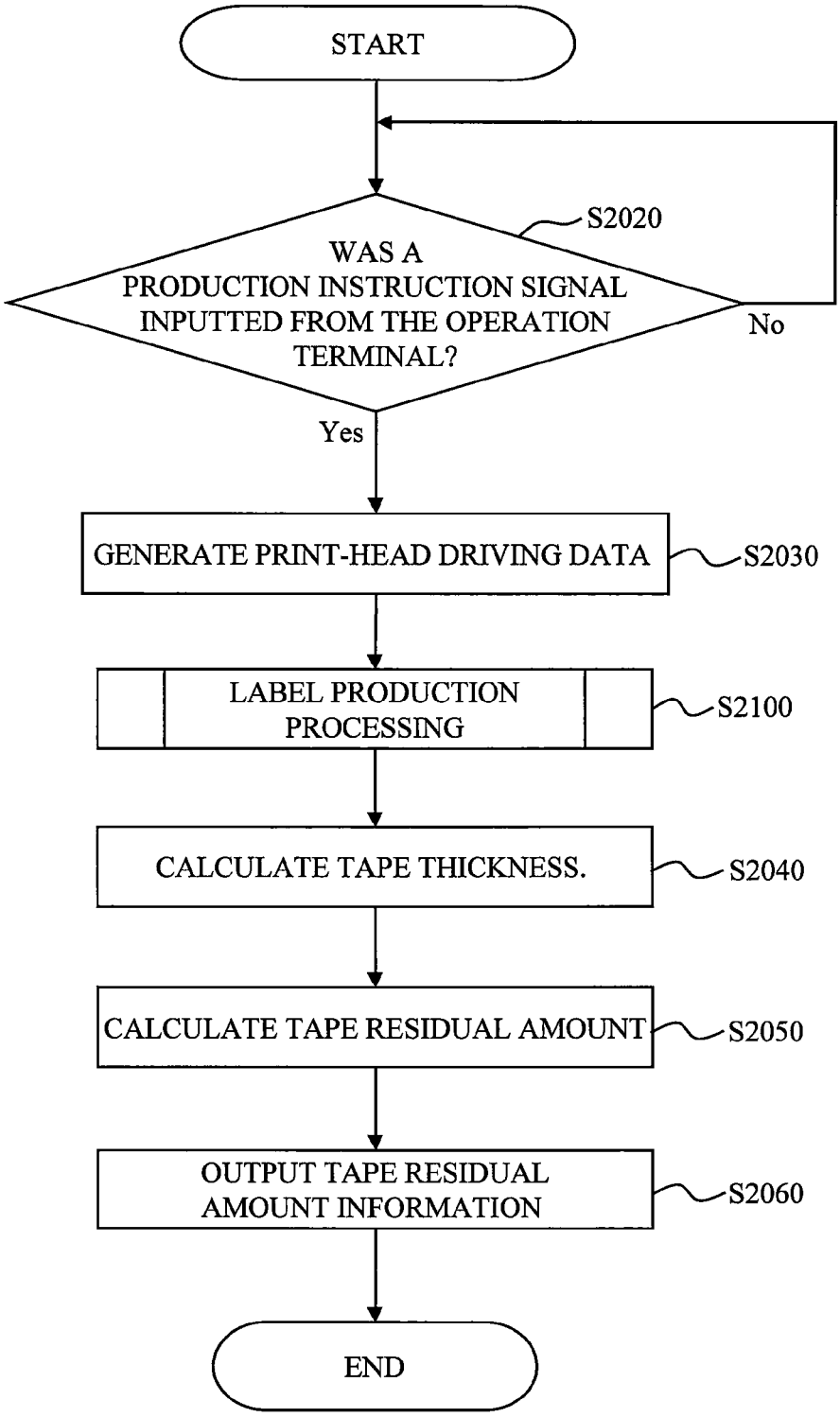
FIG. 33 is a flowchart illustrating the control contents executed by the control circuit of the label producing apparatus of the second embodiment of the present disclosure.

In FIG. 33, the flow is started ("START" position) when the operator turns ON the power of the label producing apparatus 100, for example.

First, in step S2020, similar to step S20 of the above-described FIG. 11, the control circuit 40 assesses whether or not a production instruction signal outputted from the operation terminal 400 has been inputted via the communication line NW. If the production instruction signal was inputted from the operation terminal 400, the decision is made that the condition is satisfied, the print data included in the production instruction signal is stored in the text memory 48A, and the flow proceeds to step S2030.

In step S2030, the control circuit 40, similar to step S30 of the above-described FIG. 11, generates dot pattern data corresponding to the print contents from the print data stored in the text memory 48A in the above-described step S2020. Then, the dot pattern data is stored in the print buffer 48B.

Subsequently, in step S2100, the control circuit 40 executes the label production processing (for the detailed procedure, refer to FIG. 12 described later) for producing the printed label LB1, similar to the step S100 of the above-described FIG. 11.

Then, in step S2040, the control circuit 40 calculates the tape thickness of the label producing tapes 16, 16', and 16". The details of this tape thickness calculation method will be described later.

Subsequently, in step S2050, the control circuit 40 calculates the residual tape amount. That is, as described in the above-described first embodiment, in a case where the tape feeding speed is constant, since there exists a predetermined correlation between the outside diameter of the tape rolls 17, 17', and 17" and the tape roll angular velocity, and there is a one-to-one correspondence between the roll outside diameter and residual tape amount, in this second embodiment, this correlation is utilized to calculate the residual tape amount from the angular velocity of the tape rolls 17, 17', and 17" based on the detection result of the first optical sensor 51.

The above-described residual tape amount calculation method will now be described in detail.

As described in the above-described first embodiment, in this embodiment as well, given the tape thickness t, tape total length M, roll outside diameter D, and roll inside diameter (spool outside diameter) d, the equation $M=\pi(D^2-d^2)/4t$ is established. Hereinafter, this equation will be referred to as "Equation B1" (which is the same as the aforementioned Equation A1).

Of the variables in the above-described "Equation B1", the tape thickness t is calculated from "Equation B3" described later. Further, the above-described spool outside diameter d is stored in advance in the RAM 48, etc. Therefore, if the roll outside diameter D is acquired, the tape length M (hereinafter suitably referred to as "residual tape amount M") serving as the residual tape amount can be calculated.

Here, as described in the above-described first embodiment, given the roll angular velocity ω (rad/s) and the tape feeding speed S (mm/s), the equation $D=2S/\omega$ is established (which is the same as the aforementioned Equation A2). Hereinafter, this equation will be referred to as "Equation B2." Here, as previously described, the feeding speed S is stored in advance in the RAM 48, for example. Further, the angular velocity ω (rad/s) is the value found by dividing the angle θ [rad] by the pulse cycle E (s) (that is $\omega=\theta/E$). As previously described, 48 detection mark 75 are formed on the detected body 74, the angle θ is equal to $2\pi/48=\pi/24$ [rad], and this value is stored in advance in the RAM 48, etc.

The calculation method of the tape thickness t referred to in the above-described step S2040 will now be described in detail. The tape thickness t can be estimated utilizing the fact that the difference from the square value of the above-described pulse cycle E when the tape has been consumed (fed) a predetermined length is a constant value corresponding to the tape thickness t.

Specifically, from the above-described "Equation B1," the following relationship exists:

$$M=\pi(D^2-d^2)/4 \quad \text{(a)}$$

Based on the roll outside diameter D (mm), given the roll outside diameter D' (mm) when the tape is consumed a tape feeding distance L (mm) calculated by the CPU 44, the following is derived:

$$M-L=\pi(D'^2-d^2)/4t \quad \text{(b)}$$

When Equation (b) is subtracted from Equation (a), the following is obtained:

$$L=\pi(D^2-D'^2)/4t$$

$$4tL=\pi(D^2-D'^2) \quad \text{(c)}$$

Further, given a resolution R of detection of the above-described pulse cycle E (a total number of detection mark 75 formed on the detected body 74), a pulse cycle E (msec) with an roll outside diameter D (mm), and a pulse cycle (msec) when the tape is subsequently consumed the above-described tape feeding distance L (mm), the following is derived:

$$D=(R\times E\times S)/\pi \quad \text{(d)}$$

$$D'=(R\times E'\times S)/\pi \quad \text{(d)'}$$

Note that the following relationship exists between the resolution R and the above-described angle θ:

$$\theta=2\pi/R \quad \text{(e)}$$

When Equation (d), Equation (d)', and Equation (e) are substituted in Equation (c), the following is derived:

$$t=\pi S^2/\theta^2\times L\times(E^2-E'^2)$$

Hereinafter, this equation will be referred to as "Equation B3."

Thus, the control circuit 40 calculates the tape thickness t based on the above-described "Equation B3" from the tape feeding distance L calculated by the CPU 44, the pulse cycles E and E' (in other words, the pulse cycle history information) outputted from the first optical sensor 51, and the above-described angle θ and the above-described feeding speed S read from the above-described RAM 48. Further, the control circuit 40 detects the roll angular velocity ω (=θ/E) based on the pulse cycle E outputted from the first optical sensor 51 and the above-described angle θ read from the above-described RAM 48, and calculates the roll outside diameter D based on the above-described "Equation B2" from this angular velocity ω and the above-described feeding speed S read from the RAM 48. Then, the control circuit 40 can calculate the residual tape amount M based on the above-described "Equation B1" from the calculated tape thickness t and the roll outside diameter D as well as the spool outside diameter d read from the RAM 48.

Returning to FIG. 33, subsequently, in step S2060, the control circuit 40 outputs the residual tape amount information corresponding to the above-described calculated residual tape amount M to the operation terminal 400 via the communication line NW, similar to step S60 of the above-described FIG. 11. As a result, the residual tape amount M is then displayed on the display part 401 of the operation terminal 400. This process then terminates here.

In the above-described second embodiment, the detected body 74 that rotates at an angular velocity (the same angular velocity in the above-described example) in coordination with the tape rolls 17, 17', and 17" is provided, and the first optical sensor 51 optically detects the detection mark 75 of the detected body 74. Further, the CPU 44 calculates the feeding distance L of the label producing tapes 16, 16', and 16". Then, the control circuit 40 calculates the residual tape amount M of the tape rolls 17, 17', and 17" based on the aforementioned predetermined calculation formulas using the above-described history information of the pulse cycle E consecutively detected by the plurality of detection mark 75 based on the spool outside diameter d set in advance, the feeding distance L calculated by the CPU 44, and the detection result of the first optical sensor 51, and outputs the residual tape amount information corresponding to the residual tape amount M thus calculated to the operation terminal 400. As a result, the residual tape amount M can be displayed on the display part 401 of the operation terminal 400.

Specifically, the change in the pulse cycle of the plurality of detection mark 75 from E to E' when the label producing tapes 16, 16', and 16" are fed the feeding distance L is utilized to further calculate first the tape thickness t from the above-described "Equation B3" using the feeding speed S and the disposed pitch angle θ of the detection mark 75 known in advance. Then, the residual tape amount M is calculated from the above-described "Equation B1" and "Equation B2" using this tape thickness t, the above-described spool outside diameter d and feeding speed S, and the angular velocity ω of the tape rolls 17, 17', and 17" based on the detection result of the first optical sensor 51. With this arrangement, it is possible to reliably calculate the residual tape amount M corresponding to the type of the cartridges 10, 10', and 10".

If the spool outside diameter d is thus known, it is possible to calculate the residual tape amount based on the detection result of the first optical sensor 51 and the feeding distance L without acquiring the tape thickness t, which differs for each of the cartridges 10, 10', and 10" (in other words, for each tape roll type), as parameter information. As a result, even in a case where the aforementioned plurality of cartridges 10, 10' and 10" of different types (in other words, tape rolls of different types) is used in the label producing apparatus 100, the residual tape amount can be calculated in accordance with the type of the cartridges 10, 10', and 10" (in other words, the tape roll type). As a result, the operator can reliably recognize the residual tape amount, even in a case where a plurality of different types of printed labels LB1 is produced.

Further, in this embodiment in particular, as described above, the control circuit 40 consecutively calculates the residual tape amount based on the detection result of the first optical sensor 51 and the feeding distance L, without acquiring the tape thickness t of the label producing tapes 16, 16', and 16" as parameter information. With this arrangement, acquisition of the type information of the cartridges 10, 10', and 10" (in other words, the tape roll type information) is no longer required. Therefore, it is possible to reliably identify the residual tape amount even in a case where a new tape cartridge of an unknown tape thickness t is used, if the spool outside diameter d is known. Furthermore, the tape thickness t of an actual product of the label producing tapes 16, 16', and 16" is not always constant, but rather fluctuates within a range of product error. In response, according to the above-described first embodiment, the tape thickness t of the label producing tapes 16, 16', and 16" is consecutively calculated by the above-described predetermined calculation formulas, making it possible to identify the residual tape amount with accuracy in a form that accommodates the fluctuation of the above-described tape thickness t which differs in each tape section as described above.

Note that various modifications may be made according to the second embodiment without departing from the spirit and scope of the disclosure, in addition to the above-described embodiment. Description will be made below regarding such modifications.

(2-1) Using a Residual Amount Table

While in the above-described second embodiment the control circuit 40 calculates the residual tape amount M using the above-described "Equation B1" to "Equation B3," the calculation of this residual tape amount M may be performed in advance and a residual amount table that indicates the correlation between the residual tape amount M and the pulse cycle E outputted from the first optical sensor 51 for each cartridge type may be stored in the table storage part 49.

An example of a residual amount table stored in the table storage part 49 will now be described with reference to FIG. 34. In the example shown in FIG. 34, the corresponding roll outside diameter D (mm) and the residual tape amount M (mm) of each cartridge type are calculated and registered in the residual amount table for each 0.005 (s) change in the pulse cycle E outputted from the first optical sensor 51. Here, the residual tape amount M is calculated from the above-described "Equation B1" to "Equation B3" using the values of each of the aforementioned parameters, given a feeding speed S of 10 (mm/s) and an angle θ of π/24 [rad]. Note that the increment of the above-described pulse cycle E may be a smaller or greater value.

Figure 35:
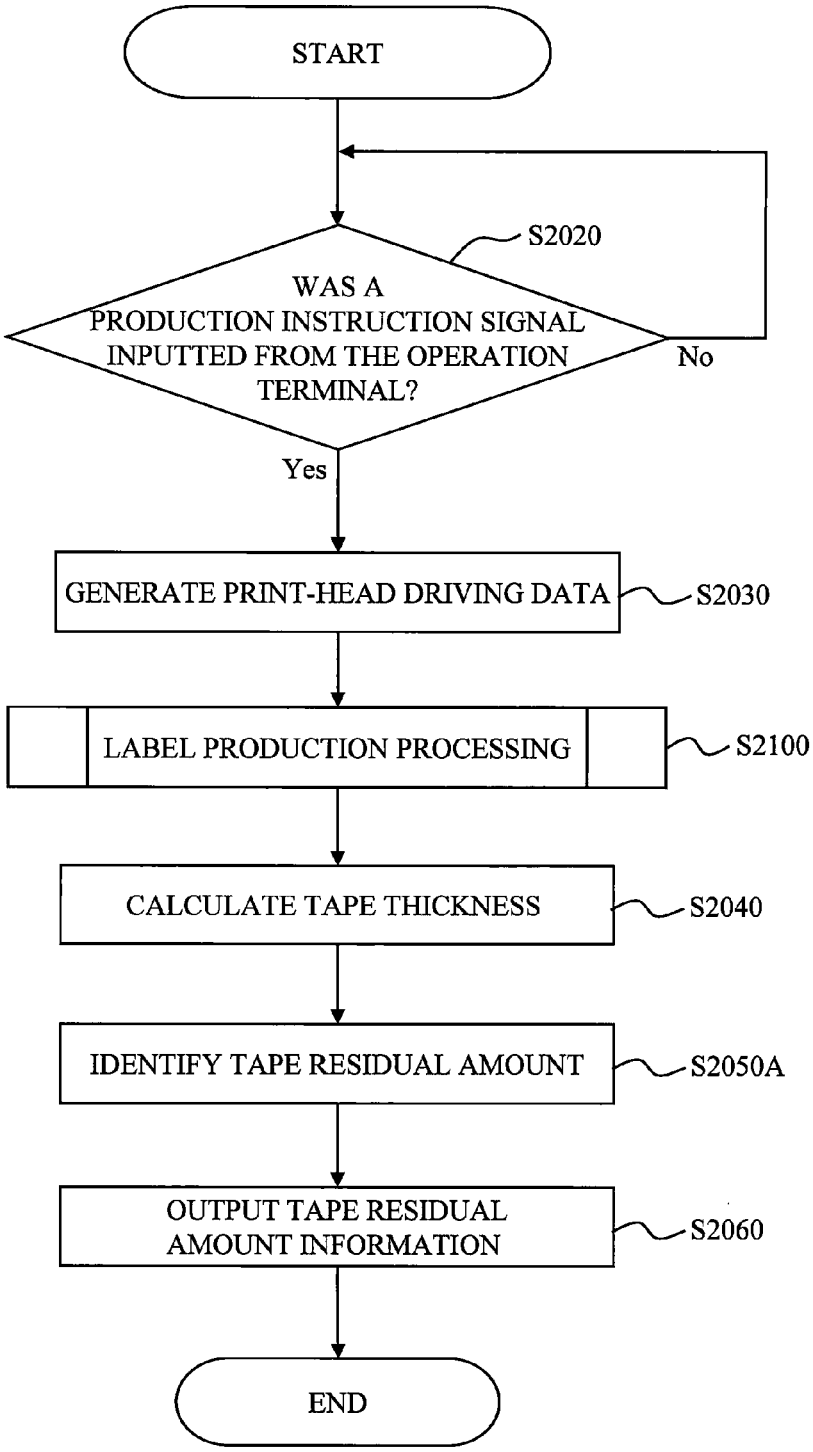
FIG. 35 is a flowchart illustrating the control content executed by the control circuit when there is a residual amount table.

The control contents executed by the control circuit 40 of this exemplary modification will now be described with reference to FIG. 35. In FIG. 35, step S2020 to step S2040 are the same as those of FIG. 33 previously described, and descriptions thereof will be omitted. In the next step S2050A provided in place of step S2050, the control circuit 40 refers to the section in the residual amount table stored in the table storage part 49 that corresponds to the cartridge type having the tape thickness t calculated in the aforementioned step S2040, and identifies the residual tape amount M corresponding to the pulse cycle E based on the detection result of the first optical sensor 51. The subsequent step S2060 is identical to that of FIG. 33 previously described.

Specifically, in a case where the cartridge 10 of a laminated type is mounted, for example, and the pulse cycle E is 0.220 (s), the residual tape amount M is 5511 (mm), as shown in FIG. 34. Therefore, the residual tape amount M is displayed as 5511 (mm) at the moment the pulse cycle E is 0.220 (s), and subsequently displayed as 5511 (mm) until the pulse cycle E changes to the next 0.215 (s). Then, when the pulse cycle E changes to the next 0.215 (s), the residual tape amount display changes to 5178 (mm). In this manner, the residual tape amount is displayed in accordance with each 0.005 (s) change in the pulse cycle E.

According to this exemplary modification, a residual amount table that indicates the correlation between the pulse cycle E of the plurality of detection mark 75 and the residual tape amount M for each type of cartridge (in other words, for each tape roll type) is stored in advance in the table storage part 49. Then, the control circuit 40 refers to the correlation corresponding to the type of cartridge in the residual amount table, and identifies the residual tape amount M of the tape rolls 17, 17', and 17" by extracting the residual tape amount M corresponding to the pulse cycle of the plurality of detection mark 75 based on the detection result of the first optical sensor 51.

The residual tape amount M is thus identified using a residual amount table prepared in advance and therefore, compared to a case where the residual tape amount M is consecutively calculated based on the detection result of the first optical sensor 51 as in the above-described second embodiment, does not require calculations, simplifying the control contents related to residual tape amount detection. As a result, the CPU, etc., can be designed with low specifications, thereby achieving lower costs. This also offers the advantage of shortening the time required to identify the residual tape amount M to the extent that the calculations are no longer required.

Note that while the residual amount table was meticulously set in the above, a table that is more broadly set may be used, as shown in FIG. 36, for example. In the example shown in FIG. 36, the pulse cycle E is calculated and registered for each 1 (m) change in the residual tape amount. In such a case, when the pulse cycle E is detected as 0.200 (s), for example, the residual tape amount may be displayed as "4-5 m" for the laminated type, "5-6 m" for the receptor type, and "2-3 m" for the thermal type.

Further, while a residual amount table that indicates the correlation between the pulse cycle of the plurality of detection mark 75 and the residual tape amount for each cartridge type is stored in the table storage part 49 in the above, a residual amount table that stores the correlation between the angular velocity ω of the tape rolls 17, 17', and 17" rather than the pulse cycle and the residual tape amount for each cartridge type may be stored in the table storage part 49. In such a case, the control circuit 40 identifies the residual tape amount M of the tape rolls 17, 17', and 17" by referring to the correlation corresponding to the type of cartridge in the residual amount table and extracting the residual tape amount M corresponding to the angular velocity ω of the tape rolls 17, 17', and 17" based on the detection result of the first optical sensor 51. Further, the correlation between both the angular velocity ω and the pulse cycle E with the residual tape amount M may be used.

(2-2) Not Using a Cartridge

The following describes an exemplary modification of the second embodiment for producing printed labels using tape rolls of a plurality of different types and not a cartridge.

In this exemplary modification, as described above, in the tag label producing apparatus 201 of the same configuration as the exemplary modification of the above-described (1-2), the roll mounting mechanism 203 on which the tape roll 300 of a variety of different types is mounted is selectively mounted on the roll housing part 204, making it possible to produce the printed label LB2 while selectively using different types of tape rolls. Then, at this time, similar to the above-described second embodiment, the tape thickness t of the tape 203A of each of the tape rolls 300 can be calculated and the residual tape amount M can be found without detecting the type of the mounted tape roll 300. In the following, the details of this procedure will be described in order.

The control contents executed by the above-described control circuit 410 of the label producing apparatus 201 are the same as the procedures of step S2020 to step 2060 of the above-described second embodiment described with reference to FIG. 33, and will be described with reference to the above-described FIG. 33.

In FIG. 33, the flow is started ("START" position) when the operator turns ON the power of the label producing apparatus 201, for example.

First, in step S2020, similar to the above-described second embodiment, the control circuit 410 assesses whether or not a production instruction signal was inputted via the communication circuit 411B. Then, once the production instruction signal is inputted, the decision is made that the condition is satisfied and the print data included in the production instruction signal is stored in the suitable memory of the above-described RAM, etc., inside the control circuit 410, and the flow proceeds to step S2030.

In step S2030, the control circuit 410, similar to the above-described second embodiment, generates dot pattern data corresponding to the print contents from the print data stored in memory in the above-described step S2020. This data is then stored in the print buffer (not shown) inside the control circuit 410.

Subsequently, similar to the above-described second embodiment, in step S2100, the control circuit 410 executes the label production processing for producing the printed label LB2 (using the same detailed procedure as previously described) on which desired printing was performed.

Then, in step S2040, the control circuit 410 calculates the tape thickness t of the tape 203A using the same technique as in the above-described second embodiment. Subsequently, in step S2050, the control circuit 410 calculates the residual tape amount M of the roll 300. The tape thickness t and the residual tape amount M are calculated in step S2040 and step S2050 using the same technique as in the aforementioned second embodiment, using the "Equation B1," "Equation B2" and "Equation B3" previously described. That is:

$$M=\pi(D^2-d^2)/4t \quad \text{(Equation B1)}$$

$$D=2S/\omega \quad \text{(Equation B2)}$$

$$t=\pi S^2/\theta^2 L\times(E^2-E'^2) \quad \text{(Equation B3)}$$

That is, similar to the above-described second embodiment, the tape thickness t is calculated based on the above-described "Equation B3" from the tape feeding distance L calculated by the control circuit 410, the pulse cycles E and E (in other words, the pulse cycle history information) outputted from the first optical sensor 251, and the above-described angle θ and the above-described feeding speed S read from the above-described RAM inside the control circuit 410. Further, the angular velocity ω (=θ/E) of the roll 300 is detected based on the pulse cycle E outputted from the first optical sensor 251 and the above-described angle θ read from the above-described RAM, and the roll outside diameter D is calculated based on the above-described "Equation B2" from this angular velocity ω and the above-described feeding speed S read from the RAM. Then, the residual tape amount M of the roll 300 can be calculated based on the above-described "Equation B1" from the calculated tape thickness t and roll outside diameter D as well as the spool outside diameter d read from the RAM.

Subsequently, in step S2060, similar to the above-described second embodiment, the control circuit 410 outputs the residual tape amount information corresponding to the above-described calculated residual tape amount M to another terminal or general-purpose computer, etc., and displays the residual tape amount M on the display part. This process then terminates here.

In the exemplary modification described above as well, similar advantages to those of the second embodiment are provided. That is, the detected body 274 that rotates at an angular velocity (at the same angular velocity in the above-described example) in coordination with the tape roll 300 is provided, and the optical sensor 251 optically detects the detection mark 275 of the detected body 274. Further, the control circuit 410 calculates the feeding distance L of the tape 203A. Then, the control circuit 410 calculates the residual tape amount M of the tape roll 300 based on the aforementioned predetermined calculation formulas using the above-described history information of the pulse cycle E consecutively detected by the plurality of detection mark 275 based on the detection result of the first optical sensor 251, the feeding distance L calculated by the control circuit 410, and the spool outside diameter d set in advance, and outputs the residual tape amount information corresponding to the residual tape amount M thus calculated. With this arrangement, it is possible to display the residual tape amount M to the operator.

Specifically, the change in the pulse cycle of the plurality of detection mark 275 from E to E' when the tape 203A is fed the feeding distance L is utilized to first further calculate the tape thickness t from the above-described "Equation B3" using the feeding speed S and the disposed pitch angle θ of the detection mark 275 known in advance. Then, the residual tape amount M is calculated from the above-described "Equation B1" and "Equation B2" using this tape thickness t, the above-described spool outside diameter d and feeding speed S, and the angular velocity w of the tape roll 300 based on the detection result of the optical sensor 251. As a result, the residual tape amount M can be reliably calculated.

Thus, if the spool outside diameter d is known, the residual tape amount M can be calculated based on the detection result of the optical sensor 251 and the feeding distance L, without acquiring as parameter information the tape thickness t which differs for each type of the tape roll 300. As a result, even in a case where a plurality of different types of tape rolls 300 is used in the label producing apparatus 200, the residual tape amount M can be calculated. As a result, the operator can reliably recognize the residual tape amount M, even in a case where a plurality of different types of printed labels LB1 is produced.

Further, in this exemplary modification in particular, as described above, the control circuit 410 consecutively calculates the residual tape amount M based on the detection result of the optical sensor 251 and the feeding distance L, without acquiring the tape thickness t of the tape 203A as parameter information. With this arrangement, acquisition of the type information of the tape roll 300 is no longer required. Therefore, it is possible to reliably identify the residual tape amount M even in a case where a new tape roll 300 of an unknown tape thickness t is used, if the spool outside diameter d is known. Furthermore, the tape thickness t of an actual product of the tape 203A is not always constant, but rather fluctuates within a range of product error. In response, in this exemplary modification, the tape thickness t of the tape 203A is consecutively calculated by the above-described predetermined calculation formulas, making it possible to identify the residual tape amount with accuracy in a form that accommodates the fluctuation of the above-described tape thickness t, which differs in each tape section as described above.

Next, a third embodiment of the present disclosure will be described with reference to FIGS. 37 to 41. Note that components identical to those in the above-described first and second embodiments are denoted using the same reference numerals, and descriptions thereof will be omitted as appropriate. In this third embodiment, the feeding distance L of the tape is calculated and then the residual tape amount M is calculated based on this feeding distance L thus calculated, the number of encoder pulses N based on the detection result of the first optical sensor 51, and the tape thickness t and roll inside diameter d acquired from the parameter table.

The control procedure executed by the control circuit 40 of the label producing apparatus 100 of this embodiment is the same as that described in the above-described first embodiment with reference to FIG. 11.

That is, similar to the above, in step S10, the control circuit 40 stores the detection result of the cartridge sensor 37 in the RAM 48, for example, and, in step S20, assesses whether or not a production instruction signal has been inputted. Subsequently, in step S30, the control circuit 40 generates and stores the print-head driving data in the print buffer 48B and, in step S100, executes the label production processing (for the detailed procedure, refer to FIG. 38 described later).

Then, in step S40, the control circuit 40 refers to the above-described parameter table (refer to FIG. 13 previously described) and acquires the parameter information corresponding to the type of cartridge detected in the above-described step S10. Subsequently, in step S50, the control circuit 40 calculates the residual tape amount.

The above-described residual tape amount calculation method will now be described in detail with reference to FIG. 37.

As described in the above-described first embodiment and second embodiment, in this embodiment as well, given the tape thickness t, tape total length M, roll outside diameter D, and the roll inside diameter (spool outside diameter) d, the equation $M=\pi(D^2-d^2)/4t$ is established. Hereinafter, this equation will be referred to as "Equation C1" (which is the same as the aforementioned Equation A1 and Equation B1).

In this embodiment, of the variables of the above-described "Equation C1," the tape thickness t and the roll inside diameter d are acquired from a parameter table as previously described. Therefore, if the roll outside diameter D is acquired, the tape total length M serving as the residual tape amount (hereinafter suitably referred to as "residual tape amount M") can be calculated.

Figures 37A, 37B:
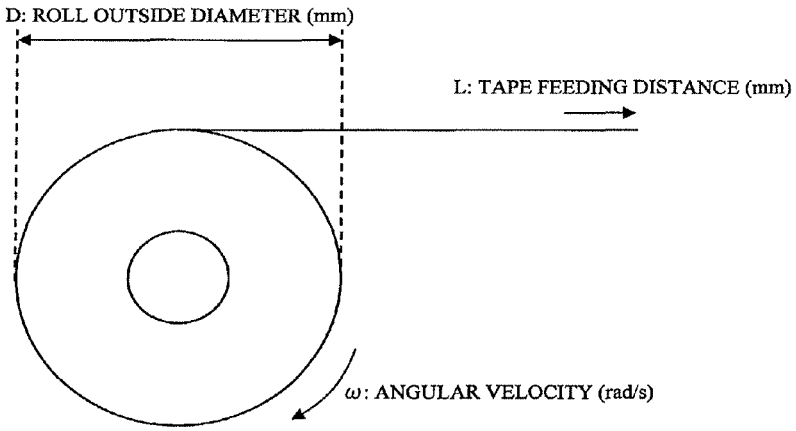
FIG. 37 is a diagram for explaining the method of calculating the roll outside diameter from the roll angular velocity based on the detection result of the first optical sensor.

Here, as shown in FIG. 37A, given a roll angular velocity ω (rad/s) and a length of tape, that is a feeding distance, L (mm) fed out from the roll in a predetermined time range (equivalent to the time range in which N encoder pulses are outputted as described later), then the feeding distance L can be expressed as D (roll outside diameter)/2×Angular velocity ω, as shown in FIG. 37B. From this equation, $D=2L/\omega$ is derived. Further, the angular velocity ω (rad/s) is a value found by multiplying the number of encoder pulses N outputted in one second from the first optical sensor 51 (the number of detection mark 75 detected by the first optical sensor 51 in one second) by the angle θ [rad] corresponding to one of the plurality of detection mark 75 provided to the detected body 74. That is, $\omega=\theta\times N$. Rearranged, given the feeding distance L of the above-described predetermined time range, and the number of encoder pulses N in that time range (in other words, when the tape is fed the feeding distance L), the equation $D=2L/\theta N$ is derived. Hereinafter, this equation is referred to as "Equation C2." Note that, as previously described, 48 detection marks 75 are formed on the detected body 74, the angle θ is equal to $2\pi/48=\pi/24$ [rad], and this value is stored in advance in the RAM 48, for example.

Here, the feeding distance L corresponds to the number of motor pulse signals of the feeding motor 33, which is a pulse motor (regardless of the existence or non-existence of any change in the feeding speed during the feeding or the state of such a change). Thus, the control circuit 40 can calculate the feeding distance L based on the number of motor pulse signals in the above-described time range as described above. Then, the control circuit 40 calculates the roll outside diameter D based on the above-described "Equation C2" from that feeding distance L thus calculated, the number of encoder pulses N outputted from the first optical sensor 51 in the above-described predetermined time range corresponding to the feeding distance L, and the above-described angle θ read from the above-described RAM 48. Then, the residual tape amount M can be calculated based on the above-described "Equation C1" from this roll outside diameter D thus calculated and the tape thickness t and roll inside diameter d acquired from the parameter table.

Returning to FIG. 11, subsequently, in step S60, the control circuit 40 outputs the residual tape amount information corresponding to the above-described calculated residual tape amount M to the operation terminal 400, and the residual tape amount M is displayed on the display part 401 of the operation terminal 400. The flow of FIG. 11 then terminates here.

The detailed procedure of step S100 of the above-described FIG. 11 executed by the control circuit 40 in this third embodiment will now be described with reference to FIG. 38. The description that follows uses as an example the case in FIG. 38 where the printed label LB1 is produced using the cartridge 10 of a laminated type.

First, in step S3110, the control circuit 40 outputs a control signal (motor pulse signal) to the feeding motor driving circuit 34. As a result, the feeding motor 33 drives the feeding roller driving shaft 30 and the ribbon take-up roller driving shaft 31, thereby starting the feed-out of the base tape 16 from the base tape roll 17 and the feed-out of the cover film 11 from the cover film roll 12. As a result, the feeding of the base tape 16, the cover film 11, and the label tape 23 with print (hereinafter collectively simply referred to as the "base tape 16, etc.") is started. Further, in this step S3110, calculation of the feeding distance based on the above-described motor pulse signal is also started. This calculation may be made by, for example, storing the counter value of the motor pulse signal at that time in the RAM 48, etc., as the value at the time that feeding started, and finding the deviation up to the counter value of the motor pulse signal in step S3165 described later, or clearing the counter value of the motor pulse signal at that time to zero, which is the initial value. Further, in this step S3110, detection (counting) of the encoder pulse detected by the above-described first optical sensor 51 is also started. This counting may be performed by, for example, clearing the number of encoder pulses at that moment to zero, and then counting the number of encoder pulses detected by the first optical sensor 51 up to step S3165 described later.

Subsequently, in step S3120, the control circuit 40 determines whether or not the base tape 16, etc., has been fed a predetermined distance, similar to step S120 of FIG. 12. This predetermined distance is a feeding distance required for the top edge of the print area of the cover film 11 to arrive at a position substantially opposite the print head 19, for example. This feeding distance may be determined based on the motor pulse signal as previously described or by detecting a marking using a known tape sensor (not shown). Until the tape is fed the predetermined distance, the decision is made that the condition is not satisfied and the routine enters a wait loop. Then, once the tape is fed the predetermined distance, the decision is made that the condition is satisfied and the flow proceeds to step S3130.

In step S3130, the control circuit 40 causes the print head 19 to start printing in accordance with the print-head driving data in the print area of the cover film 11, similar to step S130 of FIG. 12.

Then, in step S3140, the control circuit 40 determines whether or not all of the printing in the above-described print area of the cover film 11 is completed, similar to step S140 of FIG. 12. If all printing is completed, the decision is made that the condition is satisfied and the flow proceeds to step S3150.

In step S3150, the control circuit 40 determines whether or not the base tape 16, etc., has been fed a predetermined distance, similar to step S150 of FIG. 12. The feeding distance at this time is determined in the same manner as described above as well. If the base tape 16, etc., has been fed the predetermined distance, the flow proceeds to step S3160.

In step S3160, the control circuit 40 stops the feed-out of the base tape 16 and the cover film 11 from the base tape roll 17 and the cover film roll 12, and the feeding of the base tape 16, etc., similar to step S160 of FIG. 12.

Subsequently, in step S3165, the control circuit 40 ends detection of the feeding distance and encoder pulse, which was started in the above-described step S3110, and calculates the feeding distance L and the number of encoder pulses N from step S3110 to step S3165 (equivalent to the aforementioned predetermined time range). Note that the number of encoder pulses N in this case is determined only by the number of detected encoder pulses of the first optical sensor 51 from step S3110 to step S3165, and is a value that is not affected by the behavior of the encoder pulse stream consecutively detected by the first optical sensor 51 in parallel with feeding in the intermediate period thereof. Further, in this step S3165, the feeding distance L from step S3110 is calculated, thereby substantially calculating and updating the value of the residual tape amount M each time one printed label LB1 is produced (in other words, a tape length corresponding to one printed label length is set as the feeding distance L). Note that, as described later, the residual tape amount M may also be found by using any other tape length (100 mm, for example) as the calculation unit of the feeding distance L and calculating the number of encoder pulses N of that time period.

Subsequently, in step S3170, the control circuit 40 determines whether or not the above-described cutter driving button 38 has been manually operated by the operator, similar to step S170 of FIG. 12. If the cutter driving button 38 has been manually operated, the decision is made that the condition is satisfied and the flow proceeds to step S3180.

Then, in step S3180, the control circuit 40 cuts the label tape 23 with print using the cutter 28, similar to step S180 of FIG. 12. This results in formation of the printed label LB1 on which printing corresponding to the print-head driving data was performed.

Subsequently, in step S3190, the control circuit 40 discharges the printed label LB1 formed into a label shape in the above-described step S3180 to outside the apparatus, similar to step S190 of FIG. 12. Note that in a case where the printed label LB1 can be manually discharged to the outside, the step S3190 may be omitted. This routine then terminates here.

In the above-described third embodiment, the cartridge sensor 37 acquires the type information of the cartridge 10, etc., mounted to the cartridge holder 27. The detected body 74 that rotates at an angular velocity (the same angular velocity in this example) in coordination with the angular velocity of the tape rolls 17, 17', and 17" is provided, and the first optical sensor 51 optically detects the detection mark 75 of the detected body 74. Then, the control circuit 40, in the above-described step S50 of FIG. 11, calculates the residual tape amount M of the tape rolls 17, 17', and 17" based on the tape thickness and inside tape roll diameter based on the type information acquired by the cartridge sensor 37, the number of detection mark 75 (the number of encoder pulses) detected by the first optical sensor 51, and the feeding distance calculated by feeding distance calculation processing. Then, in step S60, the residual tape amount information corresponding to the residual tape amount M thus calculated is outputted to the operation terminal 400. As a result, the residual tape amount M can be displayed on the display part 401 of the operation terminal 400.

With the residual tape amount M thus calculated based on the tape thickness t and the inside tape roll diameter d corresponding to the type information of the cartridge 10, etc., the detection result of the first optical sensor 51, and the feeding distance calculation result, it is possible to calculate the residual tape amount M corresponding to the type of cartridge, even in a case where the aforementioned cartridges 10, 10', and 10" of a plurality of different types are used in the label producing apparatus 100. As a result, the operator can reliably recognize the residual tape amount M, even in a case where a plurality of different types of printed labels LB1 is produced. In particular, when the residual tape amount M is calculated, the calculation is made using the number of encoder pulses N detected during the predetermined feeding distance L from the above-described step S3110 to step S3165, thereby making it possible to calculate the residual tape amount M regardless of the value of or fluctuation in the tape feeding speed during that feeding period. Therefore, even in a case where a plurality of tape feeding speeds is used in the label producing apparatus 100 capable of variable tape feeding speed settings (for example, an apparatus comprising high-speed print mode, normal speed print mode, etc.), or a case where the feeding speed immediately after tape feeding is started and immediately before tape feeding is stopped is not always constant, the residual tape amount M can be reliably calculated.

Further, in this embodiment in particular, the control circuit 40 acquires the inside tape roll diameter d and the tape thickness t related to the tape rolls 17, 17', and 17" based on the type information of the cartridge 10, etc., acquired by the cartridge sensor 37 in the above-described step S40. In addition, in step S3165, the control circuit 40 acquires the feeding distance L and the number of encoder pulses N. Then, in step S50, the control circuit 40 calculates the residual tape amount M based on the "Equation C1" and "Equation C2" using the inside tape roll diameter d, tape thickness t, feeding distance L, and number of encoder pulses N thus acquired. With the residual tape amount M thus consecutively calculated, the residual tape amount can be detected with high accuracy in comparison to a case where the residual tape amount M is identified using a residual amount table prepared in advance, for example, without the accuracy being affected by the volume of data in a table. In turn, the operator can identify in detail the residual tape amount. Further, since the residual tape amount M can be detected with high accuracy, it is also possible to perform processing based on the residual tape amount, such as continually producing printed labels LB1 in accordance with the residual tape amount, or controlling the feeding force (tape feed-out force) via the feeding roller 18 in accordance with the residual tape amount such as by, for example, adjusting the time interval from a stopped state to the state of arrival at a predetermined feeding speed to improve the stability of tape feeding.

Further, in this embodiment in particular, in general when the type of cartridge differs, the parameter information such as the tape thickness of the label producing tapes 16, 16', and 16" and the inside diameter of the tape rolls 17, 17', and 17", etc., also differ, and thus a parameter table that indicates the tape thickness t of the label producing tapes 16, 16', and 16" and the roll inside diameter d of the tape rolls 17, 17', and 17" for each of the types of the cartridge 10, etc., is stored in advance in the table storage part 49. Then, the control circuit 40 refers to the parameter table in the above-described step S40, and acquires as parameter information the roll inside diameter d of the tape rolls 17, 17', and 17" and the tape thickness t corresponding to the type information of the cartridge 10, etc., acquired by the cartridge sensor 37. With the tape thickness t and the roll inside diameter d of the tape rolls 17, 17', and 17" thus identified using a parameter table prepared in advance, it is possible to decrease the amount of information to be acquired and simplify the structure of the cartridge sensor 37, which is a mechanical sensor mechanism, compared to a case where the tape thickness t and the roll inside diameter d of the tape rolls 17, 17', and 17" are acquired in addition to the cartridge type information by the cartridge sensor 37.

Note that various modifications may be made according to the third embodiment without departing from the spirit and scope of the disclosure, in addition to the above-described embodiment. Description will be made below regarding such modifications.

(3-1) Using a Residual Amount Table

While in the above-described third embodiment the control circuit 40 calculates the residual tape amount M using the above-described "Equation C1" and "Equation C2" based on the calculated feeding distance L, the number of encoder pulses N based on the detection result of the first optical sensor 51, and the tape thickness t and the roll inside diameter d acquired from the parameter table, the residual tape amount M may be calculated in advance and a residual amount table that indicates the correlation between the feeding distance L and the residual tape amount M for each of the cartridge types may be stored in the table storage part 49.

An example of a residual amount table stored in the table storage part 49 will now be described with reference to FIG. 39. In the residual amount table shown in FIG. 39, the feeding distance L calculated by the above-described feeding distance calculation processing during the period in which the first optical sensor 51 detects a predetermined number of detection mark 75 (from the moment one of the detection mark 75 is detected to the moment the next detection mark 75 is detected, in this example), i.e., during the period in which the first optical sensor 51 outputs a predetermined number of encoder pulse signals, the roll outside diameter D (mm), and the residual tape amount M (mm) of each cartridge type are registered in association in advance. The residual tape amount M is calculated from the above-described "Equation C1" and "Equation C2" using the values of each of the parameters shown in the previously described FIG. 13. While the roll outside diameter D and the feeding distance L per encoder pulse increase upward in the table, the roll outside diameter D and the feeding distance L per encoder pulse decrease downward in the table as the roll tape is consumed.

Note that the feeding distance L may be the distance between a plurality of encoder pulses rather than from one encoder pulse to another as described above, or may be the entire period required for production of the printed label LB1 (in other words, the feeding distance fed when producing one printed label LB1). Further, in a case where the feeding distance L from one encoder pulse to another is calculated, the calculation may be performed a plurality of times and the average value thereof used.

The control procedure executed by the control circuit 40 in this exemplary modification is the same as that described in the above-described first embodiment with reference to FIG. 17. That is, step S10 to step S30 are substantially the same as those in the aforementioned FIG. 11, and after step S30, in step S100, the aforementioned label production processing is performed. Subsequently, the flow proceeds to step S50A. In step S50A, the control circuit 40 refers to the section in the above-described residual amount table stored in the table storage part 49 that corresponds to the type of the cartridge detected in the aforementioned step S10, and identifies the residual tape amount M corresponding to the feeding distance L per encoder pulse based on the calculation result of the feeding distance calculation processing. That is, in this case, there is no need to perform calculations using the "Equation C1" and "Equation C2" based on the inside tape roll diameter d, tape thickness t, feeding distance L, and number of encoder pulses N as in the above-described third embodiment. The subsequent step S60 is identical to that of FIG. 11.

Specifically, in a case where the cartridge 10 of a laminated type is mounted, for example, and the feeding distance L per encoder pulse obtained from the calculation result of the feeding distance calculation processing is 2.17 (mm), the residual tape amount M is 5308 (mm) as shown in FIG. 39. Therefore, at the moment the feeding distance L becomes 2.17 (mm), the residual tape amount M is displayed as 5308 (mm) and continues to be displayed as 5308 (mm) until the feeding distance L changes to the next value 2.16 (mm). Then, when tape consumption causes the feeding distance L to change to the next value 2.16 (mm), for example, the residual tape amount display changes to 5242 (mm). Thus, the corresponding residual tape amount display may be changed with each 0.01 (mm) change in the feeding distance L.

According to this exemplary modification, the residual tape amount M is identified using a residual amount table prepared in advance and thus, compared to a case where the residual tape amount M is consecutively calculated based on the detection result of the first optical sensor 51 as in the above-described third embodiment, does not require calculations (or significantly suppresses the calculation volume), thereby simplifying the control contents related to residual tape amount detection. As a result, the CPU, etc., can be designed with low specifications, thereby achieving lower costs. Further, this exemplary modification also offers the advantage of shortening the time required to identify the residual tape amount to the extent that calculations are no longer required.

Note that while in this exemplary modification the residual amount table utilized employs the feeding distance L for reference, another residual amount table may be utilized. Another example of a residual amount table stored in the table storage part 49 will now be described with reference to FIG. 40. In the residual amount table shown in FIG. 40, the number of detection mark 75 detected by the first optical sensor 51 until the feeding distance L calculated as described above reaches a predetermined fixed value (100 mm in this example), and the residual tape amount M (mm) corresponding to each cartridge type are registered in association in advance. The residual tape amount M is calculated using the above-described "Equation C1" and "Equation C2" using the values of each of the parameters shown in FIG. 13 of the above-described first embodiment. While the roll outside diameter D increases and the number of encoder pulses up to a feeding distance of 100 mm decreases upward in the table, the roll outside diameter D decreases and the number of encoder pulses up to a feeding distance of 100 mm increases downward in the table as the roll tape is consumed.

In a case where the residual amount table shown in FIG. 40 is used, in step S50A of the flowchart shown in the aforementioned FIG. 17, the control circuit 40 may refer to the section in the residual amount table stored in the table storage part 49 that corresponds to the type of the cartridge detected in the aforementioned step S10, convert the value to the number of encoder pulses per the above-described feeding distance 100 mm based on the calculation result of the feeding distance calculation processing and the detection result of the first optical sensor 51, and identify the residual tape amount M corresponding to that number of encoder pulses N.

Specifically, for example, in a case where the cartridge 10 of a laminated type is mounted and the number of encoder pulses N per 100 mm converted as described above is 52, the residual tape amount M is 3763 (mm), as shown in FIG. 40. Therefore, the moment that the number of encoder pulses N reaches 52, the residual tape amount M is displayed as 3763 (mm) and is subsequently changed to 3551 (mm) once the number of encoder pulses N per 1010 mm changes to the next value 53 with further tape consumption, for example. Thus, the corresponding residual tape amount display is changed for each change of 1 in the number of encoder pulses N.

Furthermore, a table that integrates the residual amount tables of the above-described two exemplary modifications may be prepared in advance. An example of such a table is illustrated in FIG. 41. In the example shown in FIG. 41, the relationship between the residual tape amount M, the feeding distance L, and the number of encoder pulses N for each type is registered in advance and stored in the above-described table storage part 49 in a format that integrates the above-described two residual amount tables. In particular in this example, a table that is more roughly set than the aforementioned two tables is formed. In the example shown in FIG. 41, the feeding distance L from one encoder pulse to another that is based on the detection result of the above-described first optical sensor 51 and the number of encoder pulses N from the first optical sensor 51 are calculated in advance and registered for each 1 (m) of residual tape amount.

In such a case, when the feeding distance L is detected as 2.00 (mm), for example, the residual tape amount M may be displayed as "4-5 m" for the laminated type, "5-6 m" for the receptor type, and "2-3 m" for the thermal type. Similarly, when the number of encoder pulses N is detected as 53, for example, the residual tape amount M may be displayed as "3-4 m" for the laminated type, "4-5 m" for the receptor type, and "1-2 m" for the thermal type.

(3-2) Not Using a Cartridge

The following describes an exemplary modification of the third embodiment for producing printed labels using tape rolls of a plurality of different types and not a cartridge.

In this exemplary modification, in the tag label producing apparatus 201 of the same configuration as the above-described exemplary modifications (1-2) and (2-2), the roll mounting mechanism 203 on which the tape rolls 300 of different types are mounted is selectively mounted on the roll housing part 204, making it possible to produce the printed label LB2 while selectively using different types of tape rolls as described above. Then, at this time, the type of the mounted tape roll 300 is detected and the residual tape amount M is calculated in accordance with that type in the same manner as the above-described third embodiment. In the following, the details of this procedure will be described in order.

The control procedure executed by the above-described control circuit 410 of the label producing apparatus 201 of this exemplary modification is the same as that described in the above-described exemplary modification (1-2) with reference to FIG. 31.

That is, similar to the above, in step S210, the control circuit 410 stores the detection result of the roll detection sensors S1 to S4 in the RAM of the above-described control circuit 410 and, in step S220, assesses whether or not a production instruction signal has been inputted. Subsequently, in step S230, the control circuit 410 generates and stores the print-head driving data in the print buffer inside the control circuit 410 and, in step S100' (described in detail later) corresponding to step S100 of the above-described third embodiment, executes label production processing for producing the printed label LB2 on which desired printing has been performed.

Then, in step S240, the control circuit 410 accesses the above-described table storage part 410A and refers to the parameter table (refer to FIG. 32 previously described) that indicates parameter information for calculating the residual tape amount for each type of the tape roll 300, etc. Then, in the parameter table, the control circuit 410 acquires the parameter information corresponding to the type of the tape roll 300 detected in the above-described step S210. This parameter information includes the tape thickness t of the tape 203A and the roll inside diameter d of the tape roll 300.

Subsequently, in step S250, the control circuit 410 calculates the residual tape amount. The calculation method of this residual tape amount is the same as the method used in the above-described third embodiment described with reference to FIG. 37, and is performed using the aforementioned "Equation C1" and "Equation C2." That is:

$$M=\pi(D^2-d^2)/4t \quad \text{(Equation C1)}$$

$$D=2L/\theta N \quad \text{(Equation C2)}$$

Similar to the above-described third embodiment, the tape thickness t and the roll inside diameter d are acquired from the aforementioned parameter table. The feeding distance L can be calculated based on the number of motor pulse signals inputted to the platen roller driving circuit 409 in the predetermined time range. Then, the number of encoder pulses N of the predetermined time range is the number of encoder pulses outputted from the optical sensor 251 in accordance with the detection mark 275 of the plurality of detection mark 275 provided to the detected body 274. Note that, in this embodiment, 16 detection mark 275 are formed on the detected body 274 as previously described, and thus the angle θ is $2\pi/16=\pi/8$ [rad]. This angle θ is also stored in advance in the RAM.

Thus, the control circuit 410 can calculate the feeding distance L based on the above-described number of motor pulse signals. Then, the control circuit 410 calculates the roll outside diameter D of the roll 300 based on the above-described "Equation C2" from this feeding distance L, the number of encoder pulses N outputted from the optical sensor 251 in the above-described predetermined time range corresponding to the feeding distance L, and the above-described angle θ read from the RAM 48. Then, the residual tape amount M can be calculated based on the above-described "Equation C1" from this calculated roll outside diameter D and the tape thickness t and roll inside diameter d acquired from the above-described parameter table.

Subsequently, in step S260, the control circuit 410 outputs the residual tape amount information corresponding to the above-described calculated residual tape amount M to another terminal, general-purpose computer, etc., via the communication circuit 411B. As a result, the residual tape amount M is displayed on the display part of the other terminal or general-purpose computer (or may be displayed on suitable display device provided to the label producing apparatus 201). This process then terminates here.

The detailed procedure of the above-described step S100' is the same as the procedure of step S100 of the above-described first embodiment, and the contents thereof will now be described with reference to the above-described FIG. 38.

Figure 38:
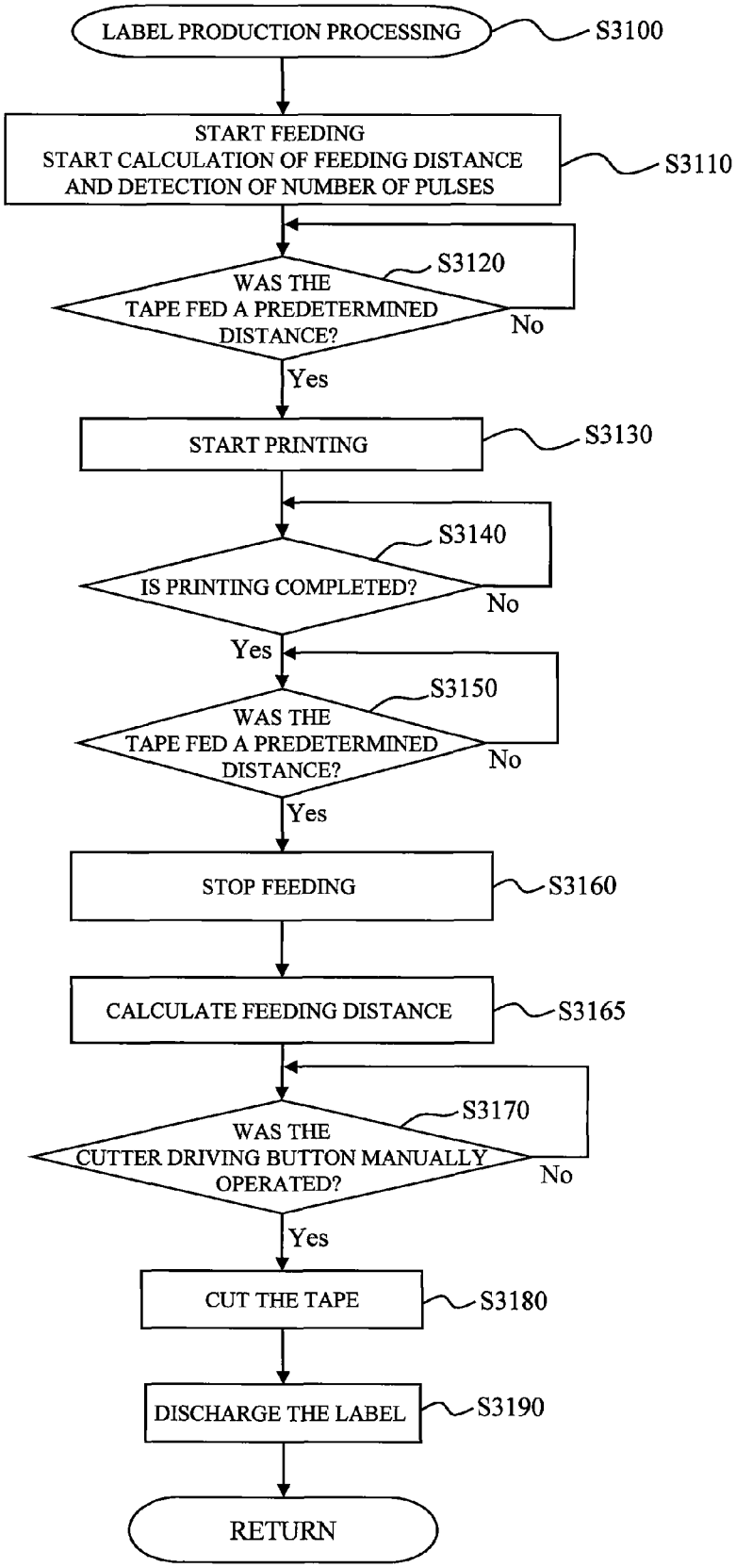
FIG. 38 is a flowchart illustrating the detailed procedure of step S100 executed by the control circuit of the label producing apparatus of the third embodiment of the present disclosure.

In the above-described FIG. 38, in step S3110, the control circuit 410 outputs a control signal (motor pulse signal) to the platen roller circuit 409 and drives the platen roller 226 by the platen roller motor 408. As a result, the feed-out and feeding of the tape 203A from the tape roll 300 are started. Further, in this step S3110, calculation of the feeding distance based on the above-described motor pulse signal is also started. This calculation may be made by, for example, storing the counter value of the motor pulse signal at that time in the above-described RAM, etc., as the value at the time that feeding started, and finding the deviation up to the counter value of the motor pulse signal in step S3165 described later, or clearing the counter value of the motor pulse signal at that time to zero, which is the initial value. Further, in this step S3110, detection (counting) of the encoder pulse detected by the above-described optical sensor 251 is also started. This counting may be performed by, for example, clearing the number of encoder pulses at that time to zero, and then counting the number of encoder pulses detected by the optical sensor 251 up to step S3165 described later.

Subsequently, in step S3120, the control circuit 410 determines whether or not the tape 203A has been fed a predetermined distance. This predetermined distance, similar to the above-described third embodiment, is the feeding distance required for the front end of the above-described print area SA of the tape 203A to reach the position substantially opposite the thermal head 231, for example. The feeding distance may be determined based on the above-described motor pulse signal or by detecting a marking provided to the tape 203A using a known sensor (not shown). Until the tape is fed the predetermined distance, the decision is made that the condition is not satisfied and the routine enters a wait loop. Then, once the tape is fed the predetermined distance, the decision is made that the condition is satisfied and the flow proceeds to step S3130.

In step S3130, the control circuit 410 outputs a control signal to the print-head driving circuit 405, causing the thermal head 231 to start printing in accordance with the print-head driving data in the print area SA of the tape 203A.

Then, in step S3140, the control circuit 410 determines whether or not all of the printing in the above-described print area SA of the tape 203A is completed. Until all of the printing is completed, the condition is not satisfied and the control circuit 410 enters a wait loop. Then, once all of the printing is completed, the decision is made that the condition is satisfied and the flow proceeds to step S3150.

In step S3150, the control circuit 410 determines whether or not the tape 203A has been further fed a predetermined distance. The feeding distance at this time may be assessed based on the motor pulse signal, etc., in the same manner as described above. Until the tape 203A is fed the predetermined distance, the decision is made that the condition is not satisfied and the routine enters a wait loop. Then, once the tape 203A is fed the predetermined distance, the decision is made that the condition is satisfied and the flow proceeds to step S3160.

In step S3160, the control circuit 410 stops output of the motor pulse signal to the platen roller driving circuit 409, thereby stopping the driving of the platen roller 226 by the platen roller motor 408, and stopping the feed-out and feeding of the tape 203A from the tape roll 300.

Subsequently, in step S3165, the control circuit 410 ends detection of the feeding distance and encoder pulse, which was started in the above-described step S3110, and calculates the feeding distance L and the number of encoder pulses N from step S3110 to step S3165 (equivalent to the aforementioned predetermined time range). Note that the number of encoder pulses N in this case is determined only by the number of detected encoder pulses of the optical sensor 251 from step S3110 to step S3165, and is a value that is not affected by the behavior of the encoder pulse stream consecutively detected by the optical sensor 251 in parallel with the feeding in the intermediate period thereof. Further, in this step S3165, the feeding distance L from step S3110 is calculated, thereby substantially calculating and updating the value of the residual tape amount M each time one printed label LB2 is produced (in other words, a tape length corresponding to one printed label length is set as the feeding distance L). Note that, as described later, the residual tape amount M may also be found by using any other tape length (100 mm, for example) as the calculation unit of the feeding distance L and calculating the number of encoder pulses N of that time period.

Then, with the feeding stopped, the tape 203A is cut when the operator manually operates the above-described cutter lever 209, and the printed label LB2 on which printing was performed in accordance with the print-head driving data is formed and discharged outside the apparatus. In this exemplary modification, step S3170, step S3180, and step S3190 of FIG. 38 are omitted and subsequently the routine ends.

In the above-described exemplary modification, the roll detection sensors S1 to S4 acquire the type information of the tape roll 300 mounted to the roll housing part 204 via the roll housing mechanism 203. The optical sensor 251 optically detects the detection mark 275 of the detected body 274 that rotates at an angular velocity (the same angular velocity in this example) in coordination with the angular velocity of the roll 300. Then, the control circuit 410 calculates the residual tape amount M of the tape roll 300 based on the tape thickness and inside tape roll diameter based on the type information acquired by the roll detection sensors S1 to S4 in the above-described step S250, the number of detection mark 275 (the number of encoder pulses) detected by the optical sensor 251, and the feeding distance calculated by the feeding distance calculation processing. Then, in step S260, the residual tape amount information corresponding to the residual tape amount thus calculated is outputted. With this arrangement, it is possible to display the residual tape amount M to the operator.

With the residual tape amount M thus calculated based on the tape thickness t and the inside tape roll diameter d corresponding to the type information of the tape roll 300, the detection result of the optical sensor 251, and the detection result of the feeding distance calculation processing in the same manner as in the above-described third embodiment, it is possible to calculate the residual tape amount M corresponding to the roll type, even in a case where the tape roll 300 of a plurality of different types is used in the label producing apparatus 201. As a result, the operator can reliably recognize the residual tape amount M, even in a case where a plurality of different types of printed labels LB2 is produced. In particular, when the residual tape amount M is calculated, the calculation is made using the number of encoder pulses N detected during the predetermined feeding distance L from the above-described step S110 to step S165, thereby making it possible to calculate the residual tape amount M regardless of the value of or the fluctuation in the tape feeding speed during that feeding period. Therefore, even in a case where a plurality of tape feeding speeds is used in the label producing apparatus 201 capable of variable tape feeding speed settings (for example, an apparatus comprising high-speed print mode, normal speed print mode, etc.), or a case where the feeding speed immediately after tape feeding is started and immediately before tape feeding is stopped is not always constant, the residual tape amount M can be reliably calculated.

Further, in this exemplary modification in particular, the control circuit 410 acquires the inside tape roll diameter d and the tape thickness t related to the tape roll 300 based on the type information of the tape roll 300 acquired by the roll detection sensors S1 to S4 in the above-described step S240. In step S165, the control circuit 410 acquires the feeding distance L and the number of encoder pulses N. Then, in step S250, the control circuit 410 calculates the residual tape amount M based on the "Equation C1" and "Equation C2" using the inside tape roll diameter d, tape thickness t, feeding distance L, and number of encoder pulses N thus acquired. With the residual tape amount M thus consecutively calculated, the residual tape amount M can be detected with high accuracy in comparison to a case where the residual tape amount M is identified using a residual amount table prepared in advance, for example, without the accuracy being affected by the volume of data in a table. As a result, the operator can minutely identify the residual tape amount M.

Further, in this exemplary modification in particular, the table storage part 410A stores in advance a parameter table that indicates the tape thickness t of the tape 203A and the roll inside diameter d of the tape roll 300 for each type of the tape roll 300. Then, the control circuit 410 refers to the parameter table in the above-described step S240, and acquires as parameter information the roll inside diameter d of the tape roll 300 and the tape thickness t corresponding to the type information of the tape roll 300 acquired by the roll sensors S1 to S4. Further, with the tape thickness t and the roll inside diameter d of the tape roll 300 thus identified using a parameter table prepared in advance, it is possible to decrease the amount of information to be acquired and simplify the structure of the roll detection sensors S1 to S4, which are mechanical sensor mechanisms, compared to a case where the tape thickness t and the roll inside diameter d of the tape roll 300 are acquired in addition to the tape roll type information by the roll detection sensors S1 to S4.

(4) Exemplary Modifications Common to Each Embodiment (4-1) When the First Optical Sensor is a Transmissive Sensor While in the above a reflective sensor was used as the first optical sensor 51, a transmissive sensor may be used. The configuration in the vicinity of the cartridge in a case where a transmissive first optical sensor 51' is used will now be described with reference to FIG. 42.

Figure 42:
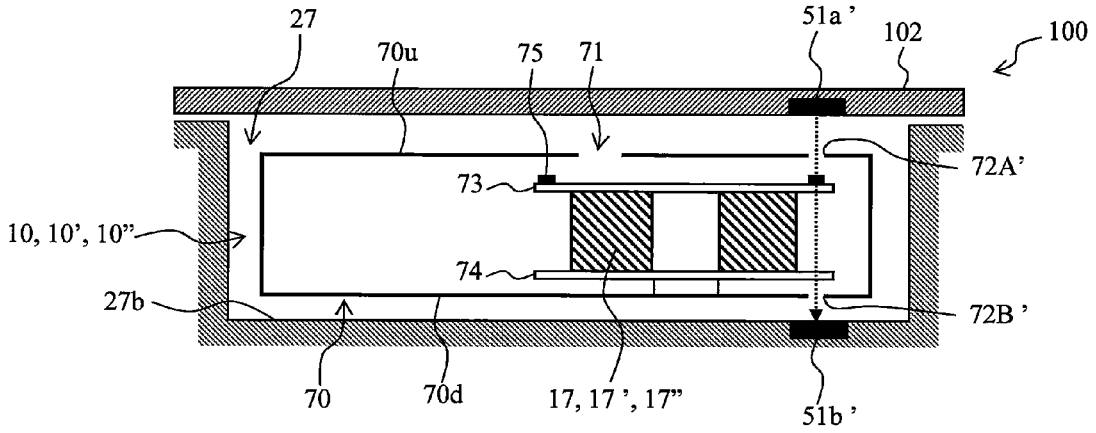
FIG. 42 is a side sectional view conceptually illustrating the configuration near the cartridge in a case where a transmission-type first optical sensor is used.

In this FIG. 42, the first optical sensor 51' of this exemplary embodiment is a transmissive optical sensor that comprises a light-emitting part 51*a*' and a light-receiving part 51*b*' and detects the detection light outputted from the light-emitting part 51*a*' and transmitted through the detected body 73 using the light-receiving part 51*b*'. The light-emitting part 51*a*' is provided to the inside of the opening/closing lid 102, and the light-receiving part 51*b*' is provided to the bottom 27*b* of the cartridge holder 27. When the opening/closing lid 102 is closed, the light-emitting part 51*a*' and the light-receiving part 51*b*' are disposed facing one side and the other side of the cartridge 10, etc., mounted to the cartridge holder 27. The detection mark 75 of the detected body 73 are made of a transparent or semi-transparent optically transmissive area 75*c* (not shown) and optically isolated area 75*s* (not shown).

Two transmission holes 72A' and 72B' through which the detection light from the above-described first optical sensor 51' is transmitted are respectively provided in positions corresponding to an upper part 70*u* and a lower part 70*d* of the cartridge housing 70. Further, in this exemplary modification, while the detection mark 75 may be formed on either of the provided film members 73 or 74 so as to contact both ends in the width direction (the vertical direction in FIG. 42) of the tape rolls 17, 17', and 17", the detection mark 75 are formed on the film member 73 on the upper side when the cartridge 10, etc., is mounted to the cartridge holder 27 in the example shown in FIG. 42. Thus, in this exemplary modification, the film member 73 is suitably referred to as the "detected body 73."

Other than the above, the components are the same as those in the aforementioned embodiments.

According to this exemplary modification, the transmissive first optical sensor 51' is used, and thus the sensor support mechanism 60 that supports the sensor in a retractable and extendable manner with respect to the cartridge holder 27 does not need to be provided as it was in the case where the reflective first optical sensor 51 is used. This makes it possible to simplify the structure of the label producing apparatus 100. Further, either of the film members 73 and 74 can be configured as the detected body, thereby improving the degree of freedom of design. Furthermore, even in a case where the film member 73 on the upper side serves as the detected body 73 as shown in FIG. 42, the detected body 73 is made of a transparent or semi-transparent film member, and thus the operator can view the tape rolls 17, 17', and 17" through the detected body 73 via the residual amount observation window 71, making it possible to roughly check the residual tape amount visually. At this time, the detection mark 75 are provided to the outer peripheral end of the detected body 73, and do not become a hindrance to the detection mark 75 when the residual tape amount is viewed.

(4-2) When Issuing an Alarm when the Residual Tape Amount Becomes Low

When the residual tape amount becomes less than or equal to a preset lower limit, an alarm may be issued. The control contents executed by the control circuit 40 of this exemplary modification will now be described with reference to FIG. 43.

Figure 43:
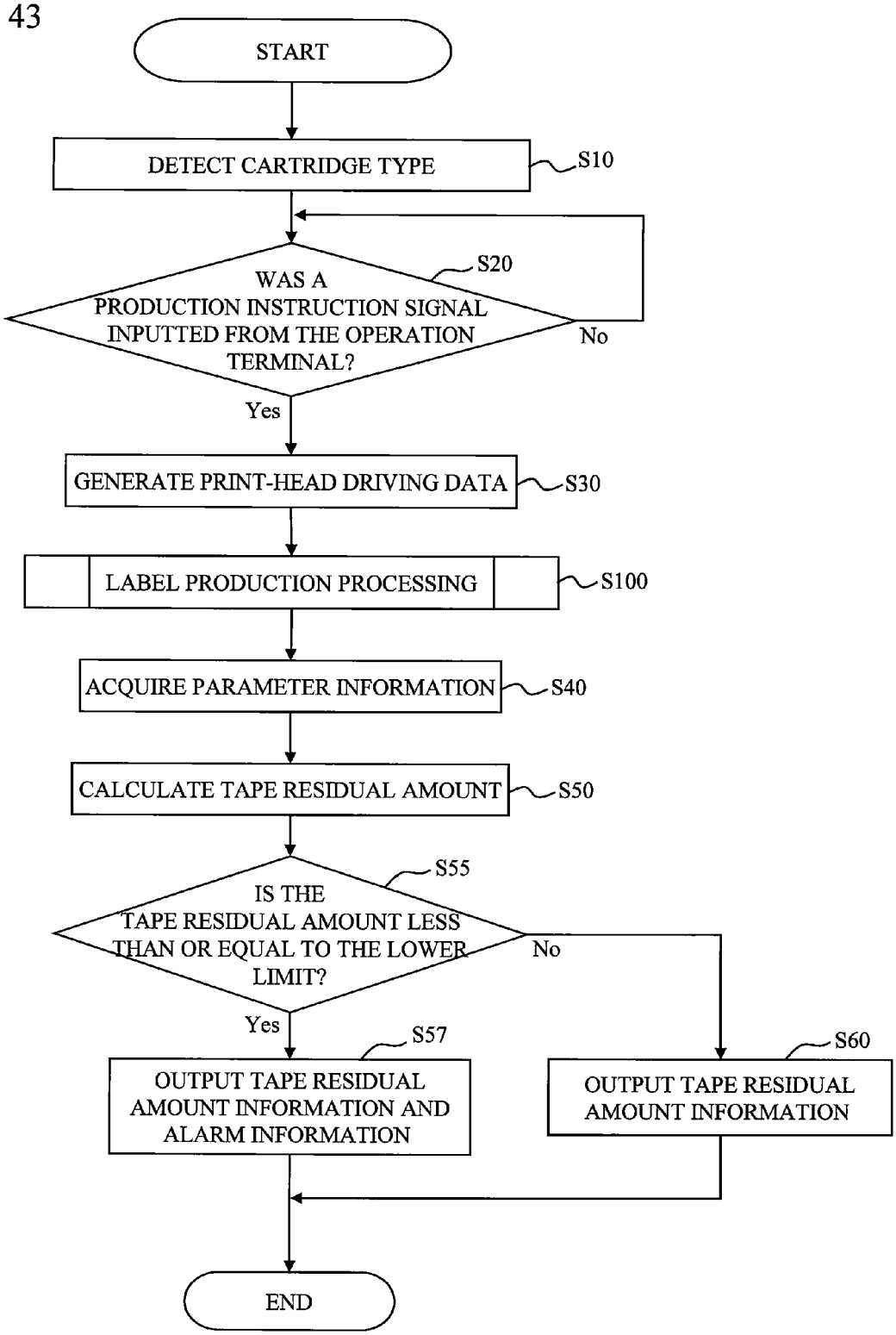
FIG. 43 is a flowchart illustrating the control content executed by the control circuit in a case where an alarm is issued when the residual tape amount is low.

In FIG. 43, step S10 to step S50 are the same as those of FIG. 11 previously described, and descriptions thereof will be omitted. In the next step S55, the control circuit 40 assesses whether or not the residual tape amount calculated in the aforementioned step S50 has decreased to or below a lower limit. This lower limit is a value preset as a residual tape amount to be alerted to the operator, and is stored in advance in the RAM 48, for example. If the residual tape amount is less than or equal to the lower limit, the decision is made that the condition is satisfied and the flow proceeds to step S57.

In step S57, the control circuit 40 outputs the residual tape amount information corresponding to the above-described calculated residual tape amount as well as the predetermined alarm information indicating that the residual tape amount is low to the operation terminal 400 via the communication line NW. As a result, the residual tape amount and an alarm are then displayed on the display part 401 of the operation terminal 400. This process then terminates here.

On the other hand, if the residual tape amount is greater than the lower limit in the above-described step S55, the decision is made that the condition is not satisfied and the flow proceeds to step S60. Step S60 is the same as that in the aforementioned FIG. 11, and the above-described residual tape amount information is outputted to the operation terminal 400 via the communication line NW. As a result, the residual tape amount is then displayed on the display part 401 of the operation terminal 400. This process then terminates here.

According to the above-described exemplary modification, the operator is alerted when the residual tape amount decreases below a predetermined value, making it possible to prevent the occurrence of an apparatus defect that would result should the operator not realize that the tape has reached its end and perform printing without any tape.

Note that while only a lower limit was established as a threshold value in the above-described embodiment, a plurality of threshold values incrementally set may be set in advance and the incremental residual amount information corresponding to each of the threshold values may be respectively outputted to the operation terminal 400 each time the residual value decreases to or below each of these threshold values. With this arrangement, as the residual tape amount gradually decreases, the operator can be notified in stages of the residual tape amount by a text display, such as "High," "Medium," or "Low," a graphic or symbol display such as a bar graph, or any other type of display.

Further, while the above has described an illustrative scenario in which the exemplary modification was applied to the control of the control circuit 40 of the label producing apparatus 100, the exemplary modification can also be applied to the control of the control circuit 410 of the label producing apparatus 201 shown in FIG. 31, etc. In each of these cases as well, the same advantages as described above are achieved.

(4-3) Other

While the above has described an illustrative scenario in which the detected bodies 74 and 274 are provided to the cartridge 10 and the tape roll 300 in each of the above embodiments and exemplary modifications, the present disclosure is not limited thereto, allowing provision of the detected body to the tape side or the apparatus housing side of the label producing apparatus. In a case where the detected body is provided to the apparatus housing side, the rotation of the roll may be transmitted to the detected body provided to the apparatus housing side via a suitable rotation transmission mechanism, thereby rotating the detected body at an angular velocity (not necessarily the same angular velocity) in coordination with the rotation of the roll, resulting in detection of the angular velocity of the detected body thus rotated. In this case as well, the same advantages as described above are achieved.

Further, while in the above the display part 401 of the operation terminal 400 that is separate from the label producing apparatuses 100 and 201 is used as a display device for displaying the residual tape amount, the present disclosure is not limited thereto, allowing the display part to be integrally provided with the label producing apparatuses 100 and 201 and used as the display device.

Further, while the above has been described in connection with an illustrative scenario in which the printed label tape 23 with print is cut by the cutter 28 and the cutter unit 208 so as to produce the printed label LB1, the present disclosure is not limited thereto. That is, in a case where a label mount (a so-called die cut label) separated in advance to a predetermined size corresponding to the label is continuously disposed on the tape fed out from the roll, the present disclosure may also be applied to a case where the label is not cut by the cutter 28 or the cutter unit 208 but rather the label mount (a label mount on which corresponding printing has been performed) only is peeled from the tape after the tape has been discharged from the tape discharging exit 104 (or onto the tray 206) so as to form the printed label LB1.

Note that the arrow shown in each figure, such as FIG. 8 and FIG. 26, in the above denotes an example of signal flow, but the signal flow direction is not limited thereto. Also note that the present disclosure is not limited to the procedures shown in the flowcharts of FIG. 11, FIG. 12, FIG. 31, FIG. 33, FIG. 35, FIG. 38, etc., and procedure additions and deletions as well as sequence changes may be made without departing from the spirit and scope of the disclosure.

Additionally, other than those previously described, methods according to the above-described embodiments and modification examples may be utilized in combination as appropriate.

What is claimed is:

1. A label producing apparatus comprising:

an apparatus housing constituting an apparatus outer shell;

a cartridge holder arranged on said apparatus housing that detachably mounts thereon a tape cartridge that includes a tape roll winding a label producing tape inside a cartridge housing;

an optical detecting device that optically detects a plurality of detection mark formed at a predetermined interval along a peripheral direction of a detected body from outside of said cartridge housing, the detected body being provided inside the cartridge housing of said tape cartridge mounted to said cartridge holder so as to rotate at a same angular velocity as said tape roll;

a tape length calculator that calculates a tape length that is wound and remaining in said tape roll based on a detection result of said optical detecting device;

a residual amount related information output portion that outputs residual amount related information related to said tape length calculated by said tape length calculator to a display device;

a cartridge sensor configured to acquire type information of said tape cartridge mounted to said cartridge holder; and a first storage device that stores a residual amount table that indicates a correlation between an angular velocity of said tape roll and the tape length of said tape roll for each type of said tape roll; wherein said tape length calculator calculates the tape length of said tape roll by referring to said correlation corresponding to said type information acquired by said cartridge sensor in said residual amount table, and extracting said tape length corresponding to an angular velocity of said tape roll based on a detection result of said optical detecting device.

2. A label producing apparatus comprising:

an apparatus housing constituting an apparatus outer shell;

a cartridge holder arranged on said apparatus housing that detachably mounts thereon a tape cartridge that includes a tape roll winding a label producing tape inside a cartridge housing;

an optical detecting device that optically detects a plurality of detection mark formed at a predetermined interval along a peripheral direction of a detected body from outside of said cartridge housing, the detected body being provided inside the cartridge housing of said tape cartridge mounted to said cartridge holder so as to rotate at a same angular velocity as said tape roll;

a tape length calculator that calculates a tape length that is wound and remaining in said tape roll based on a detection result of said optical detecting device;

a residual amount related information output portion that outputs residual amount related information related to said tape length calculated by said tape length calculator to a display device;

a cartridge sensor configured to acquire type information of said tape cartridge mounted to said cartridge holder;

a parameter information acquisition portion that acquires parameter information related to said tape roll based on said type information acquired by said cartridge sensor; and a second storage device that stores a parameter table that indicates a tape thickness of said label producing tape and an inside diameter of said tape roll for each type of said tape roll; wherein:

said parameter information acquisition portion acquires as said parameter information a tape thickness of said label producing tape and a inside diameter of said tape roll corresponding to said type information by referring to said parameter table; and said tape length calculator calculates the tape length of said tape roll by calculating said tape length based on predetermined calculation formulas using the tape thickness of said label producing tape and the inside diameter of said tape roll acquired by said parameter information acquisition portion, and an angular velocity of said tape roll based on a detection result of said optical detecting device.

3. The label producing apparatus according to claim 2, further comprising a feeding device that feeds said label producing tape fed out from said tape roll at a feeding speed S [mm/s]; wherein:

said tape length calculator calculates the tape length M based on an Equation 1 and an Equation 2 serving as said predetermined calculation formulas using the tape thickness t [mm] of said label producing tape and the roll inside diameter d [mm] of said tape roll acquired by said parameter information acquisition portion, and the angular velocity ω [rad/s] of said tape roll based on a detection result of said optical detecting device $$M=\pi(D^2-d^2)/4t \quad \text{(Equation 1)}$$

$$D=2S/\omega \quad \text{(Equation 2).}$$

4. A label producing apparatus comprising:

an apparatus housing constituting an apparatus outer shell;

a cartridge holder arranged on said apparatus housing that detachably mounts thereon a tape cartridge that includes a tape roll winding a label producing tape inside a cartridge housing;

an optical detecting device that optically detects a plurality of detection mark formed at a predetermined interval along a peripheral direction of a detected body from outside of said cartridge housing, the detected body being provided inside the cartridge housing of said tape cartridge mounted to said cartridge holder so as to rotate at a same angular velocity as said tape roll;

a tape length calculator that calculates a tape length that is wound and remaining in said tape roll based on a detection result of said optical detecting device;

a residual amount related information output portion that outputs residual amount related information related to said tape length calculated by said tape length calculator to a display device;

a cartridge sensor configured to acquire type information of said tape cartridge mounted to said cartridge holder;

a storage device that stores a parameter table that indicates a tape thickness of said label producing tape and an inside diameter of said tape roll for each type of said tape roll;

a parameter information acquisition portion that acquires a tape thickness of said label producing tape and an inside diameter of said tape roll corresponding to said type information acquired by said cartridge sensor by referring to said parameter table;

a feeding device that feeds said label producing tape fed out from said tape roll;

a setting portion configured to set a feeding speed of said feeding device variably; and a feeding distance calculation portion that calculates a feeding distance caused by said feeding device; wherein:

said tape length calculator calculates the tape length of said tape roll, with using the tape thickness of said label producing tape and the inside diameter of said tape roll acquired by said parameter information acquisition portion, a number of said detection mark detected by said optical detecting device; and said feeding distance calculated by said feeding distance calculation portion, in a case where a feeding distance L [mm] is calculated by said feeding distance calculation portion when N of said detection marks are detected by said optical detecting device by calculating said tape length based on predetermined calculation formulas using the number N and feeding distance L.

5. The label producing apparatus according to claim 4, wherein:

said tape length calculator calculates the tape length M [mm] based on the equations below given an roll outside diameter D [mm] of said tape roll using a disposed pitch angle θ [rad] of said plurality of detection marks determined in advance, the number N of said detection mark and said feeding distance L, and the tape thickness t [mm] of said label producing tape and the roll inside diameter d [mm] of said tape roll acquired by said parameter information acquisition portion:

$$D=2L/\theta N \quad \text{(Equation A)}$$

$$M=\pi(D^2-d^2)/4t \quad \text{(Equation B).}$$

6. The label producing apparatus according to claim 5, further comprising a fifth storage device that stores a residual amount table that indicates a correlation between a number N of said detection mark and said feeding distance L and said tape length, for each of said tape rolls; wherein:

said tape length calculator calculates the tape length of said tape roll by referring to said correlation corresponding to said type information acquired by said type information acquisition portion in said residual amount table, and extracting said tape length corresponding to a number N and feeding distance L when the feeding distance L is detected by said feeding distance calculation portion when N of said detection marks are detected by said optical detecting device.

7. A label producing apparatus comprising:

an apparatus housing constituting an apparatus outer shell;

a cartridge holder arranged on said apparatus housing that detachably mounts thereon a tape cartridge that includes a tape roll winding a label producing tape inside a cartridge housing;

an optical detecting device that optically detects a plurality of detection mark formed at a predetermined interval along a peripheral direction of a detected body from outside of said cartridge housing, the detected body being provided inside the cartridge housing of said tape cartridge mounted to said cartridge holder so as to rotate at a same angular velocity as said tape roll;

a tape length calculator configured to calculate a length of the tape that remains around said tape roll by means of using a predetermined correlation between a tape length of said tape roll and an angular velocity of said tape roll based on a detection result of said optical detecting device;

a residual amount related information output portion that outputs residual amount related information related to said tape length calculated by said tape length calculator to a display device;

a spring provided to said cartridge holder that applies force to said optical detecting device along a direction where the optical detecting device is far away from a bottom of said cartridge holder; and an expansion and contraction sensor that detects an expansion and contraction state of said spring.

8. The label producing apparatus according to claim 7, wherein:

said residual amount related information output portion outputs alarm information as said residual amount related information in a case where the tape length calculated by said tape length calculator is less than or equal to a preset lower limit.

9. The label producing apparatus according to claim 8, wherein:

said residual amount related information output portion, in a case where the tape length calculated by said tape length calculator becomes less than or equal to each of a plurality of threshold values incrementally set in advance, respectively outputs incremental residual amount information corresponding to each threshold value as said residual amount related information.

10. The label producing apparatus according to claim 9, wherein:

said residual amount related information output portion outputs tape residual amount information corresponding to a tape length calculated by said tape length calculator as said residual amount related information.

* * * * *